US005213168A

United States Patent [19]

Warren et al.

[11] Patent Number: 5,213,168

[45] Date of Patent: May 25, 1993

[54] APPARATUS FOR DRILLING A CURVED SUBTERRANEAN BOREHOLE

[75] Inventors: Tommy M. Warren, Coweta; Houston B. Mount, II; Warren J. Winters, both of Tulsa, all of Okla.

[73] Assignee: Amoco Corporation, Chicago, Ill.

[21] Appl. No.: 786,863

[22] Filed: Nov. 1, 1991

[51] Int. Cl.[5] ..... F21B 7/08

[52] U.S. Cl. ..... 175/61; 175/75; 175/76

[58] Field of Search ..... 175/61, 73, 74, 75, 175/76, 320

[56] References Cited

U.S. PATENT DOCUMENTS

| | | | |
|---|---|---|---|
| 2,687,282 | 8/1954 | Sanders | 255/1.6 |
| 2,712,434 | 7/1955 | Giles et al. | 255/1.6 |
| 2,730,328 | 1/1956 | Brown | 255/1.6 |
| 2,745,635 | 5/1956 | Zublin | 255/1.6 |
| 2,819,040 | 1/1958 | James et al. | 255/1.6 |
| 2,919,897 | 1/1960 | Sims | 255/1.6 |
| 3,156,310 | 11/1964 | Frisby | 175/76 |
| 3,398,804 | 8/1968 | Holbert | 175/61 |
| 4,449,595 | 5/1984 | Holbert | 175/79 |
| 4,523,652 | 6/1985 | Schuh | 175/61 |
| 4,699,224 | 10/1987 | Burton | 175/61 |
| 4,815,342 | 3/1989 | Brett et al. | 76/108 A |
| 4,895,214 | 1/1990 | Schoeffler | 175/76 X |
| 4,948,925 | 8/1990 | Winters et al. | 175/48 |
| 4,982,802 | 1/1991 | Warren et al. | 255/1.6 |
| 5,010,789 | 4/1991 | Brett et al. | 76/108.2 |
| 5,042,596 | 8/1991 | Brett et al. | 175/389 |
| 5,113,953 | 5/1992 | Noble | 175/61 |

*Primary Examiner*—William P. Neuder

*Attorney, Agent, or Firm*—James A. Gabala; Richard A. Kretchmer; Frank J. Sroka

[57] ABSTRACT

A curve drilling assembly operable with a rotary drill string is provided for drilling a curved subterranean borehole. The assembly includes a curve guide, a rotary drill bit, an imbalance force assembly, and a bearing assembly. The curve guide is connectable with the drill string for deflecting the drill string toward the outside radius of the curved borehole. The imbalance force assembly, which preferably is provided by selectably disposing cutting elements on the drill bit, is rotatable with the drill string for creating a net imbalance force along a net imbalance force vector substantially perpendicular to the longitudinal axis of the drill bit during drilling. The bearing assembly is rotatable with the drill string and is located in the curve drilling assembly near the cutting elements of the drill bit for intersecting a force plane formed by the longitudinal bit axis and the net imbalance force vector and for substantially continuously contacting the borehole wall during drilling. Preferably, the bearing assembly includes a substantially smooth wear-resistant sliding surface. The curve guide includes a mandrel rotatably disposed within a housing. A contact ring may be provided at either the uphole or the downhole end of the mandrel for contacting the borehole wall and supporting the radial force component created by the deflection of the drill string at the end of the mandrel. A flexible joint may be connected to the end of the mandrel adjacent the contact ring for drilling curved boreholes having a short radius of curvature.

70 Claims, 22 Drawing Sheets

APPARATUS FOR DRILLING A CURVED SUBTERRANEAN BOREHOLE

BACKGROUND OF THE INVENTION

1. Field of the Invention

This invention relates to apparatus for drilling the curved portion of a subterranean borehole. More particularly, the invention relates to apparatus capable of initiating and controlling curved boreholes when drilling an oil or gas well.

2. Setting of the Invention

In producing subterranean fluids, such as oil and gas, thousands of feet of substantially vertical well bore or borehole are drilled into the earth to make a relatively few feet of contact with the producing formation or strata, since the formation often has limited vertical depth (some formations have as little as five feet) and much greater horizontal extent (e.g., thousands of feet). It is often desirable to increase the contact area of the borehole with the formation to increase the production rate of the well. Hydraulic fracturing is one known method of increasing the contact area which has been proven to increase production. Hydraulic fracturing is difficult to control.

Another known method of increasing the contact area of the borehole with the formation, which is the subject of this invention, is to drill horizontally or laterally into and through the formation. In order to do so, it is necessary to be able to drill a curved borehole, or curved section of borehole, from a substantially straight (normally vertical) borehole to the desired trajectory. Because of the limited vertical depth of some formations, in order to hit the formation with the curved borehole, it is desirable to be able to drill a curved borehole having a predictable radius of curvature. Even though it has the potential of being the least expensive and most reliable method of enhancing production rates by increasing the contact area of the borehole with the formation, curve drilling is not widely used at the present time because of shortcomings in the known curve drilling assemblies, such as in their durability, in their maintenance and operational expenses, and in their ability to drill a curved borehole having a predictable radius of curvature.

In order to accurately, repeatably, and predictably drill a curved subterranean borehole having a predetermined radius of curvature it is known that it is necessary to (1) initiate and maintain a deflection of the drill bit axis with respect to the axis of the borehole and (2) to control the azimuthal direction of the deflection in the borehole. Prior curve drilling assemblies have created and maintained the deflection by creating and maintaining a lateral force near the drill bit which forces the drill bit against the borehole sidewall in the desired azimuthal direction, and have controlled the azimuthal direction of the deflection by using a collar which engages the borehole sidewall or by using the weight of the drill string (weight-on-bit) to hold the deflection-creating device in position. The azimuthal direction is controlled so that the radius of curvature of the curved borehole will exist in a single radial plane, e.g., so the borehole will not have a helical or cork-screw trajectory and will drill in a single compass direction with respect to the borehole axis.

For example, U.S. Pat. Nos. 2,712,434; 2,730,328; 2,745,635; 2,819,040; 2,919,897; and 4,699,224 disclose using a collar on the drill string to create a lateral force which forces the drill bit into the borehole sidewall. U.S. Pat. Nos. 2,712,434 and 4,699,224 use a collar having an eccentric bore with the drill string passing through the eccentric bore to create the lateral force and the deflection. U.S. Pat. Nos. 2,730,328 and 2,745,635 effectively create a collar having an eccentric bore by extending shoes or springs from the collar when the collar is subjected to weight-on-bit so that the collar and drill bit are forced to one side of the borehole with the drill bit being forced into engagement with the borehole sidewall U.S. Pat. No. 2,819,040 uses a deflecting wedge which extends from the collar when the collar is subjected to weight-on-bit in order to create a lateral force which forces the drill bit into engagement with the borehole sidewall. U.S. Pat. No. 2,919,897 discloses using an eccentrically-shaped mandrel rotatable within an eccentrically-shaped deflection bearing to create a lateral force which forces the drill bit to one side of the borehole.

Once the collar is positioned to force the drill bit in the desired azimuthal direction, sidewall engaging ribs (U.S. Pat. Nos. 2,730,328 and 2,745,635), splines (U.S. Pat. No. 2,919,897), or angled projections or blades (U.S. Pat. Nos. 2,819,040 and 4,699,224) are used to prevent rotation of the collar with the drill string in order to fix the position, or rotational orientation, of the collar in the borehole and thereby fix the azimuthal direction of the deflection and the drill bit in the borehole. In U.S. Pat. Nos. 2,819,040 and 4,699,224 the projections or blades are angled to allow the collar to rotate with the drill string in one direction and to prevent rotation of the collar with the drill string in the other direction.

The above-mentioned patents also disclose apparatus for engaging the collar to the drill string for rotation with the drill string in order to rotationally orient the collar and thereby select the azimuthal direction of the deflection in the borehole. For example, U.S. Pat. Nos. 2,730,328 and 2,745,635 use the absence of weight-on-bit or axial loading to engage the collar to the drill string and the presence of weight-on-bit to disengage the collar from the drill string; U.S. Pat. No. 2,819,040 uses a hydraulically actuated piston; and U.S. Pat. Nos. 2,712,434 and 4,699,224 use a spring-actuated detent or cog which acts as a one-way clutch mechanism. U.S. Pat. No. 2,919,897 uses a key on the collar which engages a keyway in the drill string when the drill string is lifted and which disengages when weight is placed on bit and the splines on the collar have engaged the borehole to lift the collar with respect to the drill string and drill bit.

U.S. Pat. Nos. 2,687,282; 3,156,310; 3,398,804; 4,523,652; and 4,699,224 disclose the use of a flexible joint, such as a knuckle joint, to increase the magnitude of the deflection in order to drill a curved borehole having a shorter radius of curvature. U.S. Pat. Nos. 2,687,282; 3,398,804; and 4,523,652 disclose using a stationary deflecting surface in the vertical borehole to initiate and azimuthally direct the deflection of the drill bit and using the deflecting surface and weight-on-bit to control or maintain the desired azimuthal direction.

U.S. Pat. Nos. 3,156,310 and 4,699,224 use a collar in combination with the knuckle joint to initiate the deflection and to control or maintain the azimuthal direction of the deflection in the borehole In U.S. Pat. No. 3,156,310 blades extend from the collar to deflect the collar and knuckle joint to one side of the borehole and to thereby deflect the drill bit against the opposite wall. The blades also serve to engage the borehole sidewall to prevent rotation of the collar and to maintain the azimuthal direction of the deflection. The collar may be on either side of the knuckle joint. U.S. Pat. No. 4,699,224 discloses angled blades extending from the thick side of an eccentrically bored collar. As in U.S. Pat. No. 3,156,310, the blades both deflect the collar to one side of the borehole and engage the sidewall In U.S. Pat. No. 4,699,224 the collar is on the uphole side of the knuckle joint.

In U.S. Pat. Nos. 2,919,897; 3,156,310; and 4,699,224 the weight of the drill string is carried in the non-rotating collar during drilling which creates a single wear-point. The deflection creates a radial component of the weight-on-bit which is directed towards and supported by the portions of the collar on the outside radius of the deflection and of the borehole.

U.S. Pat. Nos. 2,687,282 and 4,699,224 disclose forcing the drill bit to drill upward by leveraging the drill bit into the borehole sidewall using a reamer or stabilizer as a fulcrum between the drill bit and the knuckle joint U.S. Pat. Nos. 3,398,804 and 4,449,595 use a reamer, and U.S. Pat. No. 3,156,310 uses stabilizer blades, respectively, to leverage the drill bit into the borehole sidewall. This leveraging of the drill bit creates a lateral or radial force on the drill bit and also allows cutting forces to be leveraged from the drill bit into the drill string.

U.S. Pat. Nos. 2,687,282; 3,398,804; 4,449,595; 4,523,652; and 4,699,224 disclose using a reamer to ream the sidewall of the borehole. U.S. Pat. No. 4,523,652 discloses a curve drilling assembly in which the sidewall of a reamer is shaped to match the desired radius of curvature of a borehole in attempting to stabilize the downhole assembly when drilling into intervals of varying hardness U.S. Pat. No. 4,449,595 discloses a curve drilling assembly in which the reamer is designed to be overgauged, tapered, and non-cutting at its leading, downhole end in attempting to stabilize the reamer and prevent preferential upward cutting by the reamer. It is known that use of a reamer will both enlarge or "overgauge" the borehole diameter with respect to the drill bit diameter and will create lateral forces on the curve drilling assembly. Use of the reamer as a fulcrum will increase the overgauging of the borehole by the reamer because of the lateral forces exerted on the reamer.

U.S. Pat. No. 2,919,897 discloses biasing a selected "master" cutter on the drill bit into engagement with the borehole wall in the direction of the desired deflection and out of engagement with the borehole wall when the master cutter is oriented diametrically opposite to the direction of the desired deflection. U.S. Pat. No. 2,919,897 does not disclose or suggest controlling or modifying the gauge cutting of the remaining cutters on the drill bit.

U.S. Pat. No. 4,815,342, which is owned by the assignee of the this application, discloses a method of modeling the cutting surfaces on a drill bit, calculating the forces acting on the cutting surfaces, and calculating the position of balancing cutters which may be placed on the drill bit in order to reduce the imbalance force created by the cutters.

U.S. Pat. Nos. 5,010,789 and 5,042,596, which are owned by the assignee of the this application, disclose a drill bit and method of making a drill bit having a plurality of cutting elements (also referred to as "cutters") and a relatively smooth bearing zone. The cutting elements are positioned to cause the net imbalance force generated by the cutting elements to be directed towards the bearing zone in order to prevent backward whirl of the drill bit during drilling. Backward whirl results in severe impact loading of the cutters on the drill bit and is normally very detrimental to drill bits. Backward whirl is a motion that results in the longitudinal drill bit center moving counterclockwise around the borehole axis during drilling (the normal drilling direction being clockwise). In U.S. Pat. No. 5,042,596 the net radial imbalance force is disclosed as being created along a net radial imbalance force vector and as having sufficient magnitude to substantially maintain a sliding surface disposed in a cutter devoid region on the gauge portion of the drill bit in contact with the borehole wall.

Despite the many prior attempts to create a reliable curve drilling assembly, a need exists for a curve drilling assembly which will drill a curved borehole having a more reliable and predictable radius of curvature. The patents referenced in this application illustrate the long-felt need for a curve drilling assembly which will drill a curved borehole having these properties. There is also a commercial need for a curve drilling assembly which will drill a curved borehole with minimal maintenance and which is relatively inexpensive and easy to use.

SUMMARY OF THE INVENTION

The present invention is contemplated to overcome the above-described problems and meet the above-described needs. For accomplishing this, the present invention provides a novel and improved curve drilling assembly.

The inventors discovered that, in order to drill a curved borehole having a predictable radius of curvature, it is necessary to control the gauge cutting by the drill bit and the forces exerted on the bit during drilling. To achieve this control, the inventors discovered that it is necessary to control the forces created by the drill bit during drilling and to control the lateral forces created by the deflection in the curve drilling assembly.

The inventors discovered that the performance of a curve drilling assembly is improved by using the low friction drill bit disclosed in assignee's prior U.S. Pat. No. 5,042,596; that performance is further improved by repositioning the gauge cutting elements and imbalance forces on the bit to reduce overgauging; that performance is further improved by eliminating other gauge cutting surfaces from the curve drilling assembly; that performance is further improved by reducing the transfer of any lateral forces created by the deflection in the curve drilling assembly to the drill bit; and that performance and durability are further improved by providing a rotating contact on the rotating drill string near the deflection to transfer the lateral force component of the weight-on-bit created by the deflection to the borehole wall.

By controlling the forces created by the drill bit during drilling and controlling the lateral forces created by the deflection in the curve drilling assembly, the present invention provides a curve drilling assembly of long-sought and previously unknown accuracy, predictability, and durability.

It is an advantage of the present invention to provide a curve drilling assembly which will drill a curved borehole having a reliably predictable radius of curvature.

It is an advantage of the present invention to provide a curve drilling assembly which will drill curved boreholes having long, medium, or short radii of curvature.

It is an advantage of the present invention to provide a curve drilling assembly which requires relatively little maintenance, which is constructed and arranged to facilitate maintenance, and which is relatively inexpensive and easy to use.

Accordingly, the present invention provides a curve drilling assembly which is connectable to a rotary drill string for drilling a curved subterranean borehole having an inside radius and an outside radius. The assembly comprises curve guide means connectable with the drill string for deflecting the drill string toward the outside radius of a curved borehole; a rotary drill bit; imbalance force means, rotatable with the drill string, for creating a net imbalance force along a net imbalance force vector substantially perpendicular to the longitudinal axis of the drill bit during drilling; and bearing means, rotatable with the drill string and located in the curve drilling assembly near the cutting elements of the drill bit for intersecting a force plane formed by the longitudinal bit axis and the net imbalance force vector and for substantially continuously contacting the borehole wall during drilling.

The imbalance force means can be created and controlled in several ways and preferably is created and controlled by selecting the arrangement of the cutting elements on the drill bit. Thus, in a preferred embodiment of the invention, the cutting elements are disposed for creating the net imbalance force along the net imbalance force vector. Preferably, the cutting elements are disposed for creating a radial imbalance force along a radial imbalance force vector during drilling and for creating a circumferential imbalance force along a circumferential imbalance force vector during drilling, and the net imbalance force vector is a resultant of the radial imbalance force vector and the circumferential imbalance force vector.

In the preferred embodiment, the bearing means is disposed within a substantially continuous cutting element devoid region disposed on the gauge portion of the drill bit. Preferably, the bearing means is a substantially smooth wear-resistant sliding surface for slidably contacting the borehole wall during drilling More preferably, the sliding surface has a size sufficient to encompass the net imbalance force vector as the net imbalance force vector moves in response to a change in hardness of the borehole wall during drilling. In another aspect of the invention, the cutting elements are disposed for causing the net imbalance force to remain directed toward the bearing means during drilling and during drilling disturbances. In another aspect of the invention, the sliding surface is located on the gauge portion of the drill bit substantially opposite to a gauge cutting element and the sliding surface is constructed and arranged to move the gauge cutting element into deeper cutting engagement with the borehole wall when the gauge cutting element is about axially coincident with the inside radius of the curved borehole.

The curve guide means includes a mandrel rotatably disposed in a housing. Preferably, the housing comprises borehole engaging means for preventing rotation of the housing with the mandrel during drilling and mandrel engaging means for rotating the housing with the mandrel when the mandrel is rotated in an opposite direction to the drilling direction. Preferably, contact means are provided at the uphole end or the downhole end of the mandrel for contacting the borehole wall and supporting the radial force component of the weight-on-bit created by the deflection. The invention also provides a flexible joint which may be connected at the end of the mandrel adjacent the contact means for drilling curved boreholes having a short radius of curvature.

BRIEF DESCRIPTION OF THE DRAWINGS

The present invention will be better understood by reference to the examples of the following drawings.

DETAILED DESCRIPTION OF THE PREFERRED EMBODIMENTS

Figure 1:
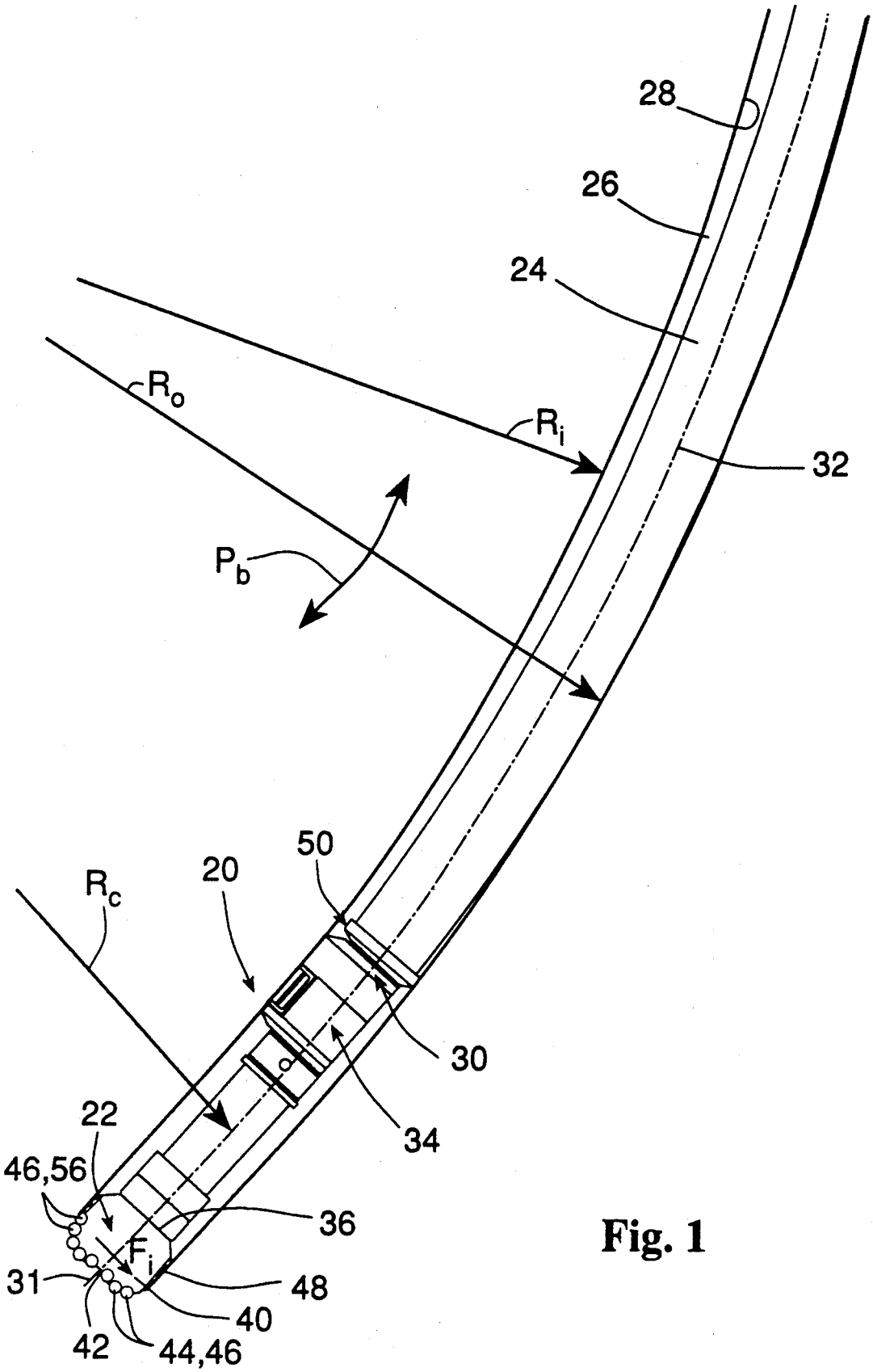
FIG. 1 is a schematic representation of an embodiment of a curve drilling assembly of the present invention which may be used for drilling curved boreholes having a long radius of curvature.

The preferred embodiments of the invention will now be described with reference to the drawings, wherein like reference characters refer to like or corresponding parts throughout the drawings.

1.0 INTRODUCTION

FIGS. 1-22A present preferred embodiments of a curve drilling assembly 20 according to the present invention. As exemplified in FIG. 1, in the preferred embodiment, the assembly 20 is connected between a rotary drill bit 22 and drill string 24 used in drilling a curved borehole 26 of an oil or gas well. In accordance with the invention, the curve drilling assembly 20 is operable with a rotational drive source, not shown in the drawings, for drilling in subterranean earthen materials to create a borehole 26 having a borehole wall 28. The rotational drive source may comprise a commercially available drilling rig with a drill string for connection to commercially available subterranean drill bits. The apparatus 20 may be used to drill a curved borehole in virtually any type of environment, e.g., water wells, steam wells, subterranean mining, etc. The assembly 20 also may be used for initiating a curved borehole 26 from a substantially straight borehole.

Figure 2:
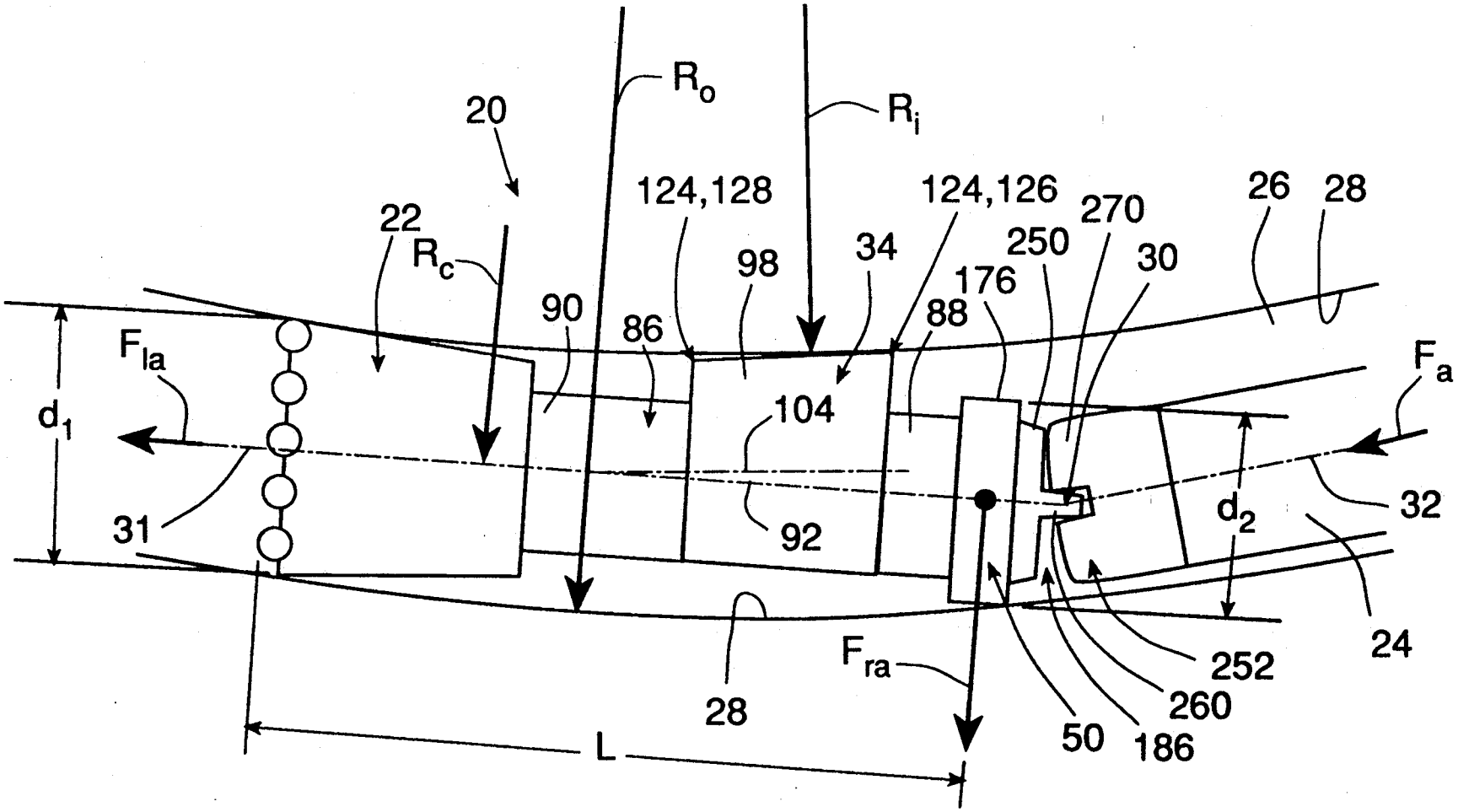
FIG. 2 is a schematic representation of another embodiment of the curve drilling assembly of the present invention.

Referring to FIG. 2, in order to drill a curved borehole 26, it is necessary to initiate and maintain a deflection 30 of the drill bit axis 31 with respect to the longitudinal axis 32 of the drill string 24 (as well as with respect to the longitudinal axis of the borehole 26) and to control the azimuthal direction of the deflection in the borehole 26. During drilling, axial forces $F_a$, commonly referred to as weight-on-bit, are exerted on the drill string 24 and drill bit 22 in order to force the drill bit 22 into the subterranean formation. The deflection 30 creates a radial or lateral force component $F_{ra}$ of the axial force in the curve drilling assembly 20. Rotation of the drill bit during drilling also creates radial, or lateral, forces on the drill bit 22 and drill string 24.

The inventors discovered that, in order to drill a curved borehole having a predictable radius of curvature it is necessary to control the integrity of the curve-creating structure of the curve drilling assembly by making the assembly drill a substantially gauge borehole (i.e., a borehole of predictable diameter with respect to the diameter of the drill bit); and that this is accomplished by controlling the forces acting on the bit-end and on the deflection-end of the assembly.

Through extensive study of the structural configuration and dynamics of a curve drilling assembly in a curved borehole, the inventors discovered that only a small amount of overgauging of the borehole is required to impair the ability of the assembly to reliably drill a curved borehole "overgauged" or "overgauging", as used hereinafter, refers to a borehole having a diameter which is larger than the drill bit drilling the borehole by an uncontrolled and unpredicted amount. For example, the inventors, research established that 5/16 inch of overgauging by a drill bit having 37/8 $\frac{7}{8}$ inch outside diameter used with a curve drilling assembly designed to drill a radius of curvature of 20 feet is sufficient to prevent the drilling of a curved borehole or to cause an inconsistent radius of curvature; and that as little as $\frac{1}{8}$ inch of overgauging by the $3\frac{7}{8}$ drill bit in a curve drilling assembly designed to drill a radius of curvature of 25 feet can cause the radius of curvature drilled to be 60 feet. It should be noted that, depending upon the size and shape of the drill bit and the radius of curvature of the curved borehole, the angle or skew of the longitudinal axis of the drill bit with respect to the longitudinal axis of the previously drilled borehole may produce a slightly oversized borehole (for example, one-sixteenth inch oversized when drilled with a 3-15/16 inch drill bit drilling a curved borehole with a 30 foot radius of curvature). However, as long as this oversizing is predictable and controllable the curve drilling assembly can be designed or adjusted to drill a borehole having a constant, predictable radius of curvature.

Referring to the example of FIG. 1, in accordance with the invention, the curve drilling assembly 20 includes curve guide means 34 connectable with the drill string 24 for deflecting the drill string 24 toward the outside radius $R_o$ of a curved borehole 26; drill bit 22 having a base portion 36 disposed about a longitudinal bit axis 31 for connection through the curve guide means 34 with the drill string 24, a gauge portion 40 disposed about the longitudinal bit axis 31 and extending from the base portion 36, a face portion 42 disposed about the longitudinal bit axis 31 and extending from the gauge portion 40, and a plurality of cutting elements 44 disposed on the face portion 42; imbalance force means 46 for creating a net imbalance force along a net imbalance force vector $F_i$ substantially perpendicular to the longitudinal bit axis 31 during drilling; and bearing means 48 located in the curve drilling assembly 20 near the cutting elements 44 for intersecting a force plane $P_f$ (best seen in FIG. 3) formed by the longitudinal bit axis 31 and the net imbalance force vector $F_i$ and for substantially continuously contacting the borehole wall 28 during drilling. The invention also includes contact means 50 for contacting the borehole wall 28 and supporting the radial force component $F_{ra}$ on the borehole wall 28 during drilling In Section 2.0, the drill bit 22, imbalance force means 46, and bearing means 48 are described as controlling the forces created near the drill bit 22. In Section 3.0, the curve guide means 34 and contact means 50 are described as controlling the forces created near the deflection 30. In Section 4.0 a flexible joint is described which enhances the ability of the assembly 20 to drill curved boreholes having a short radius of curvature. In Section 5.0 test data is presented which compares the performance of the curve drilling assembly of the present invention with the performance of prior curve drilling assemblies. As will be apparent to one skilled in the art in view of the disclosure contained herein, the features of the invention may be used, independently or in various combinations, with virtually any curve drilling assembly. Preferably all of the features of the invention are used in combination to maximize the benefits of the invention.

2.0 DRILL BIT CONTROL

In this Section, the drill bit 22, imbalance force means 46, and bearing means 48 are described as controlling the forces created near the drill bit 22. The drill bit 22 is discussed in subsection 2.1. The bearing means 48 is discussed in subsection 2.2. The imbalance force means 46 is discussed in subsection 2.3.

2.1 Drill Bit

Figure 3:
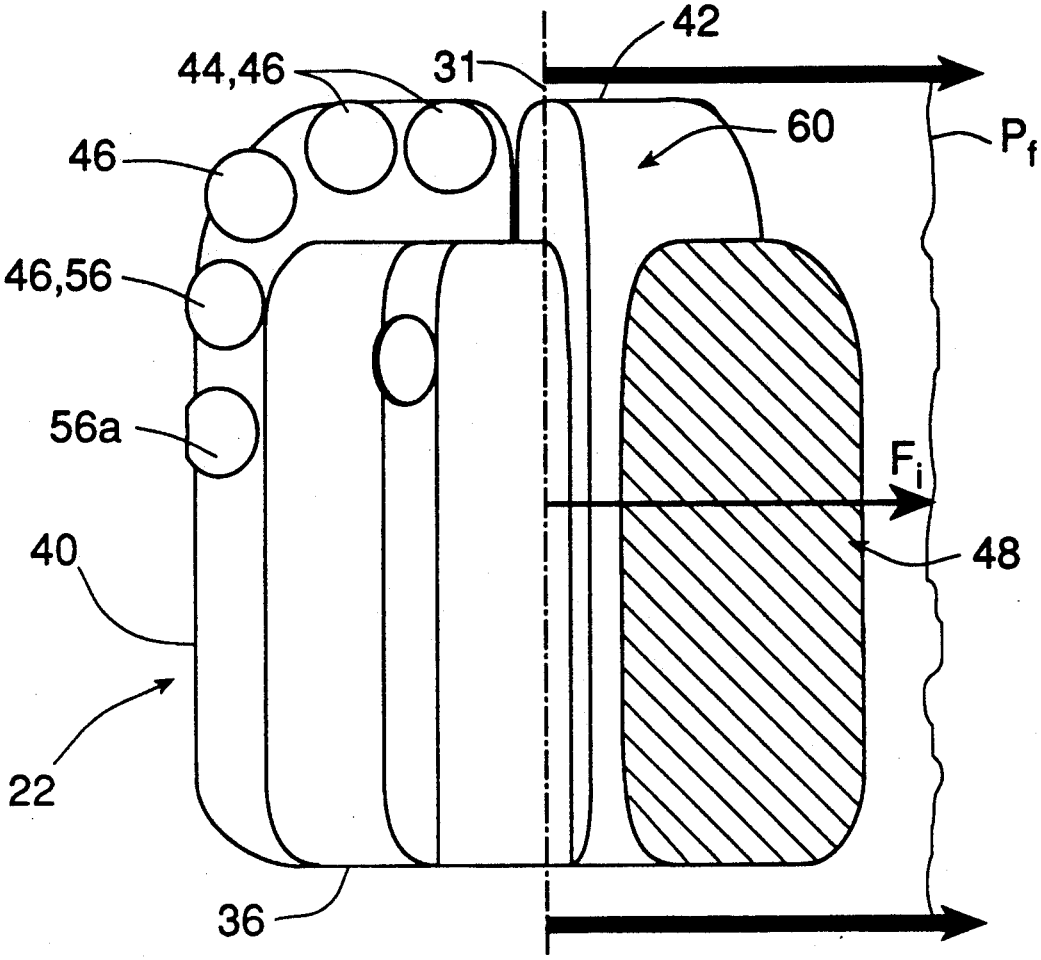
FIG. 3 is a side view of a subterranean drill bit in accordance with the present invention.
Figure 4:
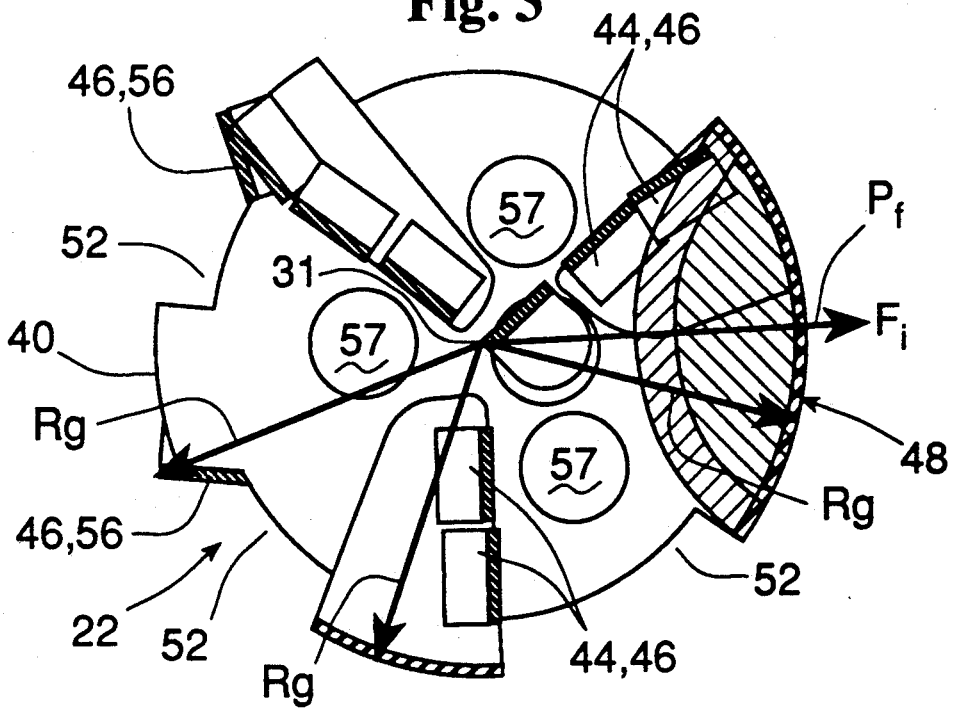
FIG. 4 is a top view of FIG. 3 showing the face portion of the drill bit.

A preferred embodiment of a fixed cutter subterranean drill bit 22 is shown in FIGS. 3 and 4. FIG. 3 shows a side view, and FIG. 4 shows a longitudinal view, corresponding to a view of an operational drill bit taken from the bottom of the borehole. Drill bit 22 includes a base portion 36 disposed about longitudinal bit axis 31 for receiving the rotational drive source. Base portion 36 includes a connection (not illustrated) that can be connected in a known manner to the drill string 24. Longitudinal bit axis 31, a theoretical concept used for reference purposes and to facilitate description, extends through the center of base portion 36. "Radial" as the term is used in this document, refers to positions located or measured perpendicularly outward from longitudinal bit axis 31, for example, as shown in FIG. 3. "Lateral", as the term is used in this document, refers to positions or directions located or measured transversely outwardly from bit axis 31, although not necessarily perpendicularly outwardly from the bit axis 31. "Axial" or "longitudinal" refers to positions or directions located or measured along or coextensively with the bit axis 31.

The drill bit gauge portion 40 includes a cylindrical portion substantially parallel to bit axis 31. Because of the substantially cylindrical shape of gauge portion 40, the gauge portion 40 has a gauge radius $R_g$ measured radially outward and perpendicularly from longitudinal bit axis 31 to the surface of the gauge portion, as shown in FIG. 4. Gauge portion 40 preferably includes a plurality of grooves or channels 52 extending parallel to bit axis 31 to facilitate the removal of rock cuttings, drilling mud, and debris.

Gauge portion 40 and face portion 42 can be considered to meet at a line 54 (FIG. 5) at which the radius of the drill bit 22 begins to transition from having the gauge radius $R_g$. Line 54 therefore represents the circumference of the gauge portion.

The drill bit 22 shown in FIG. 1 has a curved profile, i.e., the cross-section of face portion 42, when viewed from a side view perpendicular to the bit axis, has a concave profile. The face portion 42, when viewed from the side-view perspective, may, for example, have a spherical, parabolic, or other curved shape. Such profiles, however, are not limiting. For example, the face portion may be flat or may have an axially extending cavity as shown in FIGS. 3–6.

In accordance with the invention, the subterranean drill bit 22 further includes a plurality of cutting elements 44 fixedly disposed on and projecting from the face portion and spaced from one another. Preferably, the invention further includes at least one gauge cutting element 56, spaced from the face portion cutting elements 44, fixedly disposed on and projecting from the gauge portion.

Each of the cutting elements 44, 56 preferably comprises a poly-crystalline diamond compact material mounted on a support, such as a carbide support The cutting elements may, of course, include other materials such as natural diamond and thermally stable polycrystalline diamond material Each of the cutting elements 44, 56 has a base disposed in face portion 42 or gauge portion 40, respectively. Each of the cutting elements has a cutting edge for contacting the subterranean earthen materials to be cut.

As shown in FIG. 4, cutting elements 44 are positioned in linear patterns along the radial dimension on face portion 42. This is by way of illustration, however, and not by way of limitation. For example, cutting elements 44 may be positioned in a nonlinear pattern along a radial dimension of the face portion 42 to form one or more curved patterns (not illustrated) or they may be positioned in a nonuniform, random pattern on the face portion (not illustrated).

Figure 5:
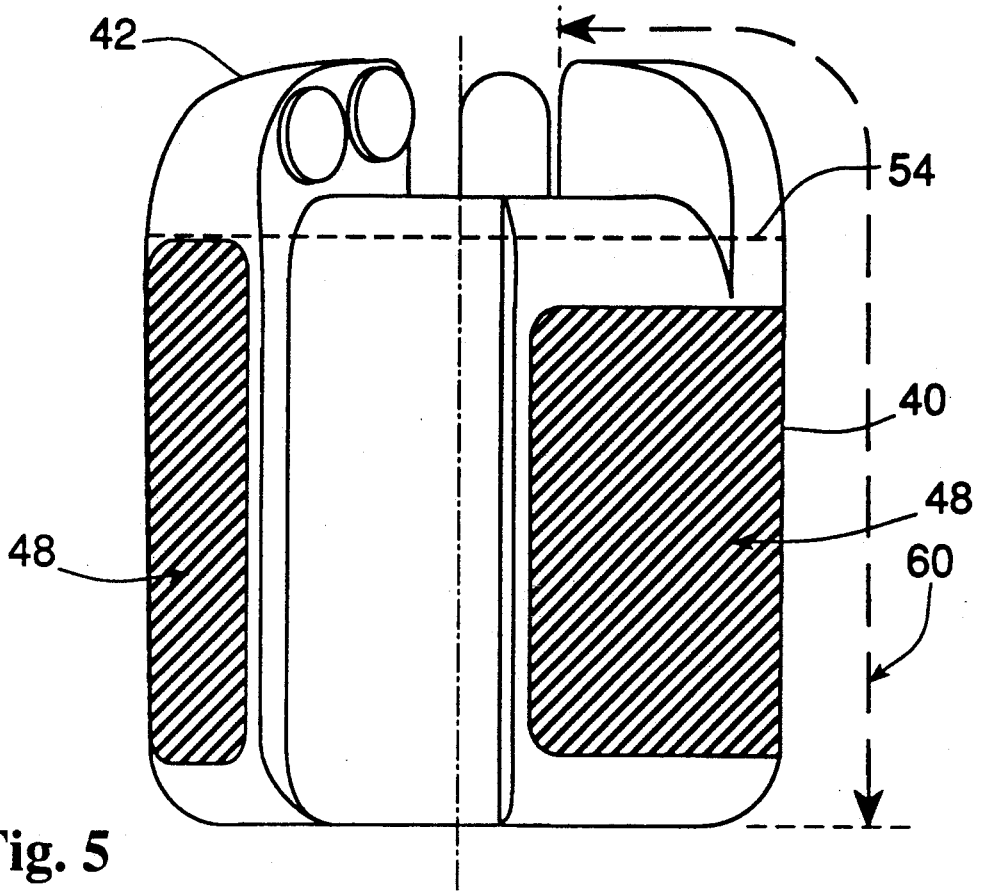
FIG. 5 is another side view of the drill bit shown in FIG. 3.
Figure 6:
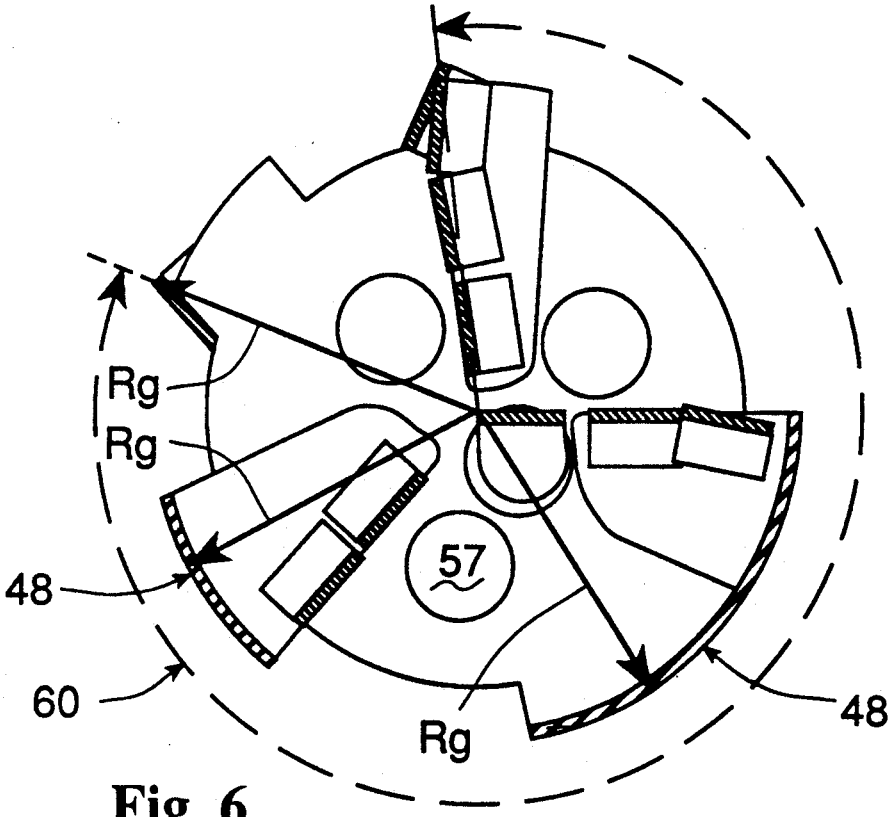
FIG. 6 is a top view of FIG. 5.

As embodied in the drill bit of FIGS. 3–6, the gauge cutting elements 56 are similar or identical to cutting elements 44. Cutting elements 56 are disposed on gauge portion 40 with their cutting edges positioned at a uniform radial distance from bit axis 31 to define gauge radius $R_g$, as shown in FIGS. 4 and 6. Gauge cutting elements 56 are spaced from cutting elements 44 and from one another As shown in FIG. 3, gauge cutting elements 56 may be aligned with corresponding ones of cutting elements 44, and two or more gauge cutting elements 56 preferably extend linearly along the gauge portion 42 in the axial direction of the bit 22. The gauge cutting elements 56 define the gauge or diametrical dimension of the borehole wall 28, and serve to finish the borehole wall. The gauge cutting elements 56 prolong bit lifetime, given that gauge cutting elements 56 closer to face portion 42 will wear faster than gauge cutting elements 56 farther from the face portion so the gauge cutting elements 56 wear in sequential rather than simultaneous fashion. The cutting edge of the gauge cutting elements **56*a* farthest from the face portion 42 may be constructed and arranged to provide a cutting edge which extends axially along gauge radius $R_g$, as does the substantially flat cutting edge of cutting element 56*a*. Such gauge cutting elements are commonly known as "gauge trimmers" and are used because their axially extended cutting edge wears longer than does the apex of a rounded cutting edge. A gauge cutting element 56** with a rounded cutting edge becomes "undergauge" as soon as the apex of the edge wears down.

The number of individual cutting elements 44, 56 on the drill bit 22 can vary considerably within the scope of the invention, depending on the specific design and application of the drill bit. The prototype drill bit 22 is 3-15/16 inches in diameter and includes at least 15 individual cutting elements, but this is not limiting. For example, a drill bit having an outside diameter of 8.5 inches could have between 25–40 individual cutting elements, approximately 17 to 28 on the face portion and approximately 8 to 12 on the gauge portion. A 17.5 inch diameter bit might have over 100 separate cutting elements It is known that commercially available drill bits used in subterranean drilling range from bore sizes of 2 inches to 25 inches, although the most widely used sizes used in drilling curved boreholes fall within the range of $3\frac{7}{8}$ to $17\frac{1}{2}$ inches.

Drill bit 22 includes an internal fluid flow channel (not illustrated) in fluid communication with the drill string bore 58, and a plurality of nozzles 57 disposed on face portion 42 and in fluid communication with the drill bit flow channel. The flow channel and nozzles 57 provide a lubricating fluid such as drilling mud to face portion 42 of the drill bit 22 during the drilling to lubricate the drill bit and remove rock cuttings, as is well known to those skilled in the art.

2.2 Bearing means

Referring to FIGS. 3–6, the invention includes bearing means 48 located in the curve drilling assembly near the cutting elements 44 for intersecting a force plane $P_f$ (FIG. 4) formed by the net imbalance force vector $F_i$ and the longitudinal bit axis 31. The bearing means 48 may be located on the drill string 24 adjacent the drill bit 22, for example, on a drill collar or stabilizer adjacent the bit, as would be understood by one skilled in the art in view of disclosure contained herein. Preferably, the bearing means 48 is within a substantially continuous cutting element devoid region 60 and is disposed on the gauge portion 40 of the drill bit 22. Preferably, the cutting element devoid region 60 extends onto the face portion 42 of the bit 22.

Cutting element devoid region 60 comprises a substantially continuous region of gauge portion 40 and face portion 42 that is devoid of cutting elements 44, 56 and abrasive surfaces Cutting element devoid region 60 intersects and is disposed about force plane $P_f$, which is formed by the longitudinal bit axis 31 and net imbalance force vector $F_i$. Force plane $P_f$ is a theoretical concept used for reference and illustrative purposes to explain the effect of the net imbalance force vector $F_i$ on the drill bit 22 and curve drilling assembly 20. For example and with reference to the drawings, force plane $P_f$ lies in the plane of the drawing sheet of FIG. 3 and extends outwardly from longitudinal bit axis 31 through the bearing means 48. When the drill bit 22 is viewed longitudinally as shown in FIG. 4, plane $P_f$ emerges perpendicularly from the drawing sheet with its projection corresponding to net imbalance force vector $F_i$. Force plane $P_f$ is important in understanding the effect of the net imbalance force vector $F_i$ because net imbalance force vector $F_i$ may not always intersect gauge portion 40. In some instances, for example, force vector $F_i$ may extend outward radially from bit axis 31 at or near face portion 42 directly toward the borehole wall without passing through gauge portion 40. Even in these instances, however, the net imbalance force identified by force vector $F_i$ will be directed and lie in a radial plane $P_f$ of the drill bit 22 which passes through the gauge portion 40.

Referring to FIGS. 5 and 6, the preferred cutting element devoid region 60 extends the full longitudinal or axial length of gauge portion 40, and preferably further extends onto face portion 42 along the circumferential and axial dimensions. Cutting element devoid region 60 may extend circumferentially along, or around, substantially all of the circumference of the gauge portion 40 ("gauge circumference"), such as, for example, in a drill bit having only one cutting element on the gauge portion For most applications, the cutting element devoid region will extend around about 20% to 70% of the gauge circumference. Cutting element devoid region 60 preferably extends axially from the line 54 between the gauge portion 40 and the face portion 42 at least one-third of the distance to the intersection of the bit axis 31 with face portion 42. Selected ones of cutting elements 44, 56 may be positioned adjacent to cutting element devoid region 60 to increase the number of cutters on the drill bit and thereby improve its cutting efficiency.

The bearing means 48 is disposed in the cutting element devoid region 60 about the force plane $P_f$ for substantially continuously contacting the borehole wall 28 during the drilling. The bearing means may comprise one or more rollers, ball bearings, or other low friction load bearing surfaces Preferably, the bearing means 48 comprises a substantially smooth, wear-resistant sliding surface 48 disposed in the cutting element devoid region 60 about the force plane $P_f$ for slidably contacting the borehole wall 28 during the drilling. The preferred sliding surface 48 intersects the force plane $P_f$ formed by the longitudinal bit axis 31 and the net imbalance force vector $F_i$.

Sliding surface 48 constitutes a substantially continuous region that has a size equal to or smaller than cutting element devoid region 60. Sliding surface 48 is disposed on gauge portion 40. Sliding surface 48 may comprise the same material as other portions of drill bit 22, or a relatively harder material such as a carbide material In addition, sliding surface 48 may include a wear-resistant coating or diamond impregnation, a plurality of diamond stud inserts, a plurality of thin diamond pads, or similar inserts or impregnation that strengthen sliding surface 48 and improve its durability.

Sliding surface 48 directly contacts the borehole wall 28. Drilling mud is pumped through the drill bit and circulates up the borehole past the gauge portion of the drill bit thereby providing some lubrication for sliding surface 28. Significant contact of the sliding surface with the borehole wall does occur. Accordingly, low friction, wear-resistant coatings for the sliding surface 48, as discussed above, are often desirable.

The specific size and configuration of sliding surface 48 will depend on the specific drill bit design and application. Preferably, the sliding surface 48 extends along substantially the entire longitudinal length of gauge portion 40 and extends circumferentially around no more than approximately 50% of the gauge circumference. The sliding surface may extend around about 20% to 50% of the gauge circumference. Preferably, the sliding surface, or bearing means, 48 extends around a minimum of about 30% of the gauge circumference.

The preferred sliding surface 48 is of sufficient surface area so that, as the sliding surface is forced against the borehole wall 28, the applied force will be significantly less than the compressive strength of the subterranean earthen materials of the borehole wall. This keeps the sliding surface 48 from digging into and crushing the borehole wall, which would result in the creation of an undesired bit whirling motion and overgauging of the borehole 26. Sliding surface 48 also has a size sufficient to encompass net imbalance force vector $F_i$ as force vector $F_i$ moves in response to a change in hardness of the subterranean earthen materials and to other disturbing forces. Preferably, the size of the sliding surface 48 is also selected so that the net imbalance force vector $F_i$ remains encompassed by the sliding surface as the bit wears.

Sliding surface 48 is preferably positioned at a radial distance from the bit axis 31 that is substantially equal to the gauge radius $R_g$, i.e., the sliding surface 48 and gauge cutter(s) 56 define the gauge radius $R_g$ of the drill bit 22 as well as the diameter of the gauge portion 40 of the drill bit 22. Sliding surface 48 may comprise a continuous surface of hardened, wear-resistant material on the gauge portion 40 of the drill bit 22. Preferably, the sliding surface comprises a plurality of spaced sliding surfaces 48, as shown in FIGS. 3–6. This facilitates hydraulic flow around the drill bit 22 which improves drilling efficiency and promotes cooling of the bit. This design is preferred for certain drilling applications.

2.3 Imbalance Force Means

Referring to the example of FIGS. 3 and 4, the curve drilling assembly 20 includes imbalance force means 46 for creating a net imbalance force along a net imbalance force vector $F_i$ substantially perpendicular to the longitudinal bit axis 31 during drilling. This subsection firstly gives an overview of the preferred components and properties of the imbalance force means 46, secondly discusses the various forces acting on a drill bit during drilling and how they are created, and thirdly discusses how the forces are controlled to produce the imbalance force means 46 and curve drilling assembly 20 of the present invention.

The imbalance force means 46 may include a mass imbalance in the drill bit 22 or drill string 24, an eccentric sleeve or collar placed around the drill bit 22 or drill string 24, or similar mechanism capable of creating the imbalance force vector $F_i$ (not illustrated). Preferably, the imbalance force means includes a radial imbalance force and the cutting elements 44, 56 are disposed for creating the radial imbalance force along a radial imbalance force vector $F_n$ (FIG. 8) during drilling. Further in accordance with the invention, the imbalance force means 46 includes a circumferential imbalance force and the cutting elements 44, 56 are disposed for creating the circumferential imbalance force along a circumferential imbalance force vector $F_{ci}$ (FIG. 8) during drilling. Further in accordance with the invention, the net imbalance force vector $F_i$ is a combination or resultant of the radial imbalance force vector $F_n$ and the circumferential imbalance force vector $F_{ci}$.

The magnitude and direction of net imbalance force vector $F_i$ will depend on the positioning and orientation of the cutting elements 44, 56, e.g., the specific arrangement of cutting elements 44, 56 on drill bit 22, and the shape of the drill bit 22 since the shape influences positioning of the cutting elements 44, 56. Orientation includes backrake and siderake of the cutting elements 44, 56. The magnitude and direction of force vector $F_i$ is also influenced by a number of factors, such as the specific design (shape, size, etc.) of the individual cutting elements 44, 56, the weight-on-bit load applied to the drill bit 22, the speed of rotation, and the physical properties of the subterranean material being drilled.

Further in accordance with the invention, the cutting elements 44, 56 are disposed to cause net imbalance force vector $F_i$ to substantially maintain the bearing means 48 in contact with the borehole wall during the drilling, to cause net radial imbalance force vector $F_i$ to have an equilibrium direction, and to cause net radial imbalance force vector $F_i$ to return substantially to the equilibrium direction in response to a disturbing displacement. These aspects of the invention and the related forces on the drill bit will also be discussed in greater detail below.

Figure 7:
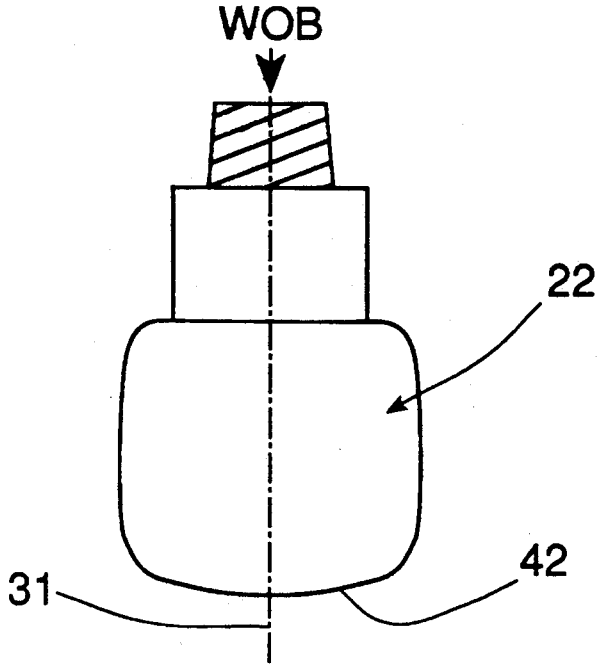
FIG. 7 is a schematic side view of a subterranean drill bit.

The principal forces acting on a subterranean drill bit as it drills through subterranean earthen materials include a drilling torque, the weight-on-bit, a radial imbalance force, a circumferential imbalance force, and a radial restoring force. With reference to FIG. 7, the weight-on-bit (WOB) is a longitudinal or axial force applied by the rotational drive source (drill string) that is directed toward the face portion 42 of the bit 22. Subterranean drill bits are often subject to weight-on-bit loads of 10,000 lbs. or more.

Figure 8:
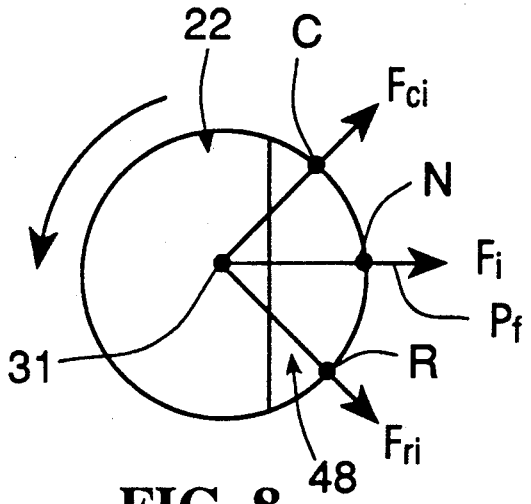
FIG. 8 is a schematic face or longitudinal view of a subterranean drill bit which is used to illustrate the forces acting on the drill bit during drilling.

The radial imbalance force is the radial component of the force created on the drill bit 22 when the bit is loaded in the axial direction. The radial imbalance force can be represented as a radial imbalance force vector $F_n$, exemplified in FIG. 8, which is perpendicular to the longitudinal bit axis 31 and intersects with a longitudinal projection of the gauge circumference at a point R, as shown in FIG. 8. The radial imbalance force vector $F_n$ and longitudinal bit axis 31 also define a radial force plane which extends radially from bit axis 31 through point R. The magnitude and direction of force vector $F_n$ is independent of the speed of rotation of the bit, and instead is a function of the shape of the drill bit; the location, orientation, and shape of the cutting elements; the physical properties of the subsurface formation being drilled; and the weight-on-bit. The location, orientation, and shape of the cutters, however, usually are the factors most amenable to control. If the drill bit and its cutting elements are perfectly symmetrical about the longitudinal bit axis and if the weight on the bit is applied directly along the bit axis, then the radial imbalance force $F_n$ will be zero. However, in the preferred embodiment, the drill bit and cutting elements are shaped and positioned so that a non-zero force $F_n$ is applied to the drill bit when the bit is axially loaded The force $F_n$ can be substantial, up to thousands of pounds.

The circumferential imbalance force is the net radial component obtained by vectorially summing the forces attributable to the interaction of the drill bit, primarily the individual cutting elements, with the borehole bottom and walls as the bit rotates. This circumferential imbalance force can be represented as a circumferential imbalance force vector $F_{ci}$ (as exemplified in FIGS. 8 and 9) which is perpendicular to the longitudinal bit axis 31 and intersects with a longitudinal projection of the gauge circumference at point C. The circumferential imbalance force vector $F_{ci}$ and longitudinal bit axis 31 also define a radial force plane which extends radially from bit axis 31 through point C. As explained below, the magnitude of the circumferential imbalance force vector $F_{ci}$ can vary, depending upon both the design of the drill bit (shape of the bit and shape and positioning of cutting elements), the operation of the drill bit, and the earthen materials being drilled.

Figure 9:
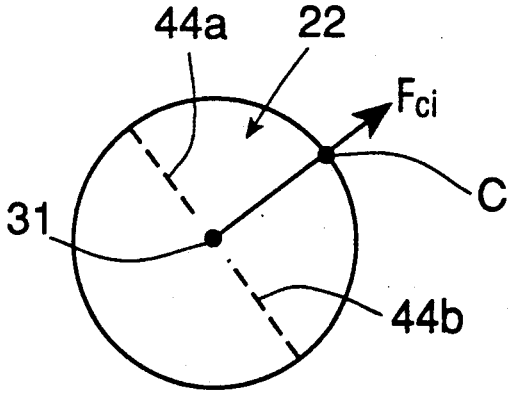
FIG. 9 is a schematic face or longitudinal view of a subterranean drill bit which is used to illustrate the circumferential imbalance force acting on the drill bit during drilling.

For example, FIG. 9 shows a longitudinal view of a drill bit 22 having cutting elements **44*a*, 44*b* which are symmetrically disposed on the face portion 42 of the drill bit 22 with respect to one another. If such a bit rotates about the bit axis 31, and if cutting elements 44*a*, 44*b* cut a homogeneous material so they experience symmetric forces, the respective cutting elements will create a force couple of torque with zero net force directed away from the bit axis 31**. If, however, cutting elements 44a, 44b are not perfectly symmetric, or if they cut heterogeneous material so they experience different or asymmetric forces, the respective cutting elements 44a, 44b will create both a torque about a center of rotation displaced from the bit axis 31 and a non-zero net circumferential imbalance force $F_{ci}$ directed in a radial plane towards the point C on the projection of the bit. Subterranean drill bits usually create a non-zero circumferential imbalance force $F_{ci}$. As will be explained in greater detail below, the present invention includes a drill bit that is intentionally designed to create a substantial circumferential imbalance force $F_{ci}$.

Referring to FIG. 8, the circumferential imbalance force vector $F_{ci}$ and the radial imbalance force vector $F_{ri}$ combine to create the net imbalance force vector $F_i$, which is substantially perpendicular to the longitudinal bit axis and which intersects with a longitudinal projection of the gauge circumference at a point N. The imbalance force vector $F_i$ and longitudinal bit axis 31 define force plane $P_f$ which extends radially from bit axis 31 through point N. This force point N indicates the point or region on a projection of the gauge circumference corresponding to the portion of the drill bit 22 that contacts the borehole wall in response to the net imbalance force vector $F_i$ at a given time. Given the geometries of the drill bit and the borehole wall, the gauge portion of the drill bit will contact the borehole wall. The bearing means is disposed on the drill bit at a location that generally corresponds to this contacting portion of the drill bit to provide the radial restoring force required to balance force vector $F_i$.

Figure 10:
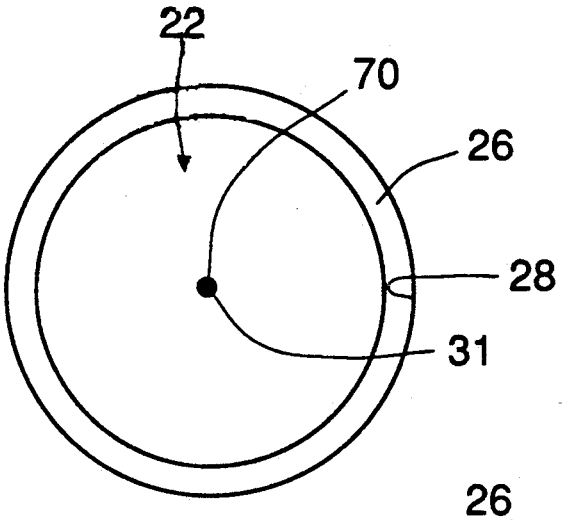
FIG. 10 is a schematic face or longitudinal view of a subterranean drill bit rotating in a borehole which is used to illustrate static stability of the drill bit.

An appreciation of the invention is further facilitated by an understanding of the concepts of static and dynamic stability as they apply to the drill bit of the present invention. Statically stable bit rotation, as the term is used in this document, can be defined as a condition in which the center of rotation of the drill bit stays at a fixed point on the drill bit surface in the absence of a disturbing force or a formation heterogeneity. For example, FIG. 10 shows a drill bit 22 with a longitudinal bit axis 31. Drill bit 22 rotates in a borehole 26 having a cylindrical borehole wall 28. The center, or longitudinal axis, of borehole 26 is designated by reference numeral 70. Because drill bit 22 rotates about a fixed center of rotation on the bit surface, i.e., longitudinal bit axis 31, the rotation is statically stable. A condition in which drill bit 22 is rotated about a fixed point on the drill bit surface, but in which this center of rotation on the drill bit is not co-located with bit axis 31, would also be considered statically stable rotation. Statically stable bit rotation is usually accompanied by a net imbalance force vector $F_i$ that has a substantially constant magnitude and direction relative to the drill bit. The direction of this constant force vector $F_i$ can be considered an equilibrium direction.

Dynamic stability, as the term is used in relation to low friction subterranean drill bits of the invention, refers to a condition in which the net imbalance force vector $F_i$ returns to an equilibrium direction in response to a disturbing displacement. The disturbing displacement may be caused by a number of factors, such as the encountering of a change in subterranean earthen material hardness, the off axis movement of the drill bit itself, and drill string vibrations.

A subterranean drill bit may have static stability, i.e., net imbalance force vector $F_i$ may be directed to an equilibrium direction, but fail to have dynamic stability, i.e., a disturbing displacement will move force vector $F_i$ away from the equilibrium direction and force vector $F_i$ will not return to the equilibrium direction upon relaxation, as explained in greater detail below.

Through an extensive research effort, the assignee of this application has discovered that cutter damage and corresponding drill bit failure apparently are caused by impact damage attributable to a subterranean drilling phenomenon termed backward whirl. Backward whirl is defined as a statically and dynamically unstable condition in which the center of rotation of the drill bit moves on the bit surface as the bit rotates A more complete description of the backward whirl theory is provided in J. F. Brett, T. M. Warren, and S. M. Behr, "Bit Whirl: A New Theory of PDC Bit Failure," Society of Petroleum Engineers, (SPE) 19571, presented at the 64th Annual Technical Conference of the SPE, San Antonio, Tex., Oct. 8-11, 1989. The phenomenon of backward whirl can be explained with reference to FIG. 11.

Figure 11:
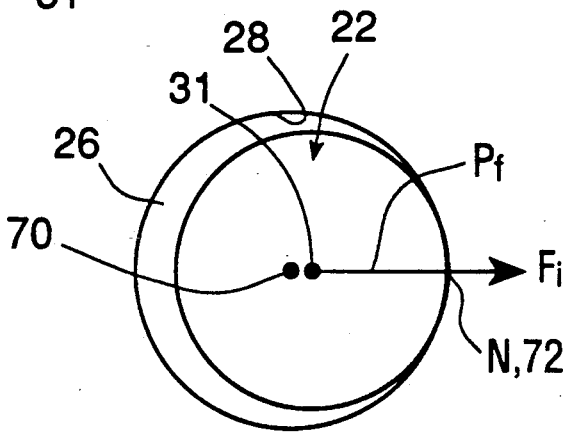
FIG. 11 is a schematic face or longitudinal view of a drill bit rotating in a borehole which is used to illustrate backward whirl of a drill bit.

FIG. 11 illustrates a condition in which drill bit 22 has been moved by net imbalance force $F_i$ radially in the borehole to a position in which the drill bit contacts borehole wall 28 at a contact point 72 adjacent to force point N. If the net imbalance force vector $F_i$ becomes large enough to force the surface of the bit against the borehole wall, and if frictional or cutting forces prevent the drill bit surface contacting the borehole wall 28 from sliding on the borehole wall 28, contact point 72 becomes the instantaneous center of rotation for the drill bit. For example, the instantaneous center of rotation of the drill bit may move from the longitudinal bit axis 31 toward contact point 72. The frictional force between the drill bit surface and the borehole wall 28, which is caused or accentuated in conventional subterranean drill bits by the gauge cutting elements around the gauge portion of the bit, causes the instantaneous center of rotation of the bit to continue to move around the face portion of the bit, away from the longitudinal bit axis 31 and toward the borehole wall, as the bit rotates.

When a drill bit begins to backward whirl, the cutting elements can move backwards, sideways, etc. They move farther per revolution than those on a bit in stable rotation, and they move faster. As a result, the cutters are subjected to high impact loads when the drill bit impacts the borehole wall, which occurs several times per bit revolution for a whirling bit. These impact forces chip and break the cutters. Once backward whirl begins, it regenerates itself. The inventors discovered that backward whirl in an overgauged borehole allows the curve drilling assembly to deviate from the structural configuration required to drill a curved borehole having a reliable, predictable radius of curvature, i.e., the backward whirl and the overgauged borehole allow the drill bit and curved drilling assembly to become sufficiently misaligned in the borehole to prevent the reliable drilling of a curved borehole.

The present invention is designed to overcome the problems caused by overgauging and by backward whirl of a subterranean drill bit in a curve drilling assembly The subterranean drill bit 22 of the present invention overcomes the undesirable effects of backward whirl by providing a cutting element arrangement and corresponding drill bit profile that, during the drilling, direct the net imbalance force vector $F_i$ towards the bearing means 48 and substantially maintain the force vector $F_i$ on the bearing means in a stable fashion. The bearing means provides a low friction contact with the borehole wall. The cutting element devoid region 60 also minimizes frictional forces, such as those attributable to gauge cutting elements, from causing the drill bit to grip or dig into the borehole wall and move the instantaneous center of rotation of the drill bit.

In accordance with the invention, the cutting elements 44, 56 are disposed to cause the net imbalance force vector $F_i$ to have a magnitude and direction which will substantially maintain the bearing means in contact with the borehole wall during the drilling, and which will avoid creating frictional or cutting forces that will cause the drill bit to grip or dig into the borehole wall and move the instantaneous center of rotation of the drill bit on the bit. Ideally, this condition would hold throughout the operation of the drill bit. Further in accordance with the invention the cutting elements are disposed to cause the net imbalance force vector $F_i$ to have an equilibrium direction. The features of the invention in which the cutting elements are disposed to cause the net imbalance force vector to have a magnitude and direction to substantially maintain the bearing means in contact with the borehole wall during the drilling, and to cause the net radial imbalance force vector to have an equilibrium direction, are related to the static stability of the drill bit.

Figure 12:
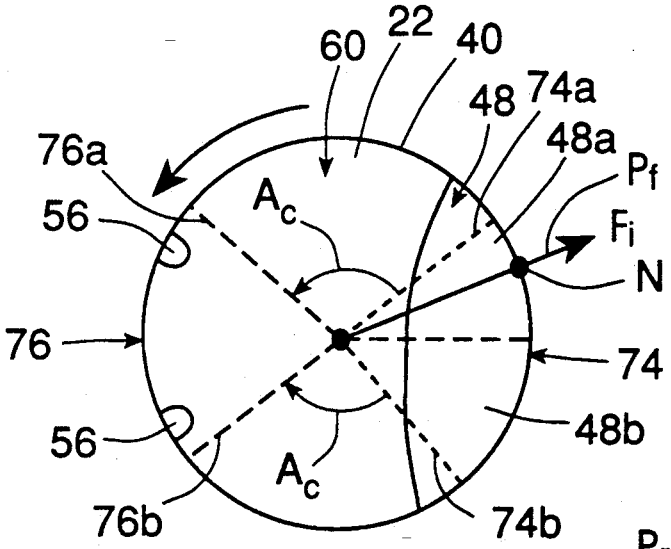
FIG. 12 is a schematic face or longitudinal view of an embodiment of a subterranean drill bit in accordance with the present invention.
Figure 13:
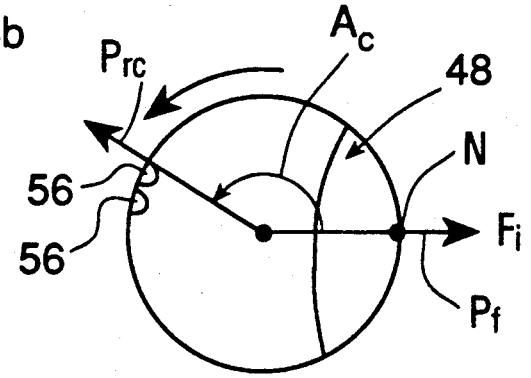
FIG. 13 is a schematic face or longitudinal view of an embodiment of a subterranean drill bit in accordance with the present invention.

The drill bit of the present invention is preferably designed so that force point N, for assumed steady state conditions, is located at a point in the leading portion or half of the bearing means 48. This relationship is illustrated by FIG. 12, which shows a leading half 48*a* and a trailing half 48*b* of sliding surface 48, with the bit rotating counter-clockwise as indicated by the arrow. With this arrangement, if the drill bit 22 encounters harder earthen materials or "hangs up" for a moment on the borehole wall, the variable force vector $F_{ci}$ will not move net imbalance force vector $F_i$ rearward beyond the trailing half 48*b* of sliding surface 48. Because force vector $F_{ci}$ is more variable than $F_{ci}$, in the preferred embodiments, force vector $F_n$ for steady state conditions is greater than force vector $F_{ci}$. This relationship enhances the static and dynamic stability of the drill bit.

The magnitude of the net imbalance force vector $F_i$ preferably is in the range of about 3% to 40% of the applied weight-on-bit load. For example, if the weight-on-bit load is 10,000 pounds, then $F_i$ should be within the range of 300 to 4,000 pounds. If the drill bit is designed for relatively low weight-on-bit, the force vector $F_i$ should be relatively large and vice versa. If the drill bit is designed for relatively high RPM, a somewhat greater force vector $F_i$ is needed. If a relatively large drill bit is used, the force vector $F_i$ should be decreased. Of course, the greater the magnitude of force vector $F_i$, in general, the greater will be the wear on the bearing means 48.

The drill bit of the invention can be further refined by specifically positioning the cutting elements (including selecting the drill bit shape and design) not only to control the direction and magnitude of net imbalance force vector $F_i$, but also of the individual force components making up the force vector $F_i$, i.e., circumferential imbalance force vector $F_{ci}$ and radial imbalance force vector $F_n$. More specifically, drill bit performance has shown improvement by positioning the cutting elements 44, 56 so that at least one of force vectors $F_{ci}$ and $F_n$ is directed towards the bearing means 48 at all times during the operation of the bit. Additional stability can be achieved by designing the drill bit shape and positioning the cutting elements so that force vectors $F_{ci}$ and $F_n$ are approximately aligned with each other and with the resultant net imbalance force vector $F_i$.

Further in accordance with the invention, the cutting elements are disposed to cause net imbalance force vector $F_i$ to substantially return to the equilibrium position in response to a disturbing displacement, preferably for disturbing displacements or offsets of up to 75 thousandths of an inch. This feature of the invention is related to the dynamic stability of the drill bit.

The magnitude and direction of net imbalance force vector $F_i$ for an operational subterranean drill bit will change as the bit operates. This movement may be caused by the factors above, such as heterogeneity of the subterranean earthen materials to be drilled. The lack of dynamic stability can cause force vector $F_i$ to move away from the bearing means in response to a disturbance, and either converge to a new equilibrium position away from the bearing means or become dynamically unstable, in which case force vector $F_i$ can continue to move as further drilling occurs.

The drill bit of the invention provides dynamic stability by making sliding surface 48 of sufficient size to encompass the net imbalance force vector $F_i$, or force plane $P_f$, as the net imbalance force vector $F_i$ moves in response to changes in hardness of the subterranean earthen materials; and by positioning the cutting elements to minimize the variations in the direction of force vector $F_i$. If the sliding surface, or bearing means, 48 is not sufficiently large to create this condition, backward whirling and overgauging can occur. Through experimentation, the inventors have found that the sliding surface preferably should extend over at least 20%, and up to 50%, of the gauge circumference. As a general rule of thumb the circumferential length, or extent, of the sliding surface around the gauge circumference should correspond to the expected range of movement of force vector $F_i$, plus up to about 20% on either side of this range of movement.

The inventors have discovered that overgauging of the borehole is further reduced and performance of the curve drilling assembly 20 is further improved by placing the gauge cutting elements 56 on the gauge portion of the drill bit 22 so that a radial plane $P_{rc}$ of the drill bit extending through the gauge cutting elements defines an angle $A_c$ of at least 90 degrees and not more than 270 degrees with the force plane $P_f$. Referring to the example of FIG. 13, the angle $A_c$ should be measured from the gauge cutting element 56 closest to the force plane $P_f$. Placing the gauge cutting elements more than 90 degrees and less than 270 degrees from the force plane $P_f$ removes components of the net imbalance force vector $F_i$ from the gauge cutting elements 56 which force the gauge cutting elements into the borehole wall 28 and thus reduces overgauging. Preferably, the angle $A_c$ is about 180 degrees and the gauge cutting element(s) 56 is disposed on the gauge portion 40 of the drill bit 22 substantially opposite to the intersection of the force plane $P_f$ with the bearing means, or sliding surface, 48 in order to maximize the component of the force vector $F_i$ acting on the gauge cutting elements 56 which biases the gauge cutting elements 56 away from the borehole wall 28.

Referring to the example of FIG. 12, the imbalance force vector $F_i$, and therefore the force plane $P_f$, move circumferentially with respect to the gauge portion 40 of the drill bit 22 in response to a disturbance of the curve drilling assembly during drilling. In further accordance with a preferred embodiment of the invention, exemplified in FIG. 12, the cutting elements 44, 56 are disposed for causing the force plane $P_f$ to remain within a force plane arc 74 on the circumference of the gauge portion 40 The force plane arc 74 may be visualized as having radial boundaries 74a, 74b at each circumferential end of the arc 74. Preferably, the gauge cutting elements 56 are located within a gauge cutting arc 76 on the gauge portion. The gauge cutting arc 76 may be visualized as having radial boundaries 76a, 76b at each circumferential end of the arc 76. The angle $A_c$ between adjacent boundaries 74a, 76a; 74b, 76b of the arcs 74, 76 is preferably greater than 90 degrees and less than 270 degrees in order to remove components of the net imbalance force vector $F_i$ from the gauge cutting elements 56, and from the gauge cutting arc 76, which would force the gauge cutting elements into the borehole wall 28. More preferably, the gauge cutting arc 76 is located on the gauge portion substantially diametrically opposite to the force plane arc 74. Further, the cutting elements 44, 56 are preferably selected and arranged so that the force plane arc 74 is encompassed within the bearing means, or sliding surface, 48 in order to maximize the static and dynamic stability of the drill bit 22 in accordance with the preceding teachings of this document.

Figure 15:
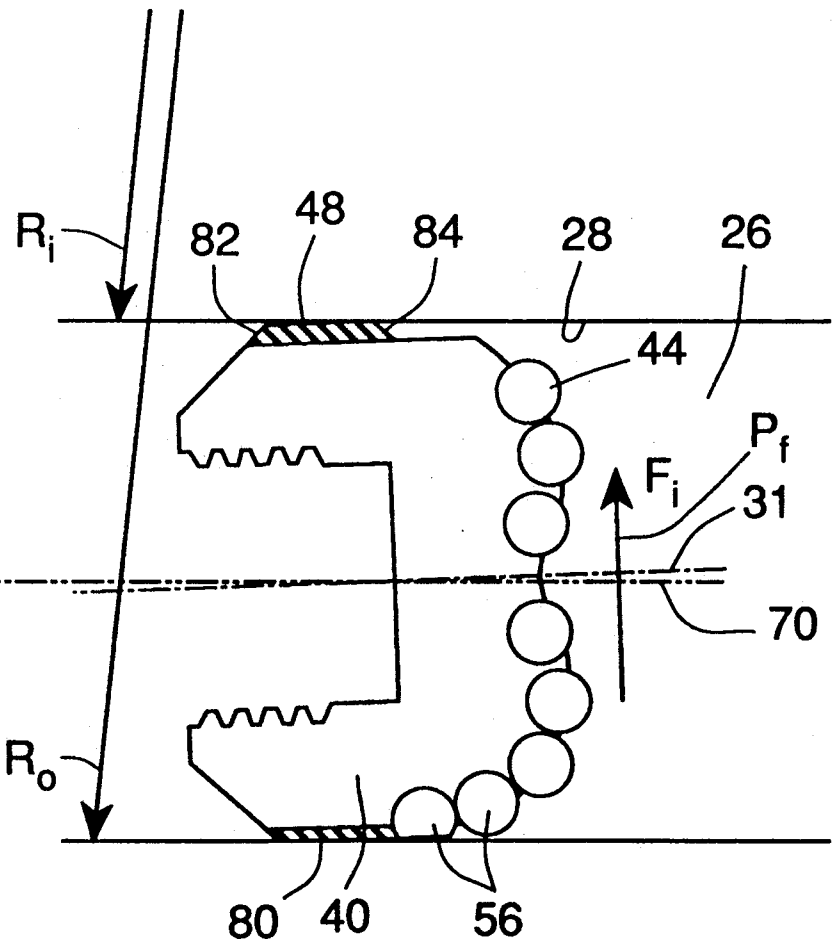
FIG. 15 is a schematic side sectional view similar to FIG. 14 which illustrates the action of the drill bit when the gauge cutting elements are adjacent the outside radius of a curved borehole.
Figure 14:
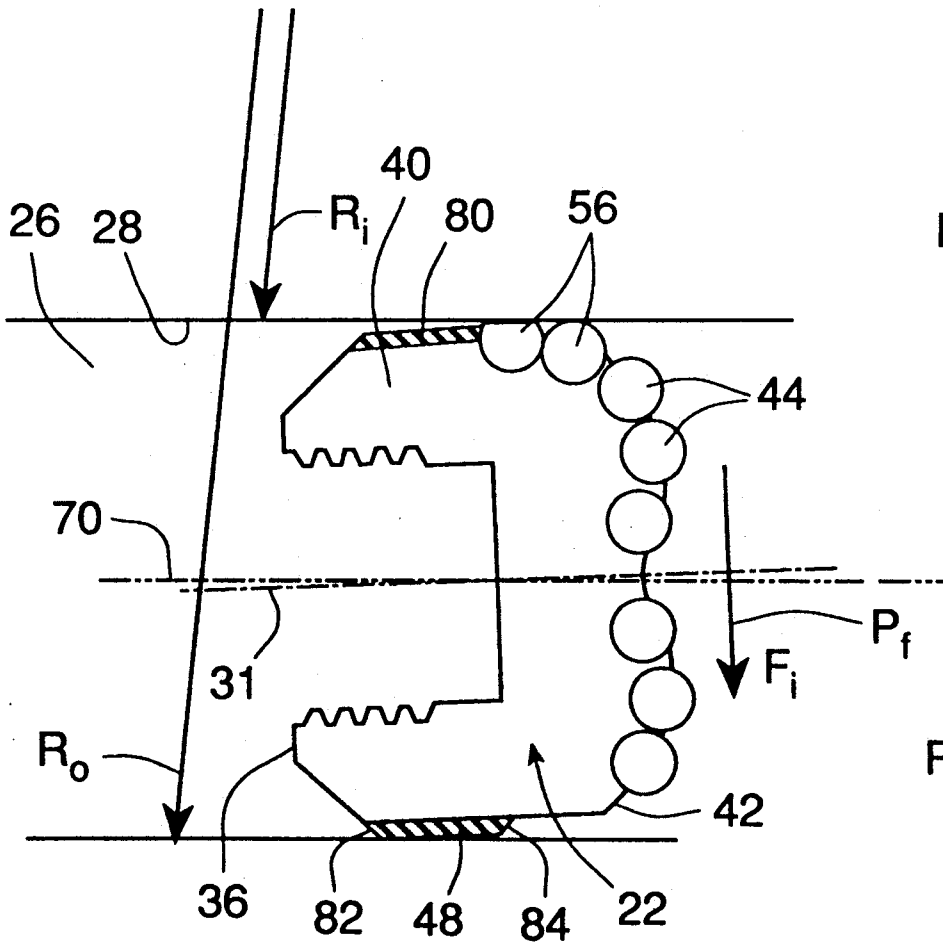
FIG. 14 is a schematic sectional side view of an embodiment of a drill bit of the present invention which illustrates the action of the drill bit when the gauge cutting elements are adjacent the inside radius of a curved borehole.

Further in accordance with the invention, referring to FIGS. 14 and 15, the sliding surface, or bearing means 48, may be disposed for forcing the gauge cutting element(s) 56 into cutting engagement with the borehole wall 28 when the gauge cutting element 56 is about axially coincident with the inside radius $R_i$ of the curved borehole 26, as exemplified in FIG. 14, in order to enhance the ability of the assembly 20 to create the curved borehole Preferably, the sliding surface 48 is located on the gauge portion 40 of the drill bit 22 about opposite the gauge cutting element 56, i.e., on the diametrically opposite side of the gauge portion 40, as illustrated in FIGS. 14 and 15. The sliding surface 48 is constructed, arranged, and shaped to utilize the skew or angle of the bit axis 31 with respect to the borehole axis 70 and to laterally displace or move the drill bit 22 and gauge cutting element 56 into deeper cutting engagement with the borehole wall when the gauge cutting element is about axially coincident with the inside radius $R_i$ of the curved borehole 26 than will the skew of the bit axis alone. By moving the cutting elements 56 into deeper, penetrating engagement with the inside radius $R_i$ of the borehole 26, the drill bit 22 slightly overcuts the inside radius which causes the drill bit and assembly 20 to move toward the inside radius and thereby enhances the creation of the curved borehole 26.

As exemplified in FIGS. 14 and 15, the invention further provides a cutting element devoid cutter pad 80 which may be located on the gauge portion 40 of the drill bit 22 between the gauge cutting element(s) 56 and the base portion 36 of the bit. Preferably, the cutter pad 80 extends radially from the drill bit a lesser distance than the gauge cutting element 56 so that the gauge cutting element 56 cuts the borehole wall 28 and the cutter pad 80 does not. The cutter pad 80 is constructed, arranged, and shaped to cooperate with the sliding surface 48 in using the skew of the bit axis 31 to move or bias the gauge cutting elements into laterally penetrating engagement with the inside radius $R_i$ of the borehole 26 and to remove the laterally penetrating bias when the gauge cutting elements 56 are not adjacent the inside radius. The cutter pad 80 may be an integral feature of the gauge portion 40 of the drill bit 22, that is, the gauge portion 40 of the drill bit 22 may be shaped or formed and the radial extension of the gauge cutting elements 56 from the gauge portion 40 adjusted to provide the functions of the cutter pad described herein. In the embodiment of FIGS. 14 and 15, the cutter pad 80 is a hardened pad which is added to the gauge portion 40.

The preferred sliding surface 48 has an uphole end 82 adjacent the base portion 36 of the drill bit and a downhole end 84 adjacent the face portion 42 of the drill bit. Preferably the gauge cutting element 56 is located nearer to the face portion 42 than is the downhole end 84 of the sliding surface 48 so that gauge cutting element 56 cuts the borehole wall and the sliding surface 48 does not. The downhole end of the sliding surface should be farther from the face portion 42 than the downhole edge of every gauge cutting element 56. It is preferred that the sliding surface 48 and cutter pad 80 be constructed and arranged to avoid creating any edges or surfaces which can cut or dig into the borehole wall 28 and thereby overgauge the borehole 26 and precipitate backward whirl of the drill bit 22. The sliding surface 48 and the cutter pad 80 are preferably about the same shape in the circumferential dimension as the bit gauge portion 40 upon which they are respectively located. The sliding surface 48 and the cutter pad 80 may be shaped in the axial or longitudinal dimension to match or align with the radius of curvature of the curved borehole 26.

The imbalance force vector $F_i$, or force plane $P_f$, is preferably directed through the sliding surface, or bearing means, 48 within force plane arc 74 (FIG. 12) approximately opposite to the gauge cutting element(s) 56, as illustrated in FIGS. 14 and 15 Therefore, referring to FIG. 14, when the gauge cutting element 56 passes across the top or inside radius $R_i$ of the borehole, the net imbalance force vector $F_i$ is directed to force sliding surface 48 against the outside radius $R_o$ of the borehole 26; and the preferred sliding surface 48 is constructed and arranged to support the drill bit 22 and to cooperate with the skewed axis 31 of the drill bit 22 in moving, or laterally displacing, the gauge cutting element 56 into engagement with the inside radius $R_i$ of the borehole 26. At the same instant, there are no gauge cutting elements 56 in force plane $P_f$ on the sliding surface 48 to cut the outside radius $R_o$ of the borehole.

As the drill bit 22 is rotated so that the gauge cutting element(s) 56 (or cutting arc 76) is not adjacent the inside radius $R_i$ of the borehole 26 (and not on the inside radius of the angle of the bit axis 31 with the borehole axis 70), the preferred sliding surface 28 cooperates with the angle of the bit axis 31 to remove the displacement which biases the gauge cutting element 56 into penetrating engagement with the inside radius $R_i$. This function and property is most pronounced when the gauge cutting element 56 is adjacent the outside radius $R_o$ of the borehole. Referring to FIG. 15, when the drill bit 22 is rotated so that the gauge cutting element 56 is adjacent the outside radius $R_o$ of the borehole 26, the force plane $P_f$ of net imbalance force $F_i$ will be directed through the sliding surface 48 which will be adjacent to the inside radius $R_i$ of the borehole 26. Since the net imbalance force $F_i$ is preferably much greater in magnitude than the weight of the curve drilling assembly 20, the net imbalance force $F_i$ biases the drill bit 22 away from the outside radius of the borehole 26 and thereby minimizes cutting on the outside radius $R_o$ of the borehole 26. In the preferred embodiment of FIGS. 14 and 15, when the gauge cutting element(s) 56 is not adjacent the inside radius $R_i$, there should be no lateral forces acting on the gauge cutting element 56 to force it towards the borehole wall 28 and therefore the gauge cutting element 56 should cut the gauge radius $R_g$ and cut a substantially gauge borehole as it is rotated around the portions of the borehole other than the inside radius $R_i$.

In the curve drilling assembly of the present invention, the imbalance force means 46, bearing means or sliding surface 48, and gauge cutting element(s) 56 cooperate to remove components of the imbalance force vector $F_i$ from the gauge cutting elements 56 which would radially or laterally force the gauge cutting elements 56 into the borehole wall 28; to laterally displace the gauge cutting elements into penetrating engagement with the borehole wall 28 when the gauge cutting elements 56 are adjacent the inside radius R of the borehole; and to remove the lateral displacement when the gauge cutting elements 56 are not adjacent the inside radius $R_i$. Rather than using a reamer as a fulcrum to leverage the drill bit against the inside radius of the curved borehole 26, the present invention guides or points the drill bit 22 in the desired direction; uses the relative positioning of the cutting elements 44, 56 and the net imbalance force $F_i$ to control gauge cutting, reduce overgauging, and to enhance the ability of the assembly 20 to drill a curved borehole; and uses the net imbalance force $F_i$ and sliding surface 48 to noncuttingly transfer the lateral forces in the drill bit to the borehole wall, effectively using the borehole wall 28 as a bearing surface for the gauge portion 42 of the drill bit 22.

If a drill bit in accordance with the present invention is operated at high rotational speed, e.g., of 500 rpm or more, the net imbalance force vector $F_i$ will have a significant dynamic component associated with centrifugal forces In such an embodiment, the magnitude of force vector $F_i$ can be increased by constructing the drill bit so that a portion of the cutting element devoid region has a first density and portions of the drill bit other than the cutting element devoid region have a second density different from the first density A similar result may be achieved by constructing the drill bit so that the bearing means has a first density, and portions of the drill bit other than the bearing means have a second density different from the second density Preferably, such a drill bit can be designed to have a greater mass on its side adjacent the bearing means, so that centrifugal forces push the bearing means against the borehole wall. The asymmetric mass distribution in a rotating body creates a force that can contribute to the net imbalance force.

3.0 DEFLECTION CONTROL

In this Section, the curve guide means 34 and contact means 50 are described as controlling the deflection and the forces created near the deflection 30. The curve guide means 34 is discussed in subsection 3.1 and the contact means 50 is discussed in subsection 3.2.

3.1 Curve Guide Means, Borehole Engaging Means, and Housing Features

In order to drill a curved borehole 26, it is necessary to initiate and maintain a deflection 30 of the drill bit axis 31 with respect to the longitudinal axis 70 of the borehole 26 and to control the azimuthal direction of the deflection in the borehole 26. Referring to the example of FIGS. 1 and 16, the invention includes curve guide means 34 for initiating and maintaining deflection 30 by deflecting the drill string 24 toward the borehole wall 28.

Figure 16:
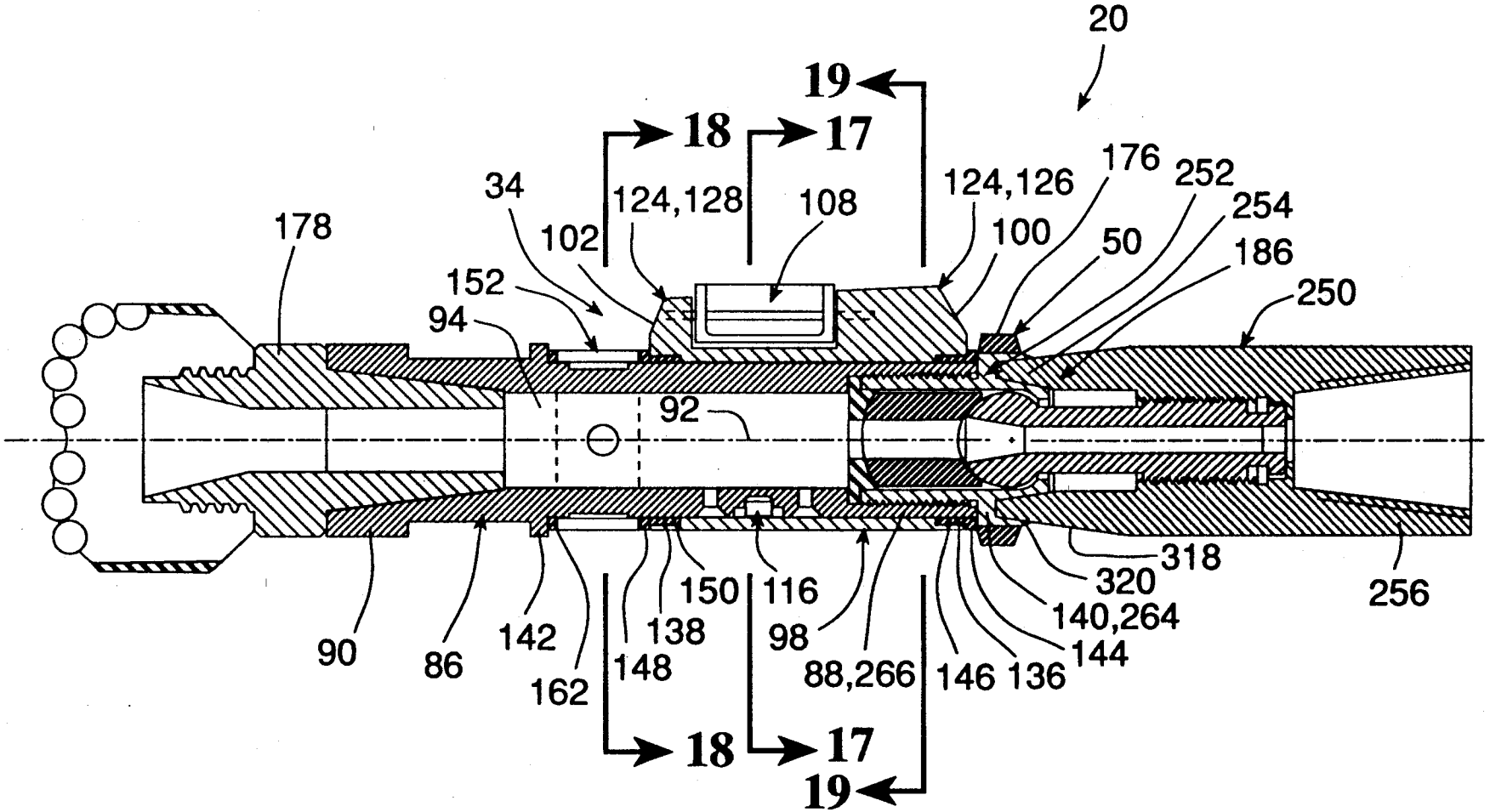
FIG. 16 is a sectional view of an embodiment of the curve drilling assembly of the present invention.
Figure 17A:
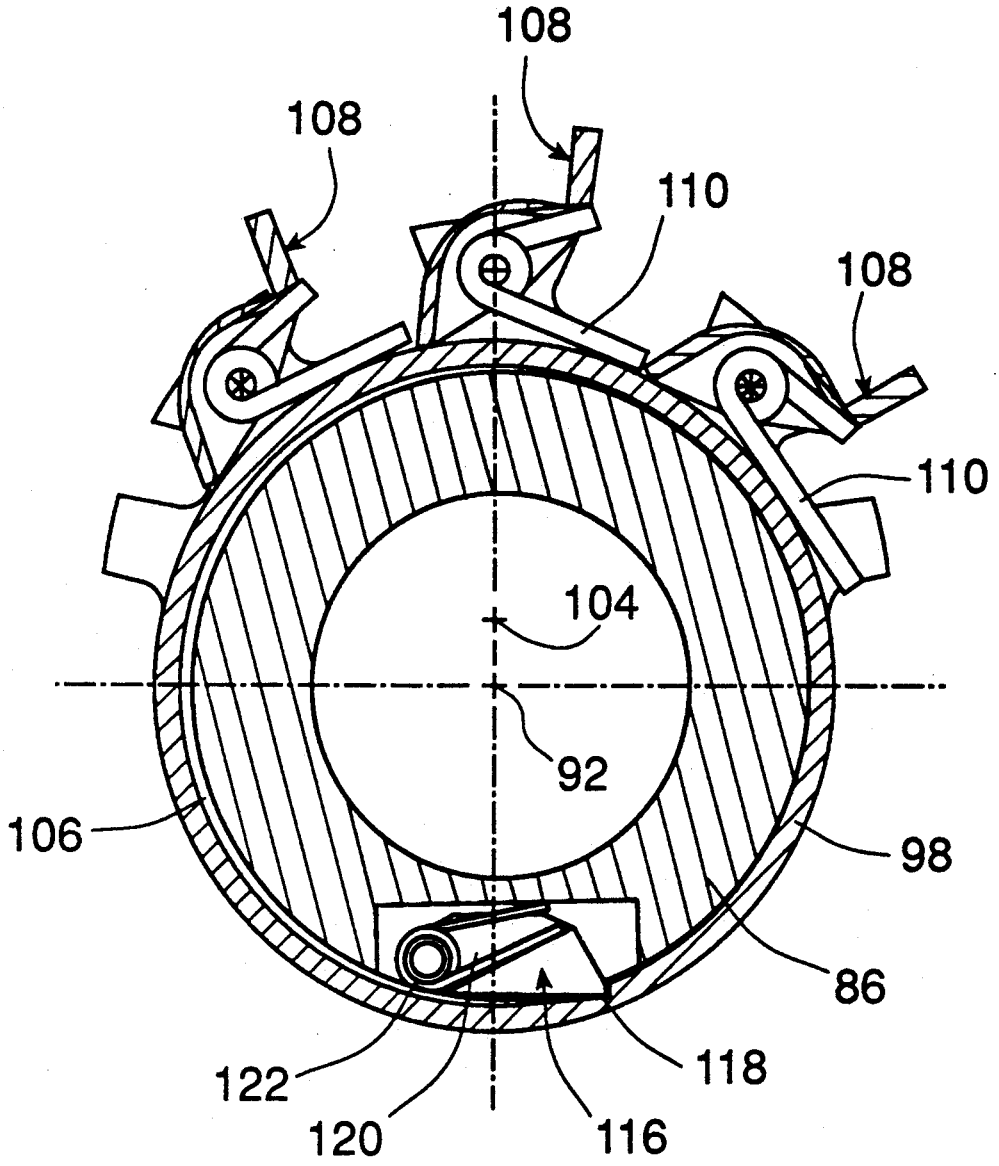
FIG. 17A is a sectional view taken along line 17-17 of FIG. 16.

In accordance with the invention, referring to the example of FIGS. 16 and 17A, the curve guide means 34 includes a mandrel 86 rotatably disposed within a housing 98. The mandrel 86 includes an uphole end 88, a downhole end 90, longitudinal or rotational axis 92, and a fluid passageway 94. The housing 98 includes an uphole end 100, a downhole end 102, longitudinal axis 104, and a passageway 106 extending through the uphole and downhole ends 100, 102. The passageway 106 may extend through the housing at an angle skewed with respect to the housing axis 104 in order to skew the rotational axis of the mandrel 86 with respect to the housing axis 104.

The housing includes borehole engaging means 108 for preventing rotation of the housing 98 with the mandrel 86 during drilling. The borehole engaging means 108 may be any type of spikes, blades, wire-like or brush-like members, or other friction creating devices which will engage with the borehole wall 28 to prevent rotation of the housing 98 when the drill bit 22, drill string 24, and mandrel 86 are rotated during drilling (normally in a clockwise direction viewed from the top of the borehole 26) and which will permit rotation of the housing 98 with the mandrel 86 when the mandrel is rotated in the opposite direction (normally counterclockwise). Referring to the example of FIG. 17A, preferably, the borehole engaging means 108 are a plurality of blades 108 which are spaced apart around the circumference of the housing 98 and which extend axially along the housing 98. Preferably, the blades 108 are biased into engagement with the borehole wall 28 with springs 110.

Figure 17B:
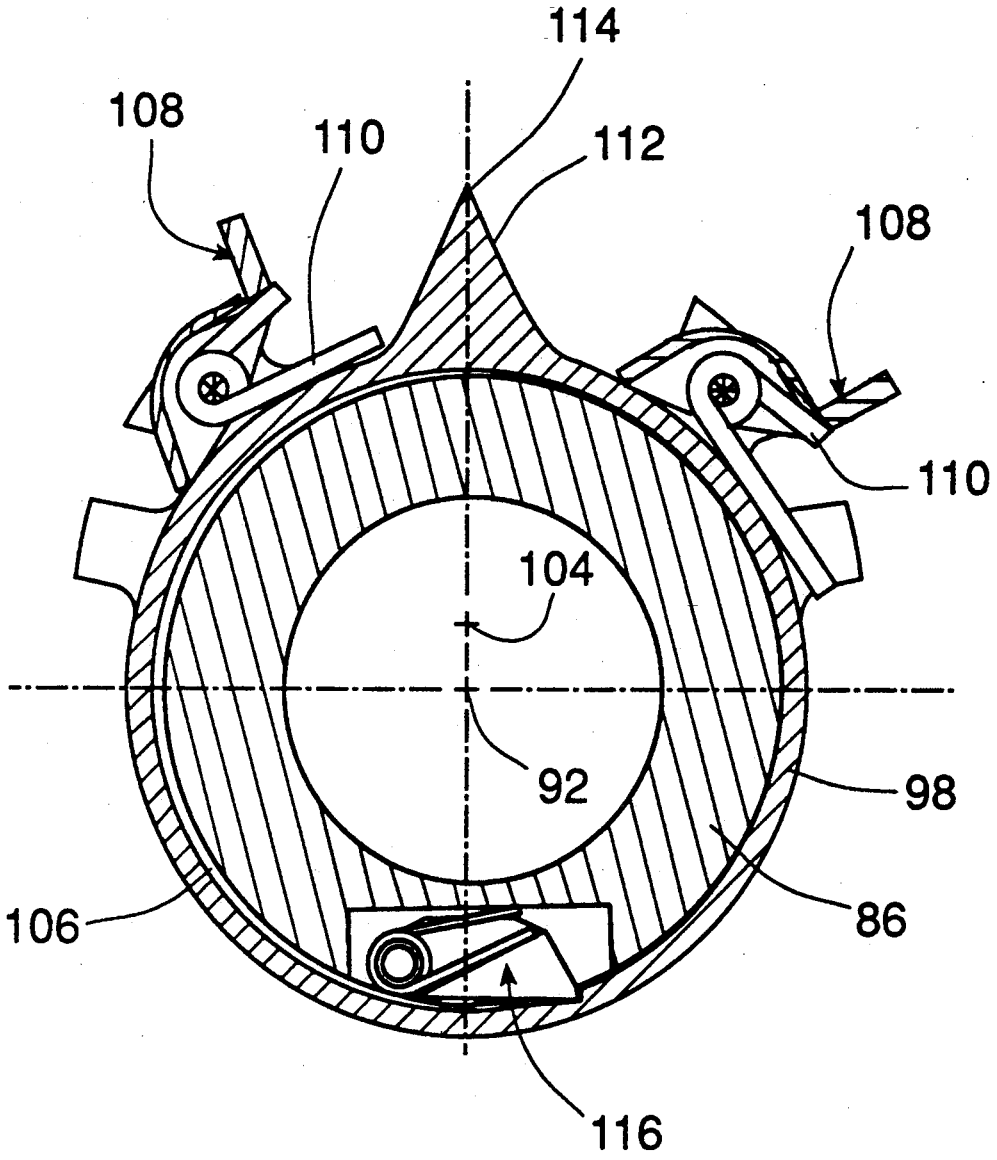
FIG. 17B is a sectional view taken along line 17-17 of FIG. 16 which illustrates another embodiment of the borehole engaging means of the present invention.

FIG. 17B illustrates an alternative embodiment of the borehole engaging means 108, in which one of the spring loaded blades 108 is replaced with a fixed blade 112. The fixed blade 112 has a sharp axially extending edge 114 which, together with the housing 98, defines a diameter slightly larger than the expected diameter of the borehole 26. The axial edge 114 scores the borehole wall 28 and assists in preventing the housing 98 from rotating with the mandrel 86 in order to maintain the rotational orientation of the assembly 20 in the borehole 26. When the fixed blade 114 is used, the housing 98 may be moved into a portion of the borehole having a diameter larger than the diameter defined by the fixed blade 114 when it is desired to rotate the housing 98 with the mandrel 86.

The borehole engaging means 108, including the spring loaded blades 108 and the fixed blade 112, may be placed at virtually any location around the circumference of the housing 98, although they are preferably placed so that they do not bear the weight-on-bit and do not transfer the weight-on-bit to the housing 98, for reasons that are further discussed below. The distance which the borehole engaging means 108, particularly the fixed blade 114, extends radially from the housing 98 and the longitudinal shape of the outermost surface of the borehole engaging means 108 may be selected to assist in guiding the curve drilling assembly, e.g., the portion of the borehole engaging means 108 which contacts the borehole wall 28 may be shaped or curved to conform to the desired curvature of the borehole.

Alternative embodiments of the borehole engaging means 108 include sizing the outside diameter of the housing 98 so that it is slightly less than the expected borehole diameter, and passing the mandrel 86 through the housing 98 at a sufficient angle, or skew, with respect to the housing axis 104 that the eccentricity of the housing 98 with respect to the rotational axis 92 of the mandrel 86 will cause the housing 98 to contact the borehole wall 28 if the housing tries to rotate. Such a contact may be designed to prevent the housing 98 from rotating with the mandrel 86. In such an embodiment the drill bit should be loaded, i.e., weight-on-bit should be placed, before beginning drilling to ensure that the contact means 50 is in contact with the borehole wall 28 and that the rotational axis 92 of the mandrel 86 is skewed with respect to the borehole axis 70.

Referring to the example of FIG. 17A, the invention further includes mandrel engaging means 116 for rotating the housing 98 with the mandrel 86 when the mandrel 86 is rotated in an opposite direction to the drilling direction (normally counterclockwise when viewed from the top of the borehole). The mandrel engaging means 116 is provided for rotationally orienting the housing 98 in the borehole 26 Preferably, the mandrel engaging means 116 is a ratchet-type mechanism, one-way clutch-type mechanism, or the like which allows the mandrel 86 to rotate relative to the housing 98 in one direction, but rotates the housing 98 with the mandrel 86 when the mandrel is rotated in the opposite direction. In a preferred embodiment, the mandrel engaging means 116 includes a recess 118 in the mandrel 86 and a pawl 120 activated by spring 122. The pawl 120 is connected to the inside surface of the housing 98. The recess 118 is shaped and the pawl 120 is positioned by the spring 122 so that the pawl 120 latchingly engages the recess 118 when the mandrel 86 is rotated counterclockwise and so that the pawl 120 does not engage the recess 118 when the mandrel 86 is rotated in a clockwise direction.

Referring to the example of FIGS. 16, 18, and 19, the housing also includes angle control means 124 for preventing the magnitude of the deflection 30 from increasing above a predetermined value and decreasing below a predetermined value. The angle control means 124 provides a mechanism which assists in regulating the radius of curvature of the curved borehole 26. In the preferred embodiment, the angle control means 124 includes an uphole deflector 126 which extends radially from the outside surface near the uphole end 100 of the housing 98. The uphole deflector 126 deflectively contacts the borehole wall 28 in order to create the deflection 30 and to prevent the magnitude of the deflection from decreasing below a predetermined value (and the radius of curvature $R_c$ from increasing above a predetermined magnitude). The radial extension of the uphole deflector can be selected so that the uphole end of the curve guide means 34 and mandrel 86 are deflected a desired minimum amount. The uphole deflector 126 defines the inside radius of the deflection 30, and the instantaneous inside radius $R_i$ of the curved borehole as it is being drilled. As best seen in FIG. 19, the preferred uphole deflector 126 extends from one side of the housing 98, generally in one radial direction, in order to deflect the housing and drill string 24 in the opposite direction. The uphole deflector 126 may include one or more ribs 126 which define channels 127. The channels 127 allow drilling fluid to flow past the uphole deflector 126 and housing 98. The circumferential dimension of the uphole deflector 126 is preferably shaped to conform to the circumference of the borehole 26, as exemplified in FIG. 19.

Figure 18:
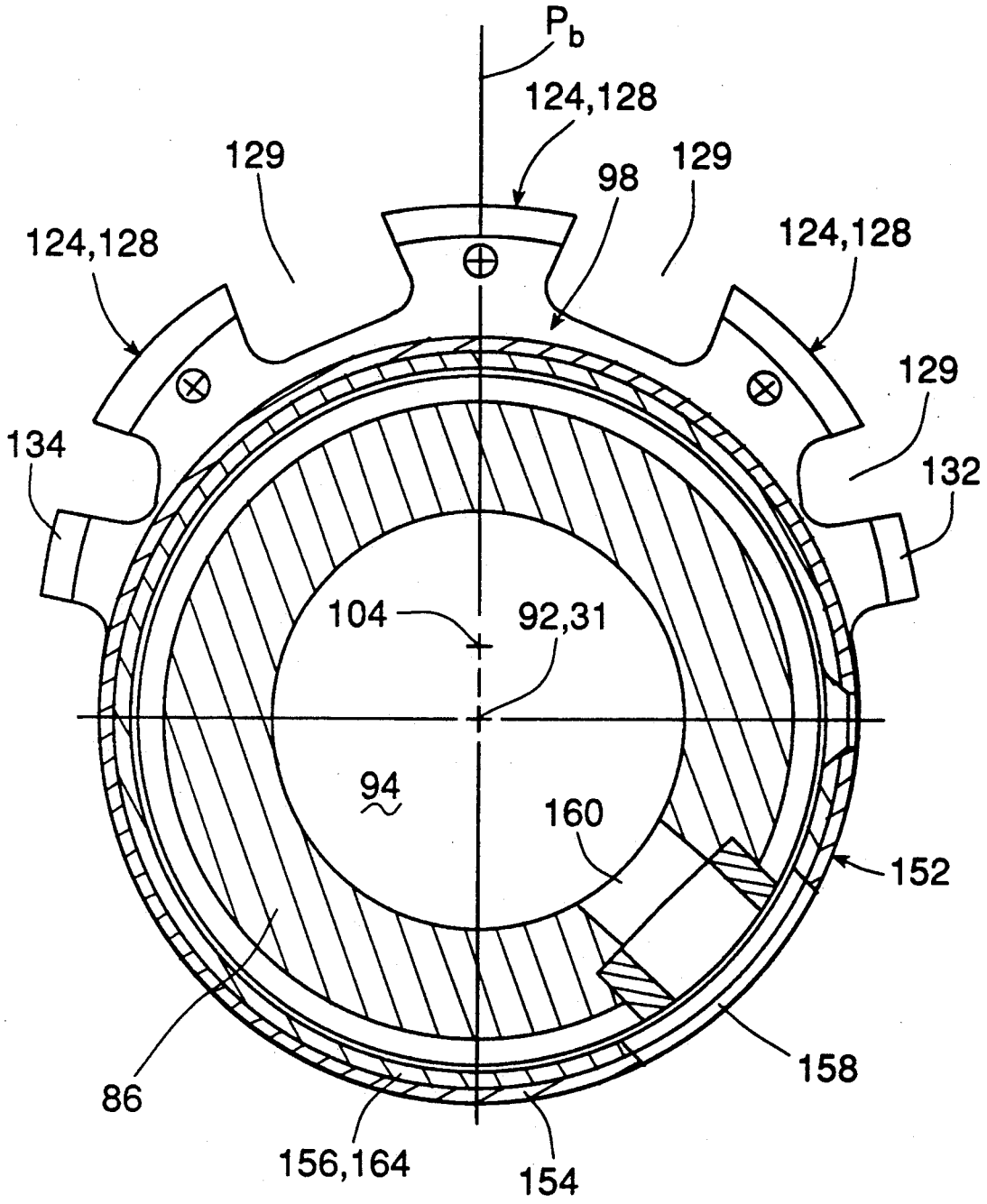
FIG. 18 is a sectional view taken along line 18-18 of FIG. 16.
Figure 19:
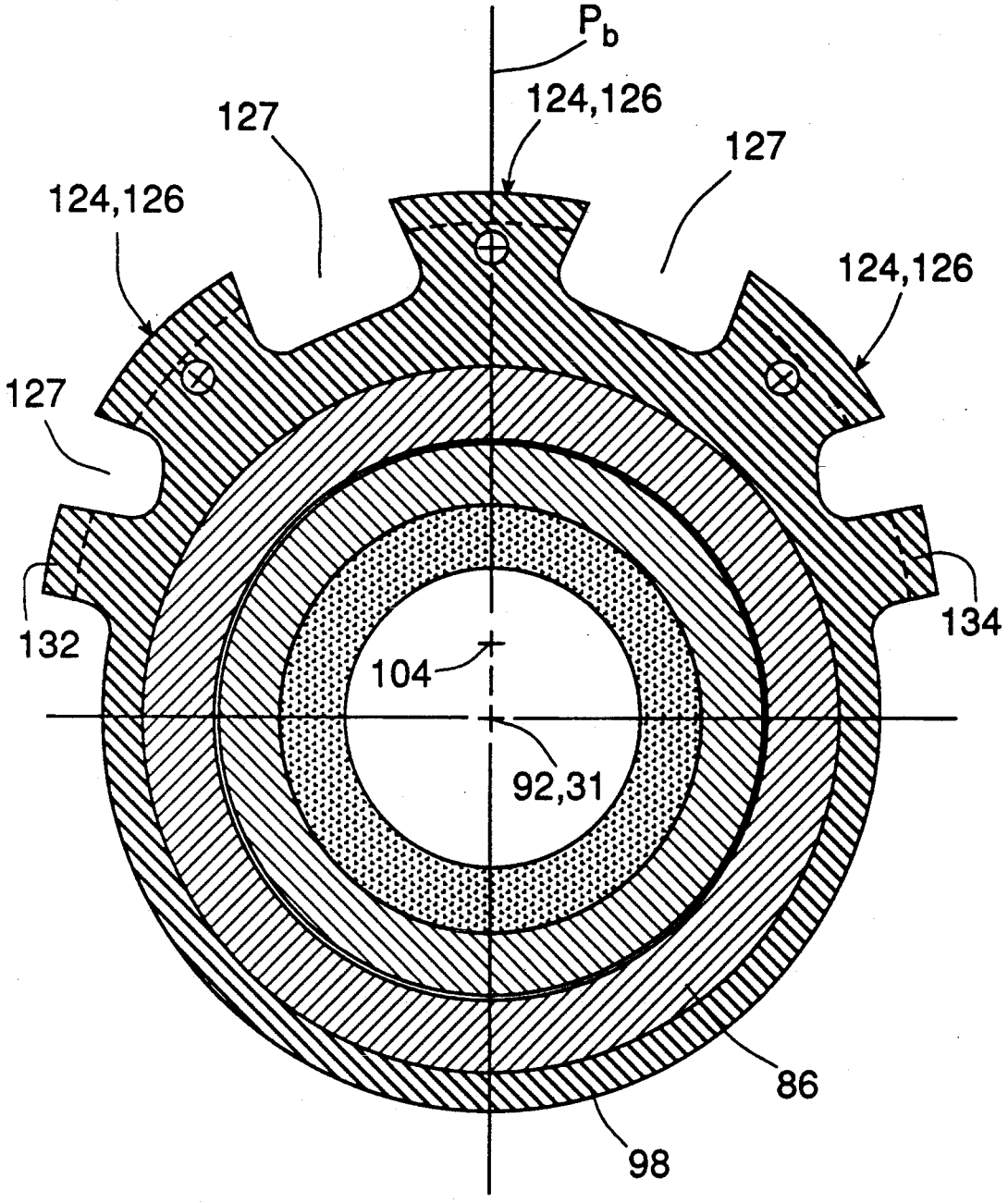
FIG. 19 is a sectional view taken along line 19-19 of FIG. 16.

As exemplified in FIG. 18, the preferred angle control means 124 further includes a downhole deflector 128 which extends from one side of the outside surface near the downhole end 102 of the housing 98 in a radial plane or planes about coincident with the uphole deflector 126. The downhole deflector 128 should be sized to deflectively contact the borehole wall 26 in order to prevent the magnitude of the deflection 30 from increasing above a predetermined value. If the magnitude of deflection 30 becomes too great, the downhole deflector 128 contacts the inside radius $R_i$ of the borehole 26 and prevents further increase in the deflection (and decrease in the radius of curvature $R_c$). This can be an important function when the curve drilling assembly 20 is drilling from a layer of harder subterranean materials into a softer layer, at which time the curve drilling assembly tends to begin rapidly increasing deflection and decreasing the radius of curvature of the curved borehole 26. Under normal curve drilling conditions the preferred downhole deflector 128 does not contact the borehole wall 28. The downhole deflector 128 may include one or more ribs 128 which define channels 129. The channels 129 allow drilling fluid to flow past the downhole deflector 128 and housing 98.

As exemplified in FIGS. 1, 18, and 19, the preferred curve guide means 34 further provides for restricting lateral motion of the housing 98, mandrel 86, and drill bit 22 in the borehole 26 in order to keep the rotational axis 92 of the mandrel 86 and the longitudinal axis 31 of the drill bit 22 about coplanar with a plane $P_b$ defined by the curved borehole during drilling. In the preferred embodiment, this feature is provided by sizing laterally extending ribs 132, 134 so that they define a diameter slightly less than that defined by the gauge radius $R_g$ of the drill bit 22. The ribs 132, 134 limit the transverse motion of the assembly 20 (with respect to the plane $P_b$) in the borehole and assist the assembly 20 in controlling the azimuthal direction of the drilling and of the curved borehole so that the curved borehole 26 remains in a single plane $P_b$.

Referring to the example of FIG. 2, the rotational axis 92 of the mandrel 86 may be skewed with respect to the longitudinal axis 104 of the housing 98. The amount of skew, or the angle, between the mandrel axis 92 and housing axis 104 may be selected, or adjusted, in conjunction with the sizing of the uphole and downhole deflectors 126, 128 to assist in regulating the magnitude of the deflection 30 and the radius of curvature $R_c$ of the curved borehole drilled by the curve drilling assembly 20.

Referring to the example of FIG. 16, the housing 98 further includes an uphole bushing 136 and a downhole bushing 138. The uphole and downhole bushings 136, 138 are preferably constructed and arranged so that the housing 98 does not contact the mandrel 86 except through the bushings 136, 138 in order to reduce friction and wear. Further, the preferred uphole and downhole bushings are located between the housing and the mandrel at the uphole and downhole ends 100, 102 of the housing 98, respectively, in order to facilitate removal and replacement of the bushings 136, 138, as well as removal and replacement of the housing 98 on the mandrel 86.

The preferred curve drilling assembly 20 also provides an uphole retaining ring 140 connectable to the mandrel 86 at the uphole end 100 of the housing 98 for retaining the housing 98 on the mandrel 86 and a downhole retaining ring 142 connectable to the mandrel 86 at the downhole end 102 of the housing 98 for retaining the housing 98 on the mandrel 86. Preferably, one of the retaining rings 140, 142 is an integral part of the mandrel 86 and the other of the retaining rings 140, 142 is detachably connectable to the mandrel 86 in order to facilitate removal and replacement of the bushings 136, 138, as well as removal and replacement of the housing 98 on the mandrel 86 In the preferred embodiment of FIG. 16, the uphole retaining ring 140 is threaded for engagement with the uphole end of the mandrel 86 In the preferred embodiment of FIG. 20, the downhole retaining ring 142 is threaded for engagement with the downhole end 90 of the mandrel 86.

In a preferred embodiment of the invention, referring to the example of FIG. 16, the uphole bushing 136 includes a radial flange 144 located between the uphole end 100 of the housing 98 and the uphole retaining ring 140 and an axial flange 146 located between the inside surface of the housing 98 and the mandrel 86. Similarly, the downhole bushing 138 includes a radial flange 148 located between the downhole end 102 of the housing 98 and the downhole retaining ring 142 and an axial flange 150 located between the inside surface of the housing 98 and the mandrel 86. Preferably, the radial flanges 144, 148 are integrally formed with their respective axial flanges 146, 150. The radial flanges 144, 148 bear any thrust or axial loading exerted on the housing 98 by the drill string 24 and mandrel 86 and the axial flanges 146, 148 separate the housing 98 from the mandrel 86 and bear any lateral or radial forces between the mandrel 86 and housing 98. The bushings 136, 138 are press-fit into the housing 98 in the preferred embodiment. The bushings 136, 138 are preferably made of aluminum-bronze or similar low friction, wear resistant materials Signaling means 152 may be interposed between the uphole or downhole retaining ring 140, 142 and its respective bushing 136, 138.

Referring to the examples of FIGS. 16 and 18, the invention further includes signaling means 152 for generating a transmittable signal when the housing 98 is in a preselected rotational orientation with respect to the mandrel 86 in order to monitor the rotational orientation of the housing 98 in the borehole 26 from the surface of the earth, or other remote location. According to the invention, the preferred signaling means 152 includes a signal ring 154 detachably connectable to the housing 98 and a signal ring bushing 156 located between the signal ring 154 and the mandrel 86 in order to facilitate rotation of the mandrel 86 relative to the signal ring 154. As best seen in FIG. 18, the signal ring 154 and bushing 156 circumscribe the mandrel 86. A signal ring port 158 is provided in the signal ring and bushing; and a mandrel port 160 is provided in the mandrel 86. The ports 158, 160 are located so that they are radially coincident at least once during each rotation of the mandrel 86 with respect to the housing 98. As the mandrel 86 rotates within the signal ring 154, a pressure pulse is created each time the ports 158, 160 are aligned, i.e., fluid and pressure are allowed to escape from the mandrel fluid passageway 94 through the ports 158, 160 into the borehole 26. The escaping fluid creates the pressure pulse which is transmitted through the drilling fluid in the drill string 24 to the surface of the earth where it may be monitored.

By establishing the relative positions of the angle control means 124, mandrel engaging means 116, and signal ring port 158 on the housing 98, the rotational orientation of the housing 98 and deflection 30 in the borehole 26 may be controlled and monitored. Since, in the embodiment of FIG. 16, the uphole deflector 126 defines the azimuthal direction of the deflection 30 with respect to the longitudinal axis of the borehole and therefore defines the plane $P_b$ of the curved borehole 26 (as does the downhole deflector 128 in FIG. 20), the circumferential position of the signal ring port 158 on the housing 98 relative to the uphole deflector 126 (downhole deflector in FIG. 20) is preferably established and fixed. By doing so, the azimuthal direction of the deflection 30 in the borehole 28 may be monitored (after establishing the initial rotational orientation of the uphole deflector in the borehole by wireline surveying or other known techniques) by monitoring the occurrence of the pressure pulses Preferably, the recess 118 and pawl 120 are radially coincident simultaneously with the radial coincidence of ports 158, 160 and a pressure pulse will occur and the accompanying pressure decrease will endure when the recess 118 and pawl 120 are engaged to rotate the housing 98 with the mandrel 86 so that the rotational orientation of the uphole deflector 126 (downhole deflector in FIG. 20) in the borehole 26 may be changed (once it has been initially established by survey or the like) without requiring additional surveying. The signaling means may be used to dynamically monitor the rotational orientation of a housing on a rotating mandrel and the azimuthal direction of a deflection in a drill string created by such a housing, as is described in assignee's copending U.S. patent application Ser. No. 07/771,587, filed on Oct. 3, 1991, entitled "Method of Dynamically Monitoring the Orientation of a Curve Drilling Assembly", invented by Tommy M. Warren and Warren J. Winters, which is a continuation-in-part of U.S. patent application Ser. No. 07/592,433, and which is incorporated herein by reference.

The signal ring 154 may be an integral part of the housing 98. Preferably, the signal ring is detachably connectable to the housing 98 to facilitate maintenance. It is expected that the signal ring 154 and signal ring bushing 156 will require more maintenance than the remainder of the housing 98. More preferably, the signal ring 154 is detachably connectable to one of the uphole end 100 (FIG. 20) and downhole end 102 (FIG. 16) of the housing 98 in order to further facilitate removal and replacement of the signal ring 154 and signal ring bushing 156. In the preferred embodiment of FIG. 16, the signal ring 154 is located between the downhole bushing 138 and the downhole retaining ring 142. The signal ring bushing 156 includes a radial flange 162 to bear thrust loadings between the signal ring 154 and the downhole retaining ring 142 as well as an axial flange 164 to bear radial and lateral loadings between the mandrel 86 and the signal ring 154. The radial flange 148 of the downhole bushing 138 bears thrust loadings between the signal ring 154 and the housing 98.

In the prototype of the signal ring 154, the signal ring bushing 156 is press fit into the signal ring 154 and then machined out to the desired bushing thickness. This construction method is provided to overcome the problems of crinkling and breaking of the bushing material, particularly in the axial flange 164, which occur with attempts to press-fit a bushing of the desired operating thickness directly into the signal rings used with mandrels of smaller diameters, particularly diameters smaller than four inches Preferably, the signal ring bushing 156 is made of the same material as the uphole and downhole bushings 136, 138.

3.2 Contact Means

The invention provides contact means 50 which, together with the curve guide means 34, provides for controlling the forces created near the deflection 30.

Referring to the example of FIG. 2, the drill string 24 exerts an axial force $F_a$ along an axial force vector during drilling operations. The axial force vector will normally coincide with and extend along the longitudinal axis 32 of the drill string The deflection 30 of the drill string 24 creates a longitudinal force component $F_{la}$ and a radial force component $F_{ra}$ of the axial force $F_a$. The longitudinal force component $F_{la}$ is directed along a longitudinal force vector which extends along the longitudinal or rotational axis 92 of the mandrel 86 and the longitudinal bit axis 31. The radial force component $F_{ra}$ is directed along a radial force vector towards the outside radius $R_o$ of the curved borehole 26 The contact means 50 is provided for contacting the borehole wall 28 and supporting the radial force component $F_{ra}$ on the borehole wall during drilling. The contact means 50 is preferably located on or adjacent and rotatable with one of the uphole end 88 or downhole end 90 of the mandrel 86, as will be further discussed below.

In the preferred embodiment of the invention, referring to the example of FIG. 2, the contact means 50 is a contact ring 50 disposed on and circumscribing the outside surface of one of the uphole end 88 and the downhole 90 of the mandrel 86. Preferably, the contact ring 50 has a substantially smooth wear-resistant sliding surface 176 for slidably contacting the borehole wall 28 during drilling. The sliding surface 176 of the contact ring is preferably made of the same materials as the bearing means sliding surface 48 discussed above. The preferred sliding surface 176 has sufficient surface area that the magnitude of the radial force component $F_{ra}$ of the axial force $F_a$ acting on the sliding surface 176 is less than the compressive strength of the subterranean materials of the borehole wall 28 and, therefore, the contact ring 50 does not dig into the borehole wall 28, which would compromise the curve-creating structural configuration of the assembly 20 and overgauge the borehole 26.

As well as supporting the radial force component $F_{ra}$ on the borehole wall 28, the contact means 50 (together with the drill bit 22) transfers all radial and lateral forces created in the curve drilling assembly 20 to the borehole wall 28. The contact means 50 also provides several other important functions. For example, it removes the radial force component $F_{ra}$ from the housing 98, which eliminates having a single wear point in the nonrotating housing and allows the housing 98 and bushings 136, 138 to be made of lighter material, which in turn allows the mandrel 86 to be of heavier materials thereby maintaining the structural integrity of the drill string 24 as the mandrel passes through the housing 98; it provides a rotating contact with the borehole wall 28 thereby spreading the wear on the relatively moving surface areas of the contact ring 50 and the borehole wall 28; and it provides a contact of fixed position on the assembly 20 to be used in calculating and predetermining the radius of curvature $R_c$ of the curved borehole 26.

By fixing the position of the contact ring 50 on the assembly, the assembly 20 may be designed and built to drill a curved borehole 26 having a more predictable and constant radius of curvature $R_c$. This may be seen by referring to the example of FIG. 18 and to the following equation:

$$R_c = \frac{L^2}{(d_1 - d_2)}$$

where:

L = the distance between the lowermost cutting edge of the lowermost gauge cutter 56 and the uphole end of the sliding surface 176 of the contact means 50;

$d_1$ = outside diameter of the drill bit 22; and $d_2$ = outside diameter of the contact means 50.

As the equation demonstrates, the more accurately the distance L can be defined, the more accurately predictable the radius of curvature of the borehole will be. The equation also demonstrates that, by varying the dimensions of L, $d_1$, and $d_2$, the radius of curvature can easily and predictably be varied. For example, by making the outside diameter $d_2$ of the contact means 50 larger, the radius of curvature $R_c$ can be increased. Similarly, by increasing or decreasing the distance L, the radius of curvature can be accordingly increased or decreased in direct proportion to the change in the square of the length L.

In the preferred embodiment, contact means, or ring, 50 is provided at the uphole end 88 of the mandrel 86 for contacting the borehole wall 28 and supporting the radial force component $F_{ra}$ of the axial force $F_a$ on the borehole wall 28 during drilling. Preferably, the contact ring 50 is disposed on the outside surface of the uphole retaining ring 140, as exemplified in FIG. 16. In an alternative embodiment, exemplified in FIG. 20, the contact means 50 may be located on the downhole end 90 of the mandrel 86.

Referring to the example of FIG. 2, the deflection 30 of the drill string created by the curve guide means 34 will force the contact means 50 against the outside radius $R_o$ of the curved borehole 26 or, if the assembly 20 is being used to initiate a curved borehole 26, the contact means 50 will be forced against the borehole wall 28 which is diametrically opposite to the radial extension of the uphole deflector 126 from the housing 98. The outside diameter $d_2$ of the contact ring 50 is preferably selected so that the contact ring 50 extends radially from the outside surface of the mandrel 86 farther than does the outside surface of the housing 98 adjacent the outside radius $R_o$ of the curved borehole 26 and so that the assembly 20 has load bearing contact with the borehole wall 28 at the drill bit 22 and the contact ring 50 but not on the housing 98. By selecting the diameter $d_2$ of the contact means 50 so that the housing 98 does not contact the outside radius $R_o$ of the borehole wall 28, the housing 98 does not support the radial force component $F_{ra}$ on the borehole wall 28.

Figure 20:
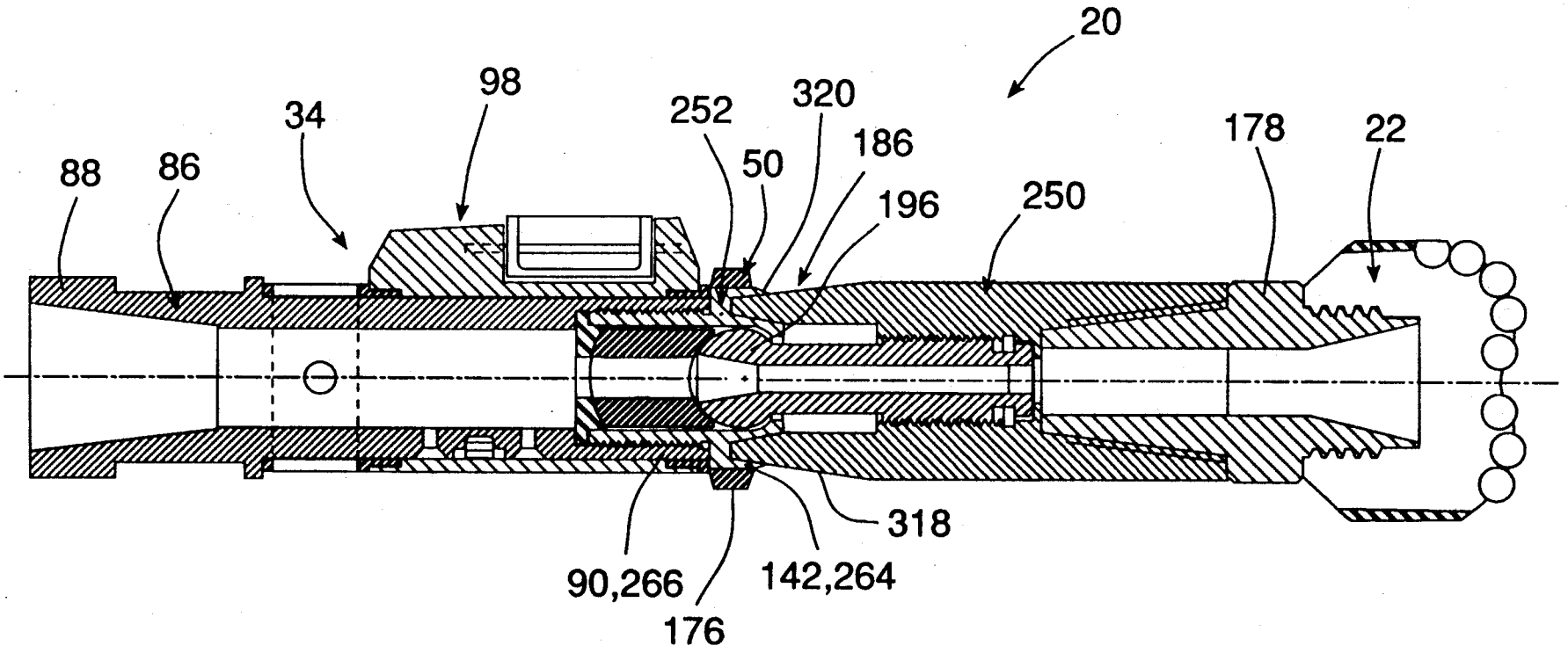
FIG. 20 is a sectional view of another embodiment of the curve drilling assembly of the present invention.

Referring to the example of FIGS. 16 and 20, the invention includes a spacing member 178 which is detachably connectable between the drill bit 22 and the downhole end 90 of the mandrel 86 for varying the distance between the drill bit 22 and the mandrel downhole end 90 without modifying the drill bit 22 or the mandrel 86 (flexible joint 186 in FIG. 20). The inventors have found that the simplest method of varying the radius of curvature $R_c$ is to vary the length L and have designed the spacing member 178 for this purpose. The spacing member 178 is designed to be relatively quickly and inexpensively manufactured in various lengths. This allows the other components, i.e., the drill bit, contact ring 50, mandrel 86, flexible joint 186, etc., which require more expensive and time-consuming manufacturing processes, to be made in uniform sizes rather than requiring expensive custom manufacturing

4.0 FLEXIBLE JOINT

Although the invention as previously described may be used in drilling curved boreholes having long, medium, and short radii of curvature, it is desirable to modify the drill string near the assembly 20 for drilling a short radius curved borehole, i.e., it is desirable to make the drill string 24 near the assembly more flexible in order to enhance the ability of the assembly 20 to drill along a short radius of curvature. "Short radius" of curvature generally refers to a curved borehole having a radius of curvature less than 80 feet.

Figure 21:
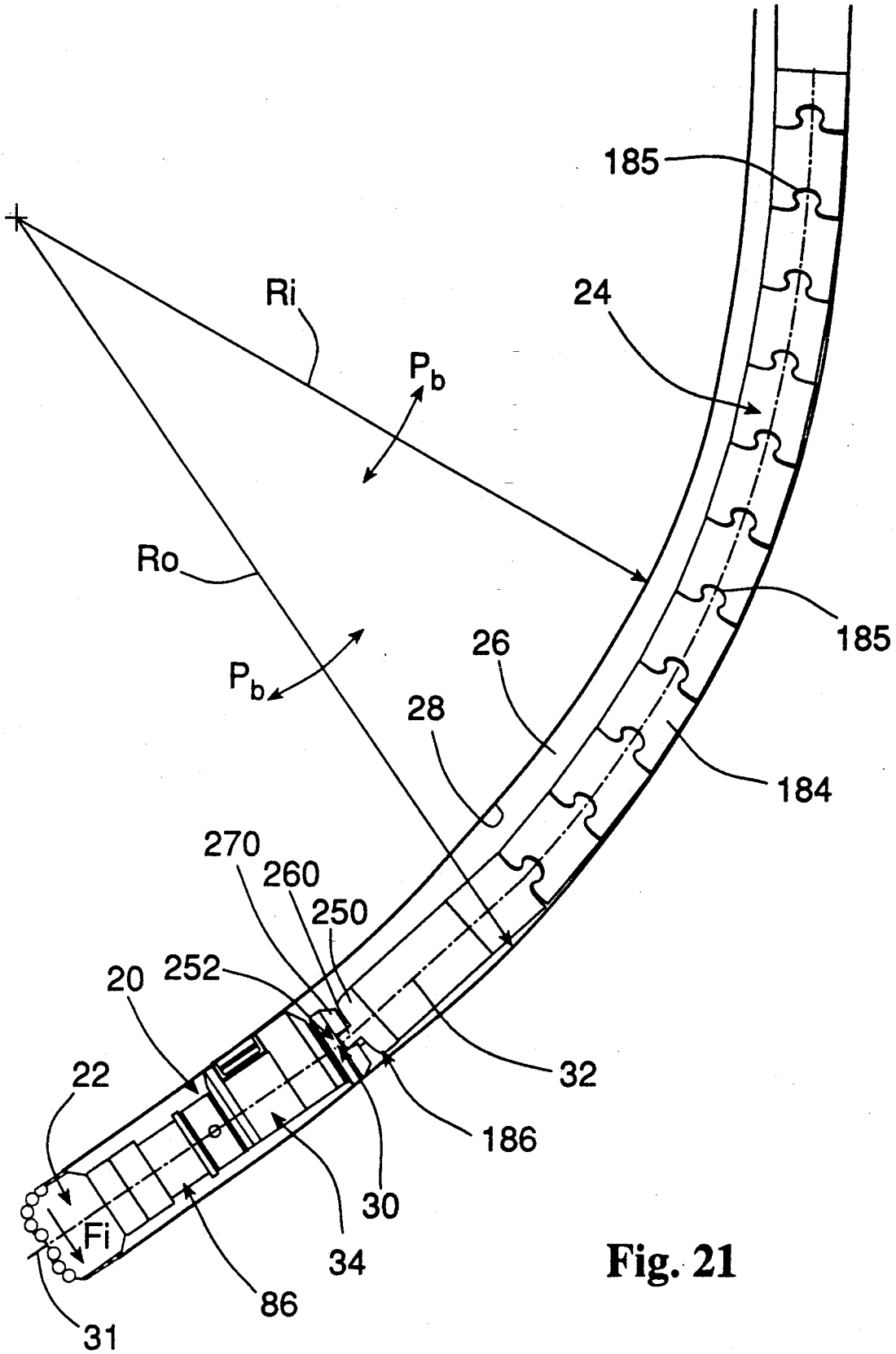
FIG. 21 is a schematic representation of an embodiment of the curve drilling assembly of the present invention used for drilling curved boreholes having a short radius of curvature.

Referring to the example of FIG. 21, the preferred modifications for drilling a curved borehole having a short radius of curvature include adding a flexible or articulating section 184 of drill string immediately above the curve drilling assembly 20. The articulating section 184 is preferably comprised of sections of pipe having articulating joints 185, or the like, as would be known to one skilled in the art in view of the disclosure contained herein. The articulating section 184 is provided so that the drill string 24 does not impair the ability of the assembly 20 to drill a short radius curved borehole, i.e., a conventional drill string often does not have sufficient flexibility to traverse a short radius curved borehole and therefore may not allow the assembly 20 to drill a short radius curved borehole The articulating section 184 preferably extends uphole from the assembly 20 through the curved portion of the borehole.

A second modification which further enhances the flexibility of the drill string 24 and the ability of the invention to drill a short radius curved borehole is the addition of a flexible joint 186. In the preferred embodiment, the flexible joint 186 is used for connecting the curve guide means 34 with the drill string 24, i.e., the flexible joint 186 is connectable between the drill string 24 and the uphole end 88 of the mandrel 86 for flexibly connecting the curve drilling assembly 20 to the drill string 24, as exemplified in FIG. 16. The flexible joint 186 may be a knuckle joint, articulated pipe joint, or other form of universal joint capable of creating the deflection 30 and transmitting torsional, thrust, and tensile forces through the deflection 30. Preferably, an improved flexible joint 186 according to the present invention, as described below, is used.

4.1 First Embodiment

Figure 22:
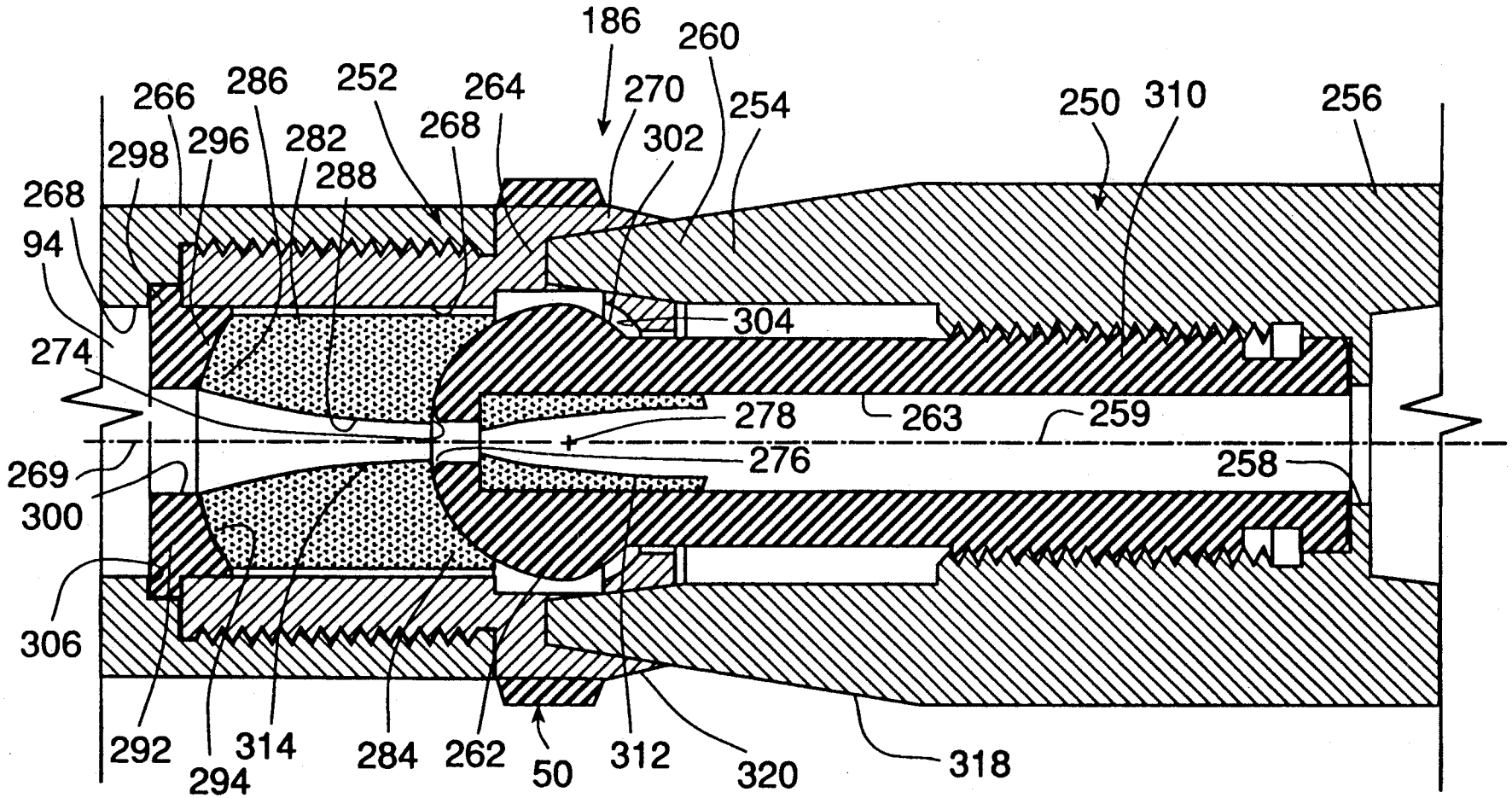
FIG. 22 is a sectional view of a flexible joint used with the present invention.
Figure 22A:
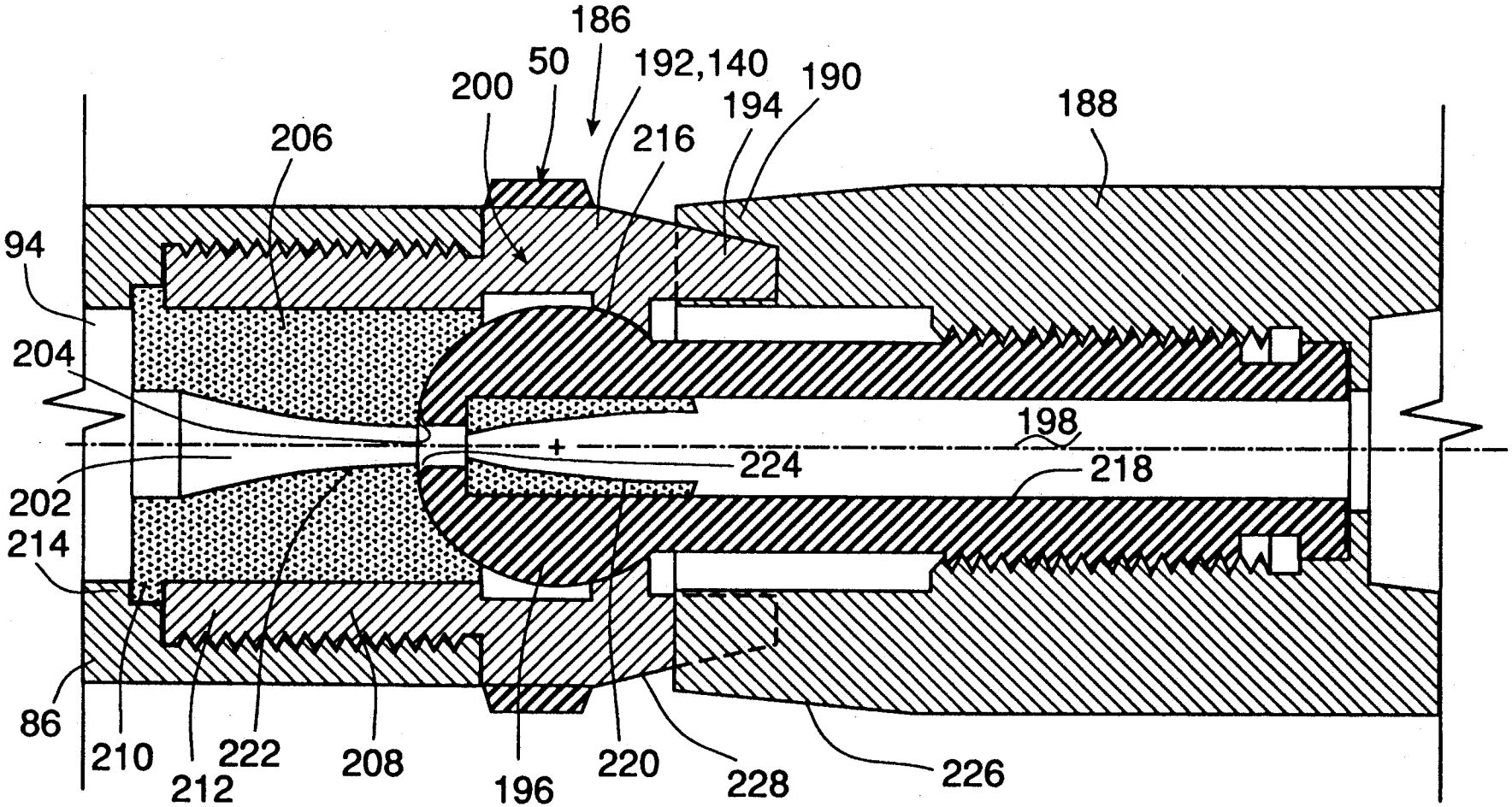
FIG. 22A is a sectional view of another embodiment of a flexible joint of the present invention.

According to a first embodiment of the inventive flexible joint 186, referring to the example of FIG. 22A, the flexible joint 186 includes an about cylindrical ball housing 188 having a toothed end 190 and an about cylindrical socket housing 192 having a toothed end 194 The toothed ends 190, 194 are shaped to interengage and form an articulating joint (best exemplified in FIG. 2) as well as to transmit the rotation and the torsional forces of the drill string 24 to the drill bit 22. The ball housing 188 includes a ball 196 having a fluid passageway 198. The socket housing 192 includes a socket 200 for enclosing and capturing the ball 196 and also has a fluid passageway 202. The preferred ball and socket 196, 200 are constructed and arranged so that the ball and socket 196, 200 and the fluid passageways 198, 202 are in fluid communicating contact in all drilling positions of the flexible joint 186. The ball and socket 196, 200 transmit the compressive and tensile forces between the drill string 24 and drill bit 22.

The preferred ball 196, socket 200, and toothed ends 190, 194 are sized so that the ball 196 engages the thrust bearing surface 204 of the socket 200 before the toothed ends 190, 194 make contact when the flexible joint 186 is subjected to compressive forces, such as the weight-on-bit exerted during drilling. This arrangement is provided so that the flexible joint is flexible under such compressive forces. The inventors have found that, if the toothed ends 190, 194 make thrust transmitting contact, particularly if the portions of the toothed ends 190, 194 on the inside radius of the deflection in the flexible joint 186 make contact before the ball 196 seats against the thrust bearing surface 204, the contact of the toothed ends 190, 194 will tend to straighten out the desired bend or deflection 30 in the flexible joint 186.

Preferably, the thrust bearing surface 204 is formed in a thrust bearing insert 206 which is placed inside the socket housing 192. The thrust bearing insert circumscribes the fluid passageway 202 in the socket housing 192 The socket housing 192 includes a shank 208 for connecting the housing 192 to a drill pipe, drill collar, or the like. In the preferred embodiment, the outside surface of the shank 208 has male threading for engagement with female threading inside the fluid passageway of a drill pipe, mandrel, or the like. The preferred thrust bearing insert 206 includes a flange 210 which holds the insert 206 in place between the end 212 of the socket housing shank 208 and a shoulder 214 inside the mandrel 86. The preferred socket housing 192 also includes a tensile bearing surface 216 which retains the ball 196 in the socket 200 when tensile forces exist between the drill string 24 and drill bit 22, such as when the drill string 24, drill bit 22, and assembly 20 are lifted out of a borehole 26.

In the preferred embodiment, the ball 196 is formed on a ball shaft 218 and the ball shaft serves to connect the ball 196 within the ball housing 188 in such a manner that the ball 196 and ball shaft 218 may be removed and replaced, as may the thrust bearing insert 206 and the socket housing 192. The ball shaft 218 includes male threading for engaging the female threading inside the ball housing 188, which may be a drill pipe, drill collar, mandrel, or the like. The ball 196, socket 200, and other components of the flexible joint 186 should be made of materials suitable for the compressive, tensile, torsional, and other forces expected to be exerted by the drill string 24 on the assembly 20 and drill bit 22 during drilling operations, as would be known to one skilled in the art in view of the disclosure contained herein.

Further, in the preferred flexible joint 186, the fluid passageway 198, 202 in the one of the ball 196 and socket 200 to be placed uphole of the other includes a nozzle 220 for accelerating drilling fluid passing through the nozzle 220. The fluid passageway 198, 202 in the one of the ball 196 and socket 200 to be placed in the downhole side of the flexible joint 186 includes a diffuser 222 for recovering fluid pressure dropped in the nozzle 220. The nozzle 220 accelerates the fluid before it crosses the gap 224 between the ball 196 and socket 200. The accelerated fluid has a lower pressure than the fluid on the exterior of the ball 196 and socket 200 and the pressure differential reduces leakage of the fluid from inside the ball and socket 196, 200 to the outside The diffuser 222 decelerates the fluid in such a manner as to maximize the recovery of the pressure drop created by the nozzle 220, as would be known to one skilled in the art in view of the disclosure contained herein. The nozzle 220 and diffuser 222 are shaped so that irrecoverable pressure loss across the flexible joint 186 is minimized. The shaping and positioning of the nozzle 220 and diffuser 222, as well as their materials of construction, will be known to one skilled in the art in view of the disclosure contained herein.

The flexible joint 186 may be located at either of the uphole and downhole ends of the curve guide means 34; and is preferably placed at the same end of the curve guide means 34 as is the contact means 50. In the preferred embodiment, the contact means 50 is located at the uphole end 88 of the mandrel 86 and the flexible joint 186 is connected between the drill string 24 and the uphole end 88 of the mandrel 86 Preferably, the socket housing 192 is connected to the uphole end 88 of the mandrel 86 and the socket housing also serves as the uphole retaining ring 140. The contact means 50 is preferably located on the outside surface of the socket housing 192/uphole retaining ring 140 combination.

The outside surface 226 of the toothed end 190 of the ball housing 188 and the outside surface 228 of the toothed end 194 of the socket housing 192 are preferably beveled, or chamfered, as exemplified in FIG. 22A, so that the teeth do not protrude and dig into the borehole wall 28 when the flexible joint 186 is deflected.

4.2 Second Embodiment

In a second, more preferred, embodiment of the flexible joint 186, referring to the example of FIG. 22, the flexible joint 186 may be described as including a loading housing 250 and a socket housing 252. The loading housing 250 includes a first end 254, a second end 256, and a bore 258 extending through the first and second ends 254, 256. The preferred loading housing 250 is about cylindrical in shape and has a longitudinal axis 259 extending through the first and second ends 254, 256. The loading housing 250 also includes at least two loading housing teeth 260 extending from the first end 254 and a loading member 262 disposed in the bore 258 and extending from the first end 254 of the loading housing 250. The preferred loading housing teeth extend about axially from the first end of the loading housing 250. The second end 256 of the loading housing 250 is used for connecting the loading housing 250 into a drill string, drill collar, curve drilling assembly, or the like. Preferably, the bore 258 is in fluid communicating contact with bore 263 of the loading member 262, as exemplified in FIG. 22.

The socket housing 252 includes a first end 264, a second end 266, and a bore 268 extending through the first and second ends 264, 266. The socket housing 252 is constructed and arranged to receive the loading member 262 in the bore 268 at the first end 264 of the socket housing 252. The preferred socket housing 252 is about cylindrical in shape and has a longitudinal axis 269 extending through the first and second ends 264, 266. The socket housing also includes at least two socket housing teeth 270 extending from the first end 264 of the socket housing 252 for intermeshing with the loading housing teeth 260 in order to form a flexible connection between the loading and socket housings 250, 252 and to transmit rotation and torque between the loading housing 250 and the socket housing 252. The preferred socket housing teeth 270 extend about axially from the first end of the socket housing 252. The second end 266 of the socket housing 252 is used for connecting the socket housing 252 into a drill string, drill collar, curve drilling assembly, or the like.

In the second preferred embodiment of the flexible joint 186, the housings 250, 252 and teeth 260, 270 are constructed and arranged so that each of at least two loading housing teeth 260 make torque and rotation transmitting contact with a socket housing tooth 270 when torque is applied across the flexible joint 186. This feature limits the twisting of the loading housing 250 relative to the socket housing 252 and thereby limits the lateral displacement of the loading member 262 relative to the socket housing 250 due to such twisting. Preferably, the loading and socket housings 250, 252 are constructed and arranged so that each of at least two loading housing teeth 260 makes torque and rotation transmitting contact with a socket housing tooth 270 before the loading member 262 makes torque transmitting contact with the socket housing 252 This construction is preferably accomplished by designing and sizing the clearances, or spacing, between the contacting teeth 260, 270 and between the loading member and the socket housing bore 268 so that the teeth 260, 270 make sufficient contact to prevent further twisting of the loading housing 250 relative to the socket housing 252 before the loading member 262 makes torque transmitting contact with the socket housing.

Figure 21B:
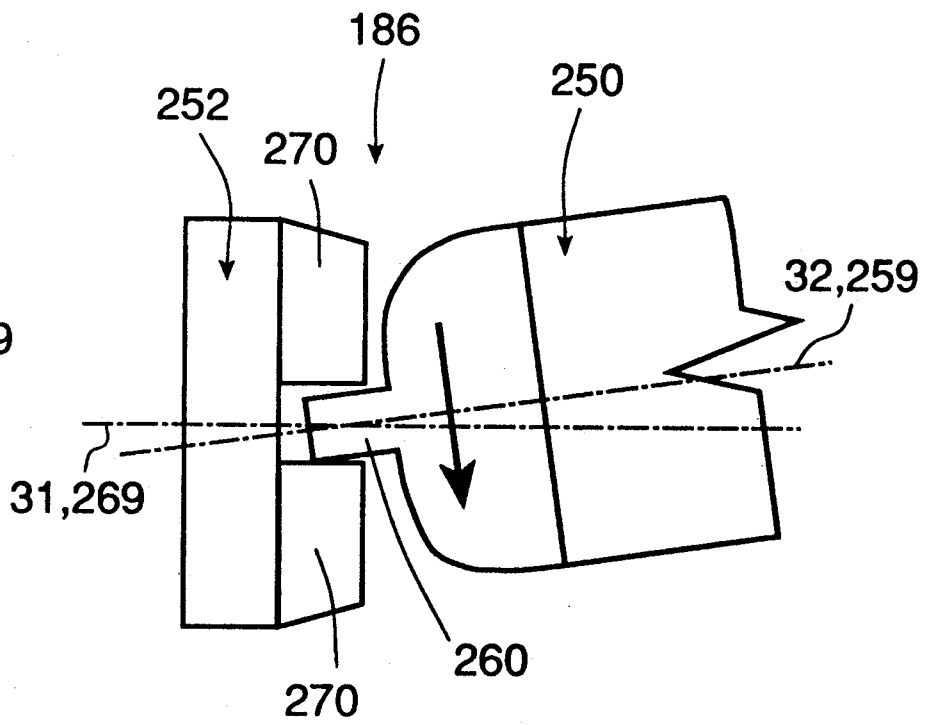
FIG. 21B is a front view of the flexible joint illustrated in FIG. 21.
Figure 21A:
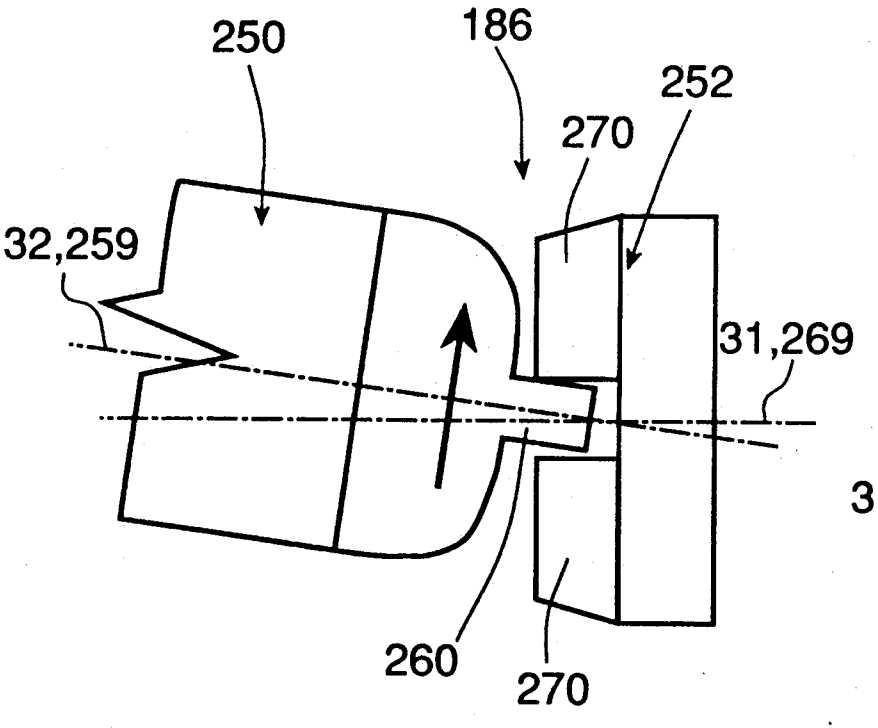
FIG. 21A is a back view of the flexible joint illustrated in FIG. 21.

The inventors have found that uncontrolled torque transmitting contact between the loading member 262 and the socket housing 252 results in failure of the loading member and also creates a net force which tends to undesirably straighten out the deflection 30 in the flexible joint 186. This problem and how it is solved by the flexible joint of the present invention may be better understood by reviewing the shape of the teeth 260, 270 and the dynamics of the flexible joint 186 during the drilling of a curved borehole. Assuming there are two diametrically opposed loading housing teeth 260, that the loading housing 250 is on the uphole side of the deflection, that the deflection 30 is in a vertical plane, and that the loading housing teeth 260 are not coplanar with the deflection, as exemplified in FIG. 21, when the flexible joint 186 is deflected and compressively loaded with the weight-on-bit, at least one loading housing tooth 260 moves downwardly with respect to the plane of deflection 30 (which is the plane of the drawing sheet of FIG. 21, 21A, or 21B) into contact with the socket housing tooth 270 below it, as exemplified in FIG. 21A. Because of the downward angle of the loading housing teeth 260, the lower side of the cusp, or free end, of the downwardly rotating tooth 260 makes contact with the socket housing tooth 270 below it. In order for the intermeshed teeth 260, 270 to deflect or flex with respect to one another, there must be clearance or space around the intermeshed teeth 260, 270. This clearance will normally be on the upper side (as shown in FIG. 21A) of the untorqued loading housing teeth 260 because of the downward force of the weight-on-bit which forces the loading housing teeth downwardly into contact with the socket housing teeth 270 below the loading housing teeth 260. When the drill string is rotated and torque is applied across the flexible joint 186, the loading housing 250 twists with respect to the socket housing 252 and the loading housing tooth 260 rotating downwardly (with respect to the plane of the deflection 30) is forced into contact with the socket housing tooth 270 below it, as exemplified in FIG. 21A. The loading housing 250 continues to twist with respect to the socket housing 252 until a second stabilizing contact capable of resisting further twisting is made. If there is insufficient clearance around the loading member 262, the loading member 262 will twist into torque transmitting contact with the socket housing 252. Preferably, there is sufficient clearance around the loading member 262 that the loading housing 250 continues to twist relative to the socket housing 252 until the upper side (as shown in FIG. 21B) of the upwardly rotating loading housing tooth 260 (which is on the diametrically opposite side of the loading housing from the downwardly rotating loading housing tooth 260) twists into contact with the socket housing tooth 270 above it and thereby makes a second stabilizing contact before the loading member 262 makes torque transmitting contact with the socket housing 252.

Preferably, the at least two loading housing teeth 260 making torque and rotation transmitting contact with socket housing teeth 270 are located at about diametrically opposed positions on the first end 254 of the loading housing 250. In the prototype flex joint 186, there are two loading housing teeth located at about diametrically opposite positions on the loading housing first end 254. By so placing the teeth 260, the forces created by the contacting teeth 260, 270 create a couple having a moment which is as nearly coaxial as possible with the axes 259, 269 of the flexible joint 186 and which therefore does not act to straighten out the deflection 30 created by the flexible joint 186.

Further, referring to the example of FIG. 22, in the second preferred embodiment of the flexible joint 186, the socket housing 252 includes a thrust bearing surface 274 disposed in the bore 268 of the socket housing 252 and the loading member 262 includes a thrust loading surface 276 for contacting the thrust bearing surface 274 and transferring thrust between the loading housing 250 and the socket housing 252, as is necessary to transfer the weight-on-bit from the drill string 24 to the curve drilling assembly 20. In the second preferred embodiment of the flexible joint 186, the thrust loading surface 276 and the thrust bearing surface 274 are constructed and arranged so that the thrust loading surface 276, when contacting the thrust bearing surface 274, is pivotable about a pivotal center 278 which is about coplanar, or radially coincident (with respect to the longitudinal axes of the housings 250, 252), with the torque transmitting contact between the loading housing teeth 260 and the socket housing teeth 270. This coplanarity or radial coincidence of the pivotal center 278 of the loading member 262 and the torque transmitting contact between the teeth 260, 270 is provided so that, if the loading member 262 makes torque transmitting contact with the socket housing 252 such contact will be about radially coincident with the teeth 260, 270 making contact, and the moment of the resulting force couple will be directed about parallel to the axes 259, 269 of the housings 250, 252. Directing the moment parallel to the axes 259, 269 of the housings 250, 252 reduces components of the moment which would straighten out the desired curve-creating deflection 30 in the flexible joint 186.

Another advantage of having the pivotal center 278 as nearly coplanar or radially coincident with the torque transmitting contact of the teeth 260, 270 as possible, is that such a structural configuration reduces the clearance between the loading member 262 and socket housing 252 needed to prevent torque transmitting contact by the loading member 262. Referring to the example of FIGS. 21 and 22, the magnitude of deflection 30 is determined by the distance or angle the loading member 262 pivots with respect to the socket housing 252 about pivotal center 278. The farther the pivotal center 278 is from being radially coincident with the contact between the teeth 260, 270, the farther the loading housing teeth 260 deflect with respect to the socket housing teeth 270 as the loading member 262 pivots a given distance about the pivotal center 278. The farther the loading housing teeth 260 must deflect with respect to the socket housing teeth 270, the greater the clearance or space between the intermeshed teeth 260, 270 must be to allow the teeth to deflect with respect to one another, particularly when the teeth are not in the plane of the deflection, as best exemplified in FIGS. 21, 21A, and 21B. The more space or clearance there is between the teeth 260, 270, the greater the distance the upwardly rotating loading housing tooth 260 must twist to make contact with the socket housing tooth 270 above it (as best seen in FIG. 21B) when the downwardly rotating loading housing tooth 260 is in contact with the socket housing tooth 270 below it (best seen in FIG. 21A). The greater the distance the upwardly rotating loading housing tooth 260 must twist, the more the loading member 262 must twist and the greater the clearance between the loading member 262 and socket housing 252 must be to prevent torque transmitting contact by the loading member 262.

The preferred loading member 262, socket housing 252, and teeth 260, 270 are constructed and arranged so that the thrust loading surface 276 engages the thrust bearing surface 274 before the teeth 260, 270 make thrust bearing contact when the flexible joint 186 is subjected to thrust, or compressive, forces, such as the weight-on-bit exerted during drilling. As with the first embodiment of the flexible joint 186, this arrangement is provided so that the flexible joint is flexible under thrust and compressive loadings. The inventors have found that if the teeth 260, 270 make thrust transmitting contact, such contact will tend to straighten out the desired bend or deflection 30, particularly if the thrust transmitting contact of the teeth 260, 270 is on the inside radius of the deflection 30.

The socket housing 252 further includes a thrust bushing 282 for transferring thrust between the loading member 262 and the socket housing 252. The thrust bushing includes a first end 284, a second end 286, and a bore 288 passing through the first and second ends 284, 286. Preferably, the first end 284 of the thrust bushing 282 includes the thrust bearing surface 274 for contacting the thrust loading surface 276 of the loading member 262 and transferring thrust between the loading member 262 and the thrust bushing 282. The thrust bushing 282 is movably disposed in the socket housing bore 268 in such a manner that the thrust bearing surface 274 is free to move laterally in the bore 268 with the thrust loading surface 276 and loading member 262. This lateral movement of the thrust bearing surface 274 may be provided by designing and sizing the thrust bushing 282 to slide laterally in the bore 268 or to tilt in the bore 268. The lateral mobility of the thrust bearing surface 274 allows the thrust bushing 282 to transfer thrust to the socket housing 252 without transferring torque from the loading member 262 and without restricting the ability of the loading member 262 to twist and/or move laterally with respect to the socket housing 252 as the loading housing 250 so moves.

The loading member 262 should be able to move laterally a sufficient distance that at least two loading housing teeth 260 (preferably two diametrically opposed loading housing teeth 260) can make contact with socket housing teeth 270 If the thrust bushing 282 does not move laterally with the loading member 262, it can restrict the lateral motion of the loading member 262 due to twisting of the loading housing 250 relative to the socket housing 252 and may prevent contact by at least two loading housing teeth 260. If at least two loading housing teeth do not make torque transmitting contact, the torque transmitted across the flexible joint 186 may be transmitted by one loading housing tooth 260 and the loading member 262 rather than by two loading housing teeth 260. The lateral movement of the thrust bushing 282 with the loading member 262 facilitates movement of a second loading housing tooth 260 into contact with a second socket housing tooth 270.

The preferred socket housing 252 further includes a compression bearing 292 for transferring thrust between the thrust bushing 282 and the socket housing 252 The compression bearing 292 includes a compression bearing surface 294 disposed in the bore 268 of the socket housing 252 between the thrust bushing second end 286 and the socket housing 252 with the compression bearing surface 294 adjacent the thrust bushing second end 286. The thrust bushing second end 286 and the compression bearing surface 294 are constructed and arranged so that the thrust bushing second end 286 slidably engages the compression bearing surface 294 in order to enhance the ability of the thrust bushing 282 and thrust bearing surface 274 to move laterally with the loading member thrust loading surface 276.

The compression bearing surface 294 may be formed in the second end 266 of the socket housing 252. In the preferred embodiment, referring to the example of FIG. 22, the compression bearing 292 is independent of the socket housing 252 and is placed in the bore 268 of the socket housing 252 between the thrust bushing 282 and the socket housing second end 266. The preferred compression bearing has a first end 296, a second end 298, and a bore 300. The compression bearing surface 294 is formed in the first end 296 of the compression bearing 292. The compression bearing surface 294 and thrust bushing second end 286 may be planar so that the thrust bushing 282 simply slides on the compression bearing 292. Preferably, as exemplified in FIG. 22, the compression bearing surface 294 and thrust bushing second end 286 are mating convex and concave surfaces so that the thrust bushing 282 will tilt with respect to the longitudinal axis 269 of the socket housing 252 as the thrust bushing second end 286 slides on the compression bearing surface 294. In the prototype flexible joint 186, the compression bearing surface 294 is concave in shape and the thrust bushing second end 286 is convex in shape although either surface 286, 294 may be convex with the other being concave.

As exemplified in FIG. 22, as is the thrust bushing 282, the compression bearing 292 may be free to move laterally or radially with respect to the socket housing 252 and may also be free to move axially in the socket housing 252 between the first and second ends 264, 266 of the socket housing 252.

In the second preferred embodiment of the flexible joint 186, the loading member 262 further includes a tension loading shoulder 302 extending laterally outwardly from the loading member 262. The socket housing 252 includes a tension bearing shoulder 304 extending laterally inwardly in the bore 268 of the socket housing 252 for capturing the tension loading shoulder 302 and for contacting the tension loading shoulder and transferring tension between the loading housing 250 and the socket housing 252. The tension loading shoulder 302 and the tension bearing shoulder 304 are constructed and arranged so that each of at least two loading housing teeth 260 makes torque and rotation transmitting contact with a socket housing tooth 270 when torque is applied across the flexible joint 186 before the loading member 262 makes torque transmitting contact with the socket housing 252. The shoulders 302, 304 should be designed and constructed so that they do not restrict the ability of the loading housing 250 to twist relative to the socket housing 252 This construction may be accomplished by providing sufficient axial and lateral clearance around the loading member 262 and shoulders 302, 304 in the socket housing 252 that the loading member 262 and tension loading shoulder 302 will not make torque transmitting contact with the socket housing 252 or tension bearing shoulder 304 before torque transmitting contact is made by at least two loading housing teeth 260 and socket housing teeth 270.

In order to provide the approximate coplanarity, or radial coincidence, between the pivotal center 278 of the loading member 262 and the torque transmitting contact of the teeth 260, 270, it is preferred that the tension bearing shoulder 304 be formed on the inside surface of the socket housing teeth 270. Consequently, the socket housing teeth 270 may be subjected to large tensile loadings, as is the tension bearing shoulder 304, when the curve drilling assembly 20 is lowered into or lifted out of a borehole 26. The preferred socket housing teeth 270, tension loading shoulder 302, and tension bearing shoulder 304 are constructed and arranged to maximize their tensile strength and to prevent splaying of the socket housing teeth 270 under tensile loading as much as possible. This construction may be accomplished by making the circumferential dimension of the socket housing teeth 270 on the socket housing 252 as large as is possible (while still providing sufficient circumferential dimension for the loading housing teeth 260 that the loading housing teeth 260 have adequate torsional strength and wear characteristics) and by shaping the tension loading shoulder 302 and tension bearing shoulder 304 to reduce splaying of the socket housing teeth 270 as much as possible, as would be known to one skilled in the art in view of the disclosure contained herein.

Preferably, as exemplified in FIG. 22, the thrust loading surface 276 and thrust bearing surface 274 are mating convex and concave surfaces in order to facilitate pivotal motion of the loading member 262 relative to the thrust bushing 282 when thrust is being transferred between the loading housing 250 and socket housing 252 As exemplified in FIG. 22, the preferred thrust loading surface 276 is convex in shape and the thrust bearing surface 274 is concave in shape, although either surface 274, 276 may be convex with the other being concave. In the prototype flexible joint 186, the convex shape of the thrust loading surface 276 and the tension loading shoulder 302 give the loading member 262 a generally spherical or ball shape.

In the preferred embodiment, in order to allow assembly and disassembly of the flexible joint 186, the socket housing first end 264 threadably engages the socket housing second end 266. Preferably, the socket housing first end 264 includes male threading which engages female threading in the bore of the socket housing second end 266. The socket housing second end 266 includes a seating surface 306, or a shoulder, in the socket housing bore 268 against which the compression bearing second end 298 seats in order to transfer thrust between the compression bearing 292 and the socket housing second end 266. The compression bearing second end 298 may include a flange for retaining the compression bearing 292 between the seating surface 306 and the socket housing first end 264, as exemplified in FIG. 22. The compression bearing 292 and thrust bushing 282 may be placed in the bore 268 of the socket housing second end 266 and the socket housing first end 264 may then be threadingly engaged with the socket housing second end 266 to retain the thrust bushing 282 and compression bearing 292 in the socket housing bore 268. Also, the socket housing second end 266 may be disassembled from the socket housing first end 264 to allow access to and removal and installation of the loading member 262 in the loading housing 250. The socket housing second end 266 may be formed in the drill pipe, drill collar, mandrel, or the like to which the socket housing 252 is to be connected.

In the preferred embodiment, the loading member 262 is formed on a shaft 310 and the shaft 310 serves to connect the loading member 262 within the loading housing 250 in such a manner that the loading member 262 may be removed and replaced, as may be the thrust bushing 282 and compression bearing 292 and the socket housing 252. The preferred shaft 310 includes male threading for engaging female threading inside the bore 258 of the loading housing 250. The loading member 262, loading housing 250, socket housing 252, thrust bushing 282, compression bearing 292, and other components of the flexible joint 186 should be made of material suitable for the compressive, tensile, torsional, and other forces expected to be exerted by the drill string 24 on the curve drilling assembly 20 and drill bit 22 during drilling operations, as would be known to one skilled in the art in view of the disclosure contained herein.

The preferred flexible joint 186 is constructed and arranged so that the thrust loading surface 276 and thrust bearing surface 274 are in contact and the loading housing bore 258, loading member bore 263, socket housing bore 268, thrust bushing bore 288, and compression bearing bore 300 define a fluid passageway through the flexible joint 186 in all drilling positions of the flexible joint 186. Similarly to the first embodiment of the flexible joint 186, the bore in the one of the loading member 262 and thrust bushing 282 to be placed uphole of the other may include a nozzle 312 for accelerating drilling fluid passing through the nozzle 312. The bore in the one of the loading member 262 and thrust bushing 282 to be placed on the downhole side of the flexible joint 186 may include a diffuser 314 for recovering fluid pressure dropped in the nozzle 312. As discussed with the first embodiment of the flexible joint 186, the nozzle 312 and diffuser 314 are provided to reduce leakage from inside the flexible joint 186 to the outside. The appropriate nozzle 312 or diffuser 314 may also extend into the compression bearing bore 300. The shaping and positioning of the nozzle 312 and diffuser 314, as well as their materials of construction, will be known to one skilled in the art in view of the disclosure contained herein.

The second preferred embodiment of the flexible joint 186 may be located at either of the uphole and downhole ends of the curve guide means 34, and is preferably placed at the same end of the curve guide means 34 as is the contact means 50 Referring to the example of FIG. 16, the contact means 50 is preferably located at the uphole end 88 of the mandrel 86 and the flexible joint 186 is connected between the drill string 24 and the uphole end 88 of the mandrel 86. Preferably, the socket housing second end 266 is formed by the uphole end 88 of the mandrel 86 and the socket housing first end 264 also forms and serves as the uphole retaining ring 140. The contact means 50 is preferably located on the outside surface of the socket housing first end 264.

FIG. 20 illustrates an embodiment in which the contact means 50 and flexible joint 186 are located at the downhole end 90 of the mandrel 86. In the example of FIG. 20, the socket housing second end 266 is formed by the downhole end 90 of the mandrel 86. The socket housing first end 264 is used to create the downhole retaining ring 142. Further, in the example of FIG. 20, the contact means 50 is formed on the outside surface of the combination downhole retaining ring 142 and socket housing first end 264. Either of the loading housing 250 and socket housing 252 may be used to connect the flexible joint 186 to the mandrel 86. In the embodiment of FIG. 20, the spacing member 178 is connected between the drill bit 22 and the flexible joint 186 in order to allow use of the flexible joint in uniform sizes and to thereby avoid expensive and time consuming custom manufacturing necessary to vary the distance L by varying the length of the flexible joint.

The outside surface 318 of the loading housing first end 254 and the outside surface 320 of the socket housing first end 264 are preferably beveled or chamfered, as exemplified in FIGS. 16, 20, and 22, so that the teeth 260, 270 do not protrude and dig into the borehole wall 28 when the flexible joint 186 is deflected.

5.0 TEST DATA

Figures 23A, 23B, 23C:
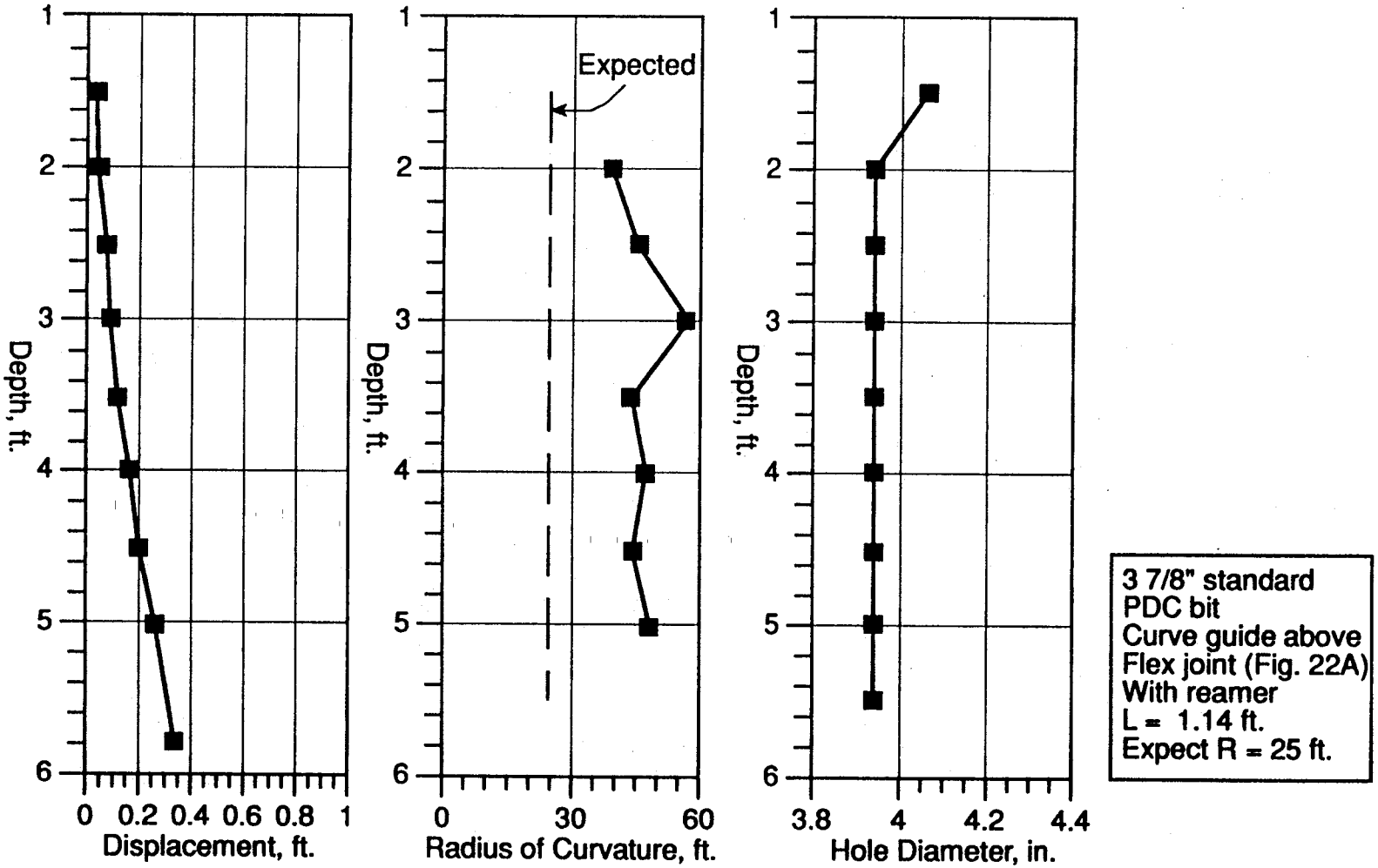
FIG. 23 is a plot of test data illustrating the performance of a prior curve drilling assembly

FIGS. 23-27 present test data which may be used to compare the curve drilling assembly 20 of the present invention with prior curve drilling assemblies. For the tests, a drill truck was set up to drill into a limestone block. In each test an 18 inch deep borehole was first drilled to act as a pilot hole for the assembly The curved section of the borehole was then drilled in 1½ foot increments. After drilling each 1½ foot increment, the drilling was stopped and the rotational orientation of the curve drilling assembly in the borehole was visually checked. In most cases the borehole engaging means was pulled to the top of the hole and rerun before drilling resumed. After each borehole was drilled, it was calipered with a tool that was especially designed for the tests. The inclination of the borehole was measured and the curvature was calculated in ½ foot segments of axial length FIG. 23 presents the test results of a prior curve drilling assembly which included a conventional 3⅞ inch diameter PDC drill bit connected to the downhole end of a mandrel. The uphole end of the mandrel was connected to a flexible joint 186 similar to the one exemplified in FIG. 22A. An eccentrically bored rotatable collar (curve guide) was placed on the drill string on the uphole side of the flexible joint to create the deflection and to maintain the azimuthal direction of the deflection in the borehole. A 3⅞ inch reamer was located immediately uphole from the base portion 36 of the drill bit 22. The assembly was sized to drill a 25 foot radius of curvature using the formula $$R_c = L^2/(d_1 - d_2)$$

where:

L = the distance between the lowermost cutting edge of the lowermost gauge cutter on the drill bit and the uphole end of the flexible joint;

$d_1$ = the outside diameter of the drill bit; and $d_2$ = the outside diameter of the flexible joint.

Referring to FIG. 23, it can be seen that the diameter of the drill borehole was approximately ⅛ inch overgauged and that the radius of curvature unpredictably oscillated around 45 feet. The radius of curvature was at least 20 feet greater than predicted with the formula at all of the measured intervals except one.

Figures 24A, 24B, 24C:
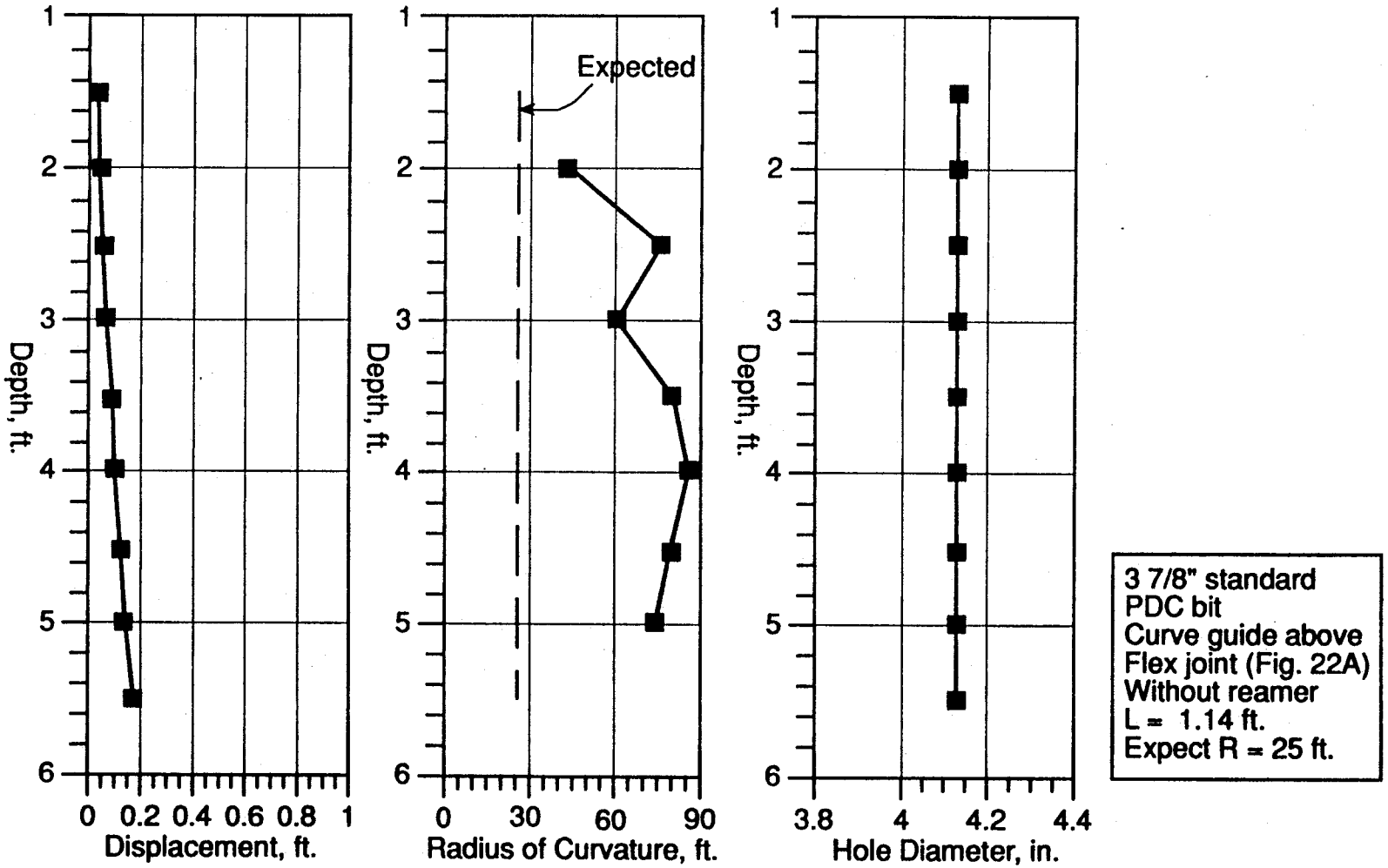
FIG. 24 is a plot of test data illustrating the performance of another prior curve drilling assembly.

The curve drilling assembly tested for FIG. 24 utilized the same configuration and flexible joint 186 as the assembly tested for FIG. 23, but the reamer was eliminated for the test of FIG. 24. The assembly was designed for drilling a 25 foot radius of curvature using the formula $$R_c = L^2/(d_1 - d_2)$$

where:

L = the distance between the lowermost cutting edge of the lowermost gauge cutter and the uphole end of the sliding surface of the contact means on the flexible joint;

$d_1$ = the outside diameter of the drill bit; and $d_2$ = the outside diameter of the contact ring.

Referring to the data plotted in FIG. 24, it is seen that the assembly drilled a borehole diameter that was approximately ¼ inch overgauged and the radius of curvature unpredictably oscillated around 75 feet. The radius of curvature was at least 35 feet greater than predicted with the formula at all of the measured intervals except one.

Figures 25A, 25B, 25C:
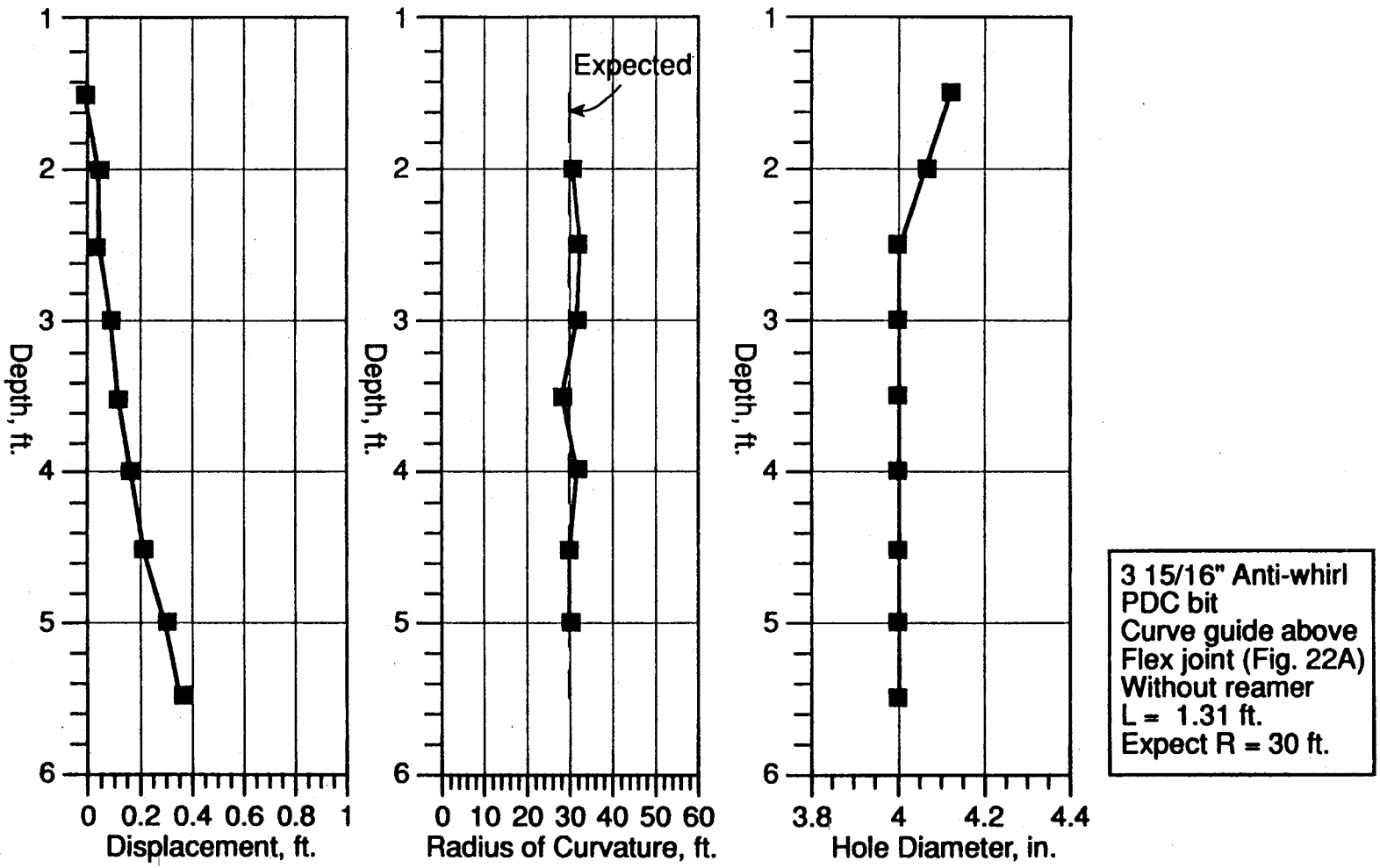
FIG. 25 is a plot of test data illustrating the performance of an embodiment of a curve drilling assembly of the present invention similar to that shown in FIG. 20, but using the flexible joint of FIG. 22A.

FIG. 25 presents test results obtained utilizing an embodiment of the curve drilling assembly 20 of the present invention similar to the embodiments of FIG. 20, but using the flexible joint 186 of FIG. 22A. A 3-15/16 inch diameter drill bit 22 according to the present invention was used. The flexible joint 186 was located between the downhole end 90 of the mandrel 86 and the drill bit 22 with the contact means 50 on the downhole end 90 of the mandrel 86. The assembly was designed to drill a 30 foot radius of curvature using the formula as described for the test of FIG. 24. No reamer was used. Referring to the data plotted on FIG. 25, it is seen that the assembly drilled a borehole that was approximately 1/16 inch oversized and which had a substantially constant radius of curvature of 30 feet.

Figures 26A, 26B, 26C:
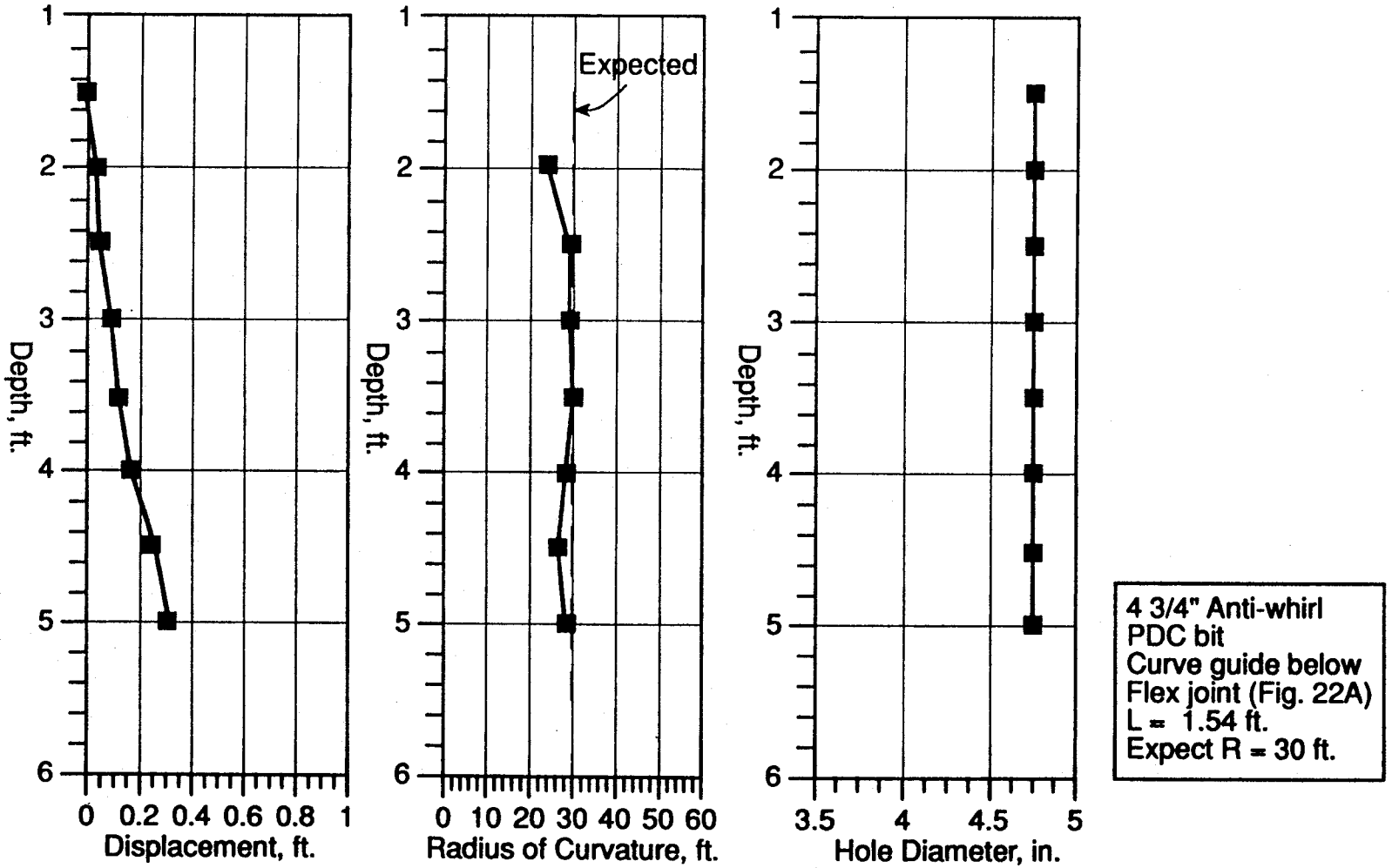
FIG. 26 is a plot of test data illustrating the performance of an embodiment of a curve drilling assembly of the present invention similar to the one shown in FIG. 16, but using the flexible joint of FIG. 22A.

FIG. 26 presents test results utilizing an embodiment of the curve drilling assembly 20 of the present invention similar to the embodiment of FIGS. 16 and 21, but using the flexible joint 186 of FIG. 22A. A 4¾ inch diameter drill bit 22 according to the present invention was used. The flexible joint 186 was located between the drill string 24 and the curve guide means 34 with the contact means 50 on the uphole end 88 of the mandrel 86. The assembly was designed to drill a 30 foot radius of curvature using the formula as described for the test of FIG. 24. No reamer was used. Referring to the data plotted in FIG. 26, it is seen that the assembly drilled a borehole having an about gauge diameter and having a substantially constant radius of curvature of 30 feet.

Figures 27A, 27B, 27C:
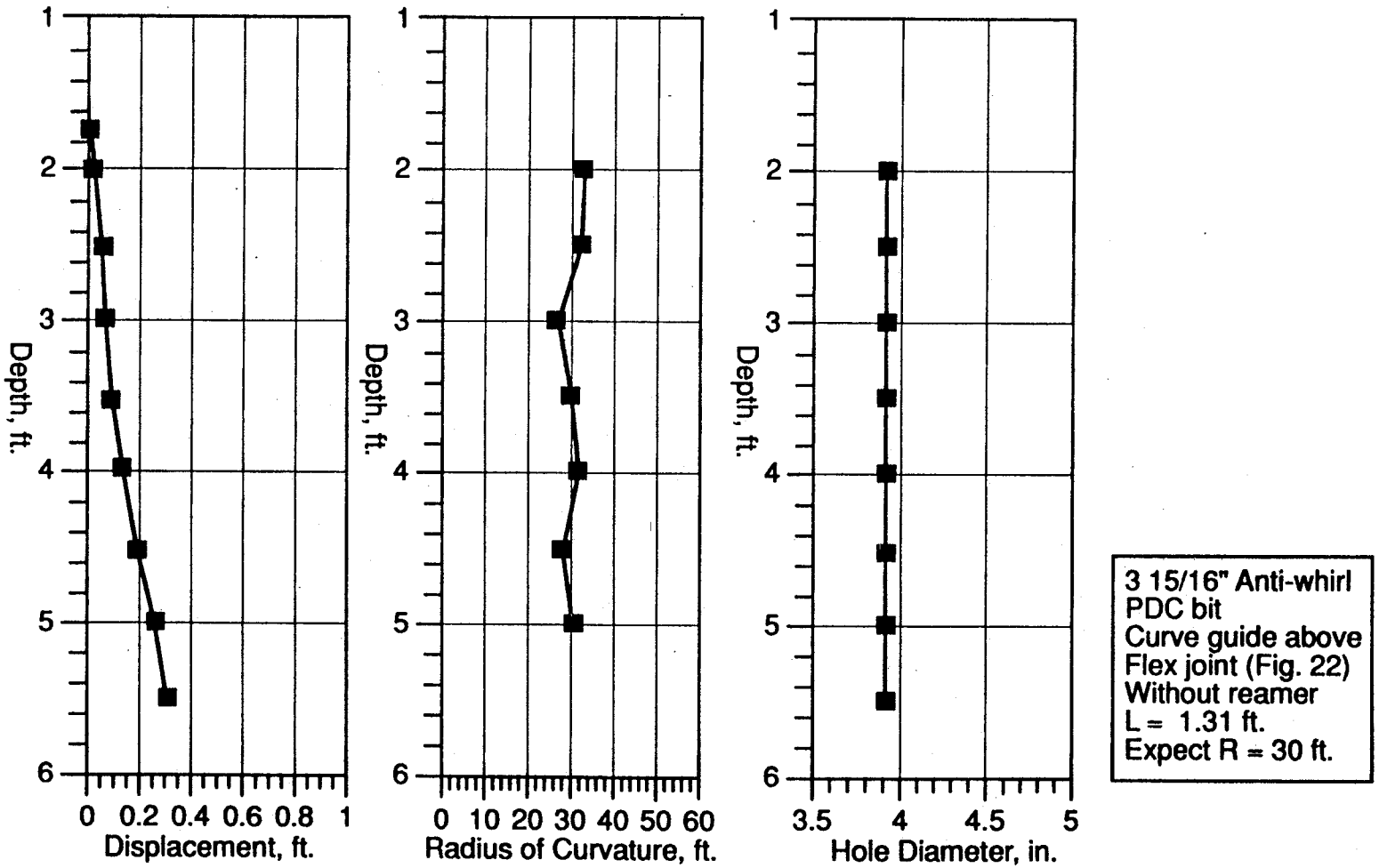
FIG. 27 is a plot of test data illustrating the performance of an embodiment of a curve drilling assembly of the present invention similar to the one shown in FIG. 20 and using the flexible joint of FIG. 22.

FIG. 27 presents test results utilizing an embodiment of the curve drilling assembly 20 of the present invention similar to the embodiment of FIG. 20 and using the flexible joint 186 of FIG. 22. A 3-15/16 inch diameter drill bit 22 according to the present invention was used. The flexible joint 186 was located between the downhole end 90 of the mandrel 86 and the drill bit 22 with the contact means 50 on the downhole end 90 of the mandrel 86. The assembly was designed to drill a 30 foot radius of curvature using the formula as described for the test of FIG. 24. No reamer was used. Referring to the data plotted in FIG. 27, it is seen that the assembly drilled a borehole having an about gauge diameter and having a substantially constant radius of curvature of 30 feet.

Because of the limited vertical depth of some subterranean formations, in order to drill laterally into the formation with a curve drilling assembly, it is important that the curve drilling assembly be able to drill a curved borehole having a reliably predictable radius of curvature. By "reliably predictable" is meant a radius of curvature that is sufficiently constant and repeatable that the trajectory of the curved borehole can be accurately predicted. If the radius of curvature unpredictably varies (as in FIGS. 23 and 24) the trajectory of the curved borehole will also unpredictably vary and the desired ability to predictably drill laterally into a selected formation will be diminished. As FIGS. 25–27 illustrate, the curve drilling assembly 20 of the present invention drills a curved borehole having a radius of curvature which is reliably predictable with the given formula and which is substantially constant.

While presently preferred embodiments of the invention have been described herein for the purpose of disclosure, numerous changes in the construction and arrangement of parts and the performance of steps will suggest themselves to those skilled in the art, which changes are encompassed within the spirit of this invention, as defined by the following claims

What is claimed is:

1. Curve drilling assembly connectable to a rotary drill string for drilling a curved subterranean borehole having an inside radius and an outside radius, the assembly, comprising:

curve guide means connectable with the drill string for deflecting the drill string toward the outside radius of a curved borehole;

a rotary drill bit having a base portion disposed about a longitudinal bit axis for connection through the curve guide means with the drill string, a gauge portion disposed about the longitudinal bit axis and extending from the base portion, a face portion disposed about the longitudinal bit axis and extending from the gauge portion, and a plurality of cutting elements disposed on the face portion;

a flexible joint for connecting the drill bit with the curve guide means;

imbalance force means, rotatable with the drill string, for creating a net imbalance force along a net imbalance force vector substantially perpendicular to the longitudinal bit axis during drilling; and bearing means, rotatable with the drill string and located in the curve drilling assembly near the cutting elements for intersecting a force plane formed by the longitudinal bit axis and the net imbalance force vector and for substantially continuously contacting the borehole wall during drilling.

2. Curve drilling assembly connectable to a rotary drill for drilling a curved subterranean borehole having an inside radius and an outside radius, the assembly, comprising:

curve guide means connectable with the drill string for deflecting the drill string toward the outside radius of a curved borehole;

a rotary drill bit having a base portion disposed about a longitudinal bit axis for connection through the curve guide means with the drill string, a gauge portion disposed about the longitudinal bit axis and extending from the base portion, a face portion disposed about the longitudinal bit axis and extending from the gauge portion, and a plurality of cutting elements disposed on the face portion;

a flexible joint for connecting the curve guide means with the drill string;

imbalance force means, rotatable with the drill string, for creating a net imbalance force along a net imbalance force vector substantially perpendicular to the longitudinal bit axis during drilling; and bearing means, rotatable with the drill string and located in the curve drilling assembly near the cutting elements for intersecting a force plane formed by the longitudinal bit axis and the net imbalance force vector and for substantially continuously contacting the borehole wall during drilling.

3. Curve drilling assembly connectable to a rotary drill string for drilling a curved subterranean borehole having an inside radius and an outside radius, the assembly, comprising:

curve guide means connectable with the drill string for deflecting the drill string toward the outside radius of a curved borehole, in which the curve guide means comprises a mandrel rotatably disposed within a housing;

a rotary drill bit having a base portion disposed about a longitudinal bit axis for connection through the curve guide means with the drilling string, a gauge portion disposed about the longitudinal bit axis and extending from the base portion, a face portion disposed about the longitudinal bit axis and extending from the gauge portion, and a plurality of cutting elements disposed on the face portion;

imbalance force means, rotatable with the drill string, for creating a net imbalance force along a net imbalance force vector substantially perpendicular to the longitudinal bit axis during drilling; and bearing means, rotatable with the drill string and located in the curve drilling assembly near the cutting elements for intersecting a force plane formed by the longitudinal bit axis and the net imbalance force vector and for substantially continuously contacting the borehole wall during drilling.

4. Curve drilling assembly of claim 3 in which the cutting elements comprise: diamond cutting elements

5. Curve drilling assembly of claim 3 in which the cutting elements comprise:

polycrystalline diamond compact cutting elements.

6. Curve drilling assembly of claim 3:

wherein the bearing means is within a substantially continuous cutting element devoid region disposed on the gauge portion of the drill bit.

7. Curve drilling assembly of claim 2:

wherein the cutting element devoid region on the drill bit extends along about 20% to 70% of the gauge circumference of the drill bit.

8. Curve drilling assembly of claim 3 in which the imbalance force means comprises:

a radial imbalance force, the cutting elements being disposed for creating the radial imbalance force along a radial imbalance force vector during drilling.

9. Curve drilling assembly of claim 8 in which the imbalance force means comprises:

a circumferential imbalance force, the cutting elements being disposed for creating the circumferential imbalance force along a circumferential imbalance force vector during drilling

10. Curve drilling assembly of claim 9:

wherein the net imbalance force vector is a resultant of the radial imbalance force vector and the circumferential imbalance force vector.

11. Curve drilling assembly of claim 3:

wherein the cutting elements are disposed for causing the net imbalance force vector to have an equilibrium direction and for causing the net imbalance force vector to return substantially to the equilibrium direction in response to a disturbing displacement.

12. Curve drilling assembly of claim 3:

wherein the cutting elements are disposed for causing the force plane of the net imbalance force to intersect a leading portion of the bearing means during drilling.

13. Curve drilling assembly of claim 6 in which the bearing means comprises:

a substantially smooth wear-resistant sliding surface for slidably contacting the borehole wall during drilling.

14. Curve drilling assembly of claim 13:

wherein the sliding surface has a size sufficient to encompass the net imbalance force vector as the net imbalance force vector moves in response to a change in hardness of the borehole wall during drilling.

15. Curve drilling assembly of claim 13:

wherein the net imbalance force is of sufficient magnitude and the sliding surface is of sufficient surface area that the magnitude of the net imbalance force acting along the net imbalance force vector through the sliding surface is less than the compressive strength of the borehole wall.

16. Curve drilling assembly of claim 6:

wherein the cutting element devoid region extends around at least about 50% of the gauge circumference of the drill bit.

17. Curve drilling assembly of claim 16 in which the drill bit comprises:

at least one gauge cutting element disposed on the gauge portion of the drill bit so that a radial plane of the drill bit extending through the gauge cutting element defines an angle of at least 90 degrees and not more than 270 degrees with the force plane.

18. Curve drilling assembly of claim 17:

wherein the force plane moves circumferentially on the gauge portion of the drill bit in response to a disturbance of the curve drilling assembly during drilling; and wherein the cutting elements are disposed for causing the force plane to remain within a force plane arc on the circumference of the gauge portion; and wherein the gauge cutting elements are located within a gauge cutting arc on the gauge portion, the gauge cutting arc being substantially diametrically opposite to the force plane arc.

19. Curve drilling assembly of claim 16 in which the drill bit comprises:

at least one gauge cutting element disposed on the gauge portion of the drill bit substantially opposite to the intersection of the force plane with the bearing means.

20. Curve drilling assembly of claim 3 in which the drill bit comprises:

at least one gauge cutting element located on the gauge portion of the drill bit; and wherein the bearing means is further defined as forcing the gauge cutting element into cutting engagement with the borehole wall when the gauge cutting element is about axially coincident with the inside radius of the curved borehole.

21. Curve drilling assembly of claim 20 in which the bearing means comprises:

a substantially smooth sliding surface, located on the gauge portion of the drill bit substantially opposite to the gauge cutting element, the sliding surface being constructed and arranged to move the gauge cutting element into deeper cutting engagement with the borehole wall when the gauge cutting element is about axially coincident with the inside radius of the curved borehole than when the gauge cutting element is not about axially coincident with the inside radius of the curved borehole.

22. Curve drilling assembly of claim 21, comprising:

a cutting element devoid cutter pad, located on the gauge portion of the drill bit between the gauge cutting element and the base portion of the drill bit, the cutter pad extending radially from the drill bit a lesser distance than the gauge cutting element so that the cutter pad does not cut the borehole wall, the cutter pad being constructed and arranged to cooperate with the sliding surface in moving the gauge cutting element into deeper cutting engagement with the borehole wall when the gauge cutting element is about axially coincident with the inside radius of the curved borehole than when the gauge cutting element is not about axially coincident with the inside radius of the curved borehole.

23. Curve drilling assembly of claim 21:

wherein the sliding surface has an uphole end adjacent the base portion of the drill bit and a downhole end adjacent the face portion of the drill bit; and wherein the gauge cutting element is located nearer to the face portion than is the downhole end of the sliding surface so that the sliding surface does not cut the borehole wall.

24. Curve drilling assembly of claim 3 in which the housing comprises:

borehole engaging means for preventing rotation of the housing with the mandrel during drilling; and mandrel engaging means for rotating the housing with the mandrel when the mandrel is rotated in an opposite direction to the drilling direction.

25. Curve drilling assembly of claim 24:

wherein the borehole engaging means extends radially from the housing in order to engage the borehole wall during drilling.

26. Curved drilling assembly of claim 3:

wherein the rotational axis of the mandrel is skewed with respect to the longitudinal axis of the housing.

27. Curve drilling assembly of claim 3:

wherein the drill string exerts an axial force on the curve drilling assembly; and wherein the deflection of the drill string creates a radial force component of the axial force, the radial force component being directed toward the outside radius of the curved borehole; and in which the curve drilling assembly comprises:

contact means for contacting the borehole wall and supporting the radial force component at the downhole end of the mandrel on the borehole wall.

28. Curve drilling assembly of claim 3, comprising:

a flexible joint, connectable between the drill bit and the downhole end of the mandrel, for flexibly connecting the curve drilling assembly to the drill bit.

29. Curve drilling assembly of claim 28, comprising:

a spacing member, detachably connectable between the drill bit and the flexible joint for varying the distance between the drill bit and the flexible joint without modifying the drill bit, flexible joint, or the mandrel.

30. Curve drilling assembly of claim 3:

wherein the drill string exerts an axial force on the curve drilling assembly; and wherein the deflection of the drill string creates a radial force component of the axial force, the radial force component being directed toward the outside radius of the curved borehole; and in which the curve drilling assembly comprises:

contact means for contacting the borehole wall and supporting the radial force component at the uphole end of the mandrel on the borehole wall.

31. Curve drilling assembly of claim 30, comprising:

a flexible joint, connectable between the drill string and the uphole end of the mandrel, for flexibly connecting the curve drilling assembly to the drill string.

32. Curve drilling assembly of claim 30 in which the contact means comprises:

a contact ring disposed on and circumscribing the outside surface of the uphole end of the mandrel 33. Curve drilling assembly of claim 32:

wherein the contact ring has a substantially smooth wear-resistant sliding surface for slidably contacting the borehole wall during drilling.

34. Curve drilling assembly of claim 33:

wherein the radial force component is of sufficient magnitude and the sliding surface of the contact ring is of sufficient surface area that the magnitude of the radial force component acting on the sliding surface is less than the compressive strength of the borehole wall.

35. Curve drilling assembly of claim 30 in which the contact means comprises a contact ring disposed on and circumscribing the outside surface of the uphole end of the mandrel; and wherein the contact ring extends radially from the outside surface of the mandrel farther than does the outside surface of the housing adjacent the outside radius of the curved borehole so that the curve drilling assembly has load-bearing contact with the borehole wall at the drill bit and the contact ring 36. Curve drilling assembly of claim 30 in which the housing comprises:

angle control means for preventing the magnitude of the deflection from increasing above a predetermined value and decreasing below a predetermined value.

37. Curve drilling assembly of claim 36 in which the housing includes an uphole end, a downhole end, and an outside surface extending between the uphole and downhole ends; and in which the angle control means comprises:

an uphole deflector, extending radially from the outside surface near the uphole end of the housing, for deflectively contacting the borehole wall in order to create the deflection and to prevent the magnitude of the deflection from decreasing below a predetermined value.

38. Curve drilling assembly of claim 37 in which the angle control means comprises a downhole deflector, extending radially from the outside surface near the downhole end of the housing in a radial plane about coincident with the uphole deflector for deflectively contacting the borehole wall in order to prevent the magnitude of the deflection from increasing above a predetermined value.

39. Curve drilling assembly of claim 3:

wherein the curve guide means is further defined as restricting lateral motion of the housing, mandrel, and drill bit in the borehole in order to keep the longitudinal axes of the housing, drill bit, and mandrel about coplanar with a plane defined by the curved borehole.

40. Curve drilling assembly of claim 3 in which the housing includes an uphole end, a downhole end, and an outside surface extending between the uphole and downhole ends; and wherein the outside surface at the downhole end of the housing has a downhole transverse dimension about equal to the outside diameter of the drill bit, the downhole transverse dimension extending in a plane about transverse to a plane of curvature of the curved borehole; and the outside surface at the uphole end of the housing has an uphole transverse dimension about equal to the outside diameter of the drill bit, the uphole transverse dimension extending in a plane about transverse to a plane of curvature of the curved borehole; in order to restrict lateral motion of the housing, mandrel, and drill bit in the borehole and to thereby keep the rotational axes of the housing, mandrel, and drill bit about coplanar with the plane of curvature of the curved borehole.

41. Curve drilling assembly of claim 3, comprising:

a spacing member detachably connectable between the drill bit and the mandrel for varying the length of the assembly without modifying the mandrel or modifying the drill bit.

42. Curved drilling assembly of claim 3:

wherein the rotational axis of the mandrel is skewed with respect to the longitudinal axis of the housing.

43. Curve drilling assembly of claim 3, comprising:

a spacing member detachably connectable between the drill bit and the mandrel for varying the length of the apparatus without modifying the mandrel or modifying the drill bit.

44. Curve drilling assembly of claim 24:

wherein the curve guide means is further defined as restricting lateral motion of the housing, mandrel, and drill bit in the borehole in order to keep the longitudinal axes of the housing, drill bit, and mandrel about coplanar with a plane defined by the curved borehole.

45. Curve drilling assembly connectable between a rotary drill string and drill bit for drilling a curved subterranean borehole having an inside radius and an outside radius, the assembly comprising:

curve guide means for deflecting the drill string toward the outside radius of a curved borehole when an axial force is exerted on the assembly through the drill string, the deflection creating a radial force component of the axial force directed towards the outside radius of the curved borehole, the curve guide means comprising:

a mandrel rotatably disposed within a housing, the mandrel having an uphole end and a downhole end;

contact means for contacting the borehole wall and supporting the radial force component at one of the uphole end and the downhole end of the mandrel on the borehole wall during drilling, said contact means being located at said uphole end of said mandrel; and a flexible joint, connected between said uphole end of said mandrel and the drill string, for flexibly connecting said assembly to the drill string, said flexible joint comprising:

a loading housing having a first end, a second end for connecting the loading housing to one of the uphole end of the mandrel and the drill string, a bore extending through the first and second ends, at least two loading housing teeth extending from the first end, and a loading member disposed in the bore and extending from the first end of the loading housing;

a socket housing for receiving the loading member, the socket housing having a first end, a second end for connecting the socket housing to one of the uphole end of the mandrel and the drill string, a bore extending through the first and second ends, and at least two socket housing teeth extending from the first end of the socket housing for intermeshing with the loading housing teeth in order to form a flexible connection between the loading and socket housings and to transmit rotation and torque between the loading housing and the socket housing, the loading housing teeth and the socket housing teeth being constructed and arranged so that each of at least two loading housing teeth makes torque and rotation transmitting contact with a socket housing tooth when torque is applied across the flexible joint.

46. Flexible joint of claim 45:

wherein the at least two loading housing teeth making torque and rotation transmitting contact are located at about diametrically opposed positions on the first end of the loading housing.

47. Flexible joint of claim 45:

in which the socket housing comprises a thrust bearing surface disposed in the bore of the socket housing; and in which the loading member comprises a thrust loading surface for contacting the thrust bearing surface and transferring thrust between the loading housing and the socket housing; and wherein the thrust loading surface and the thrust bearing surface are constructed and arranged so that the thrust loading surface, when contacting the thrust bearing surface, is pivotable about a pivotal center which is about coplanar with the torque transmitting contact between the teeth.

48. Curve drilling assembly of claim 45 connectable between a rotary drill string and drill bit for drilling a curved subterranean borehole having an inside radius and an outside radius, the assembly comprising:

curve guide means for deflecting the drill string toward the outside radius of a curved borehole when an axial force is exerted on the assembly through the drill string, the deflection creating a radial force component of the axial force directed towards the outside radius of the curved borehole, the curve guide means comprising:

a mandrel rotatably disposed within a housing, the mandrel having an uphole end and a downhole end, the housing having an uphole end, a downhole end, and an outside surface extending between the uphole and downhole ends of the housing, wherein the outside surface of the housing at the downhole end of the housing has a downhole transverse dimension about equal to the outside diameter of the drill bit, the downhole transverse dimension extending in a plane about transverse to a plane of curvature of the curved borehole and the outside surface of the housing at the uphole end of the housing has an uphole transverse dimension about equal to the outside diameter of the drill bit, the uphole transverse dimension extending in a plane about transverse to a plane of curvature of the curved borehole, in order to restrict lateral motion of the housing, mandrel, and drill bit in the borehole and to thereby keep the rotational axes of the housing, mandrel, and drill bit about coplanar with the plane of curvature of the curved borehole; and contact means for contacting the borehole wall and supporting the radial force component at one of the uphole end and the downhole end of the mandrel on the borehole wall during drilling.

49. Curve drilling assembly connectable between a rotary drill string and drill bit for drilling a curved subterranean borehole having an inside radius and an outside radius, the assembly comprising:

curve guide means for deflecting the drill string toward the outside radius of a curved borehole when an axial force is exerted on the assembly through the drill string, the deflection creating a radial force component of the axial force directed towards the outside radius of the curved borehole, the curve guide means comprising: a mandrel rotatably disposed within a housing, the mandrel having an uphole end and a downhole end;

contact means for contacting the borehole wall and supporting the radial force component at one of the uphole end and the downhole end of the mandrel on the borehole wall during drilling, wherein the contact means is located at the downhole end of the mandrel; and a flexible joint, connectable between the downhole end of the mandrel and the drill bit for flexibly connecting the assembly to the drill bit, said flexible joint comprising:

a loading housing having a first end, a second end for connecting the loading housing to one of the uphole end of the mandrel and the drill string, a bore extending through the first and second ends, at least two loading housing teeth extending from the first end, and a loading member disposed in the bore and extending from the first end of the loading housing; and a socket housing for receiving the loading member, the socket housing having a first end, a second end for connecting the socket housing to one of the uphole end of the mandrel and the drill string, a bore extending through the first and second ends, and at least two socket housing teeth extending from the first end of the socket housing for intermeshing with the loading housing teeth in order to form a flexible connection between the loading and socket housings and to transmit rotation and torque between the loading housing and the socket housing, the loading housing teeth and the socket housing teeth being constructed and arranged so that each of at least two loading housing teeth makes torque and rotation transmitting contact with a socket housing when torque is applied across the flexible joint.

50. Flexible joint of claim 49:

wherein the at least two loading housing teeth making torque and rotation transmitting contact are located at about diametrically opposed positions on the first end of the loading housing.

51. Flexible joint of claim 49:

in which the socket housing comprises a thrust bearing surface disposed in the bore of the socket housing; and in which the loading member comprises a thrust loading surface for contacting the thrust bearing surface and transferring thrust between the loading housing and the socket housing; and wherein the thrust loading surface and the thrust bearing surface are constructed and arranged so that the thrust loading surface, when contacting the thrust bearing surface, is pivotable about a pivotal center which is about coplanar with the torque transmitting contact between the teeth.

52. Curve drilling assembly connectable between a rotary drill string and drill bit for drilling a curved subterranean borehole having an inside radius and an outside radius, the assembly comprising:

curve guide means for deflecting the drill string toward the outside radius of a curved borehole when an axial force is exerted on the assembly through the drill string, the deflection creating a radial force component of the axial force directed towards the outside radius of the curved borehole, the curve guide means comprising:

a mandrel rotatably disposed within a housing, the mandrel having an uphole end and a downhole end, and wherein the housing comprises:

borehole engaging means for preventing rotation of the housing with the mandrel during drilling; and mandrel engaging means for rotating the housing with the mandrel when the mandrel is rotated in an opposite direction to the drilling direction; and contact means for contacting the borehole wall and supporting the radial force component at one of the uphole end and the downhole end of the mandrel on the borehole wall during drilling.

53. Curve drilling assembly of claim 52:

wherein the borehole engaging means extends radially from the housing in order to engage the borehole wall during drilling.

54. Curve drilling assembly connectable between a rotary drill string and drill bit for drilling a curved subterranean borehole having an inside radius and an outside radius, the assembly comprising:

curve guide means for deflecting the drill string toward the outside radius of a curved borehole when an axial force is exerted on the assembly through the drill string, the deflection creating a radial force component of the axial force directed towards the outside radius of the curved borehole, the curve guide means comprising:

a mandrel rotatably disposed within a housing, the mandrel having an uphole end and a downhole end; and contact means for contacting the borehole wall and supporting the radial force component at one of the uphole end and the downhole end of the mandrel on the borehole wall during drilling wherein the contact means comprises: a contact ring disposed on and circumscribing the outside surface of one end of the mandrel; and wherein the contact ring extends radially from the outside surface of the mandrel farther than does the outside surface of the housing adjacent the outside radius of the curved borehole so that the curve drilling assembly has load-bearing contact with the borehole wall at the drill bit and the contact ring.

55. Curve drilling assembly of claim 54, wherein said one end is the downhole end of the mandrel so that the curve drilling assembly has load-bearing contact with the borehole wall at the contact ring and the outside surface of the housing does not contact the outside radius of the curved borehole.

56. Curve drilling assembly connectable between a rotary drill string and drill bit for drilling a curved subterranean borehole having an inside radius and an outside radius, the assembly comprising:

curve guide means for deflecting the drill string toward the outside radius of a curved borehole when an axial force is exerted on the assembly through the drill string, the deflection creating a radial force component of the axial force directed towards the outside radius of the curved borehole, the curve guide means comprising a mandrel rotatably disposed within a housing, the mandrel having an uphole end and a downhole end; and contact means for contacting the borehole wall and supporting the radial force component at one of the uphole end and the downhole end of the mandrel on the borehole wall during drilling wherein the housing comprises:

angle control means for preventing the magnitude of the deflection from increasing above a predetermined value and decreasing below a predetermined value.

57. Curve drilling assembly of claim 56 in which the housing includes an uphole end, a downhole end, and an outside surface extending between the uphole and downhole ends; and wherein the contact means is located at the uphole end of the mandrel; and in which the angle control means comprises:

an uphole deflector, extending radially from the outside surface near the uphole end of the housing, for deflectively contacting the borehole wall in order to create the deflection and to prevent the magnitude of the deflection from decreasing below a predetermined value.

58. Curve drilling assembly of claim 57 in which the angle control means comprises:

a downhole deflector, extending radially from the outside surface near the downhole end of the housing in a radial plane about coincident with the uphole deflector for deflectively contacting the borehole wall in order to prevent the magnitude of the deflection from increasing above a predetermined value.

59. Curve drilling assembly of claim 56 in which the housing includes an uphole end, a downhole end, and an outside surface extending between the uphole and downhole ends; and wherein the contact means is located at the downhole end of the mandrel; and in which the angle control means comprises:

a downhole deflector, extending radially from the outside surface near the downhole end of the housing, for deflectively contacting the borehole wall in order to create the deflection and to prevent the magnitude of the deflection from decreasing below a predetermined value.

60. Curve drilling assembly connectable between a rotary drill string and drill bit for drilling a curved subterranean borehole having an inside radius and an outside radius, the assembly comprising:

curve guide means for deflecting the drill string toward the outside radius of a curved borehole when an axial force is exerted on the assembly through the drill string, the deflection creating a radial force component of the axial force directed towards the outside radius of the curved borehole, the curve guide means comprising a mandrel rotatably disposed within a housing, the mandrel having an uphole end and a downhole end;

contact means for contacting the borehole wall and supporting the radial force component at one of the downhole end and the downhole end of the mandrel on the borehole wall during drilling; and signaling means for generating a signal when the housing is in a preselected rotational orientation with respect to the mandrel in order to monitor the rotational orientation of the housing from the surface of the earth, the signaling means comprising:

a signal ring detachably connectable to the housing; and a signal ring bushing, located between the signal ring and the mandrel, in order to facilitate rotation of the mandrel relative to the signal ring.

61. Curve drilling assembly of claim 60 in which the housing includes an uphole end and a downhole end; and wherein the signal ring is detachably connectable to one of the uphole and the downhole ends of the housing in order to facilitate removal and replacement of the signal ring and signal ring bushing.

62. Curve drilling assembly in claim 60:

wherein the signal ring bushing is press fit into the signal ring and then machined out to the desired thickness.

63. Curve drilling assembly connectable between a rotary drill string and drill bit for drilling a curved subterranean borehole having an inside radius and an outside radius, the assembly comprising:

curve guide means for deflecting the drill string toward the outside radius of a curved borehole when an axial force is exerted on the assembly through the drill string, the deflection creating a radial force component of the axial force directed towards the outside radius of the curved borehole, the curve guide means comprising:

a mandrel rotatably disposed within a housing, the mandrel having an uphole end and a downhole end;

an uphole retaining ring, connectable to the mandrel at the uphole end of the housing, for retaining the housing on the mandrel, the uphole retaining ring having an outside surface extending beyond the uphole end of the mandrel; and contact means for contacting the borehole wall and supporting the radial force component at one of the uphole end and the downhole end of the mandrel on the borehole wall during drilling, wherein the contact means is located on the outside surface of the uphole retaining ring.

64. Curve drilling assembly connectable between a rotary drill string and drill bit for drilling a curved subterranean borehole having an inside radius and an outside radius, the assembly comprising:

curve guide means for deflecting the drill string toward the outside radius of a curved borehole when an axial force is exerted on the assembly through the drill string, the deflection creating a radial force component of the axial force directed towards the outside radius of the curved borehole, the curve guide means comprising:

a mandrel rotatably disposed within a housing, the mandrel having an uphole end and a downhole end;

a downhole retaining ring, connectable to the mandrel at the downhole end of the housing, for retaining the housing on the mandrel, the downhole retaining ring having an outside surface extending beyond the downhole end of the mandrel; and contact means for contacting the borehole wall and supporting the radial force component at one of the uphole end and the downhole end of the mandrel on the borehole wall during drilling, wherein the contact means is located on the outside surface of the downhole retaining ring.

65. A flexible joint for transmitting rotation, torque, thrust, and tension across a bend or other nonlinearity in a rotatable conduit, such as the curve creating deflection in a rotary drill string used in drilling curved subterranean boreholes, comprising:

a loading housing having a first end, a second end for connecting the loading housing into the drill string, a bore extending through the first and second ends, at least two loading housing teeth extending from the first end, and a loading member disposed in the bore and extending from the first end of the loading housing;

a socket housing for receiving the loading member, the socket housing having a first end, a second end for connecting the socket housing into the drill string, a bore extending through the first and second ends, and at least two socket housing teeth extending from the first end of the socket housing for intermeshing with the loading housing teeth in order to form a flexible connection between the loading and socket housings and to transmit rotation and torque between the loading housing and the socket housing; and wherein the loading housing teeth and the socket housing teeth are constructed and arranged so that each of at least two loading housing teeth makes torque and rotation transmitting contact with a socket housing tooth when torque is applied across the flexible joint.

66. Flexible joint of claim 65:

wherein the at least two loading housing teeth making torque and rotation transmitting contact are located at about diametrically opposed positions on the first end of the loading housing.

67. Flexible joint of claim 65:

in which the socket housing comprises a thrust bearing surface disposed in the bore of the socket housing; and in which the loading member comprises a thrust loading surface for contacting the thrust bearing surface and transferring thrust between the loading housing and the socket housing; and wherein the thrust loading surface and the thrust bearing surface are constructed and arranged so that the thrust loading surface, when contacting the thrust bearing surface, is pivotable about a pivotal center which is about coplanar with the torque transmitting contact between the teeth.

68. Flexible joint of claim 65:

in which the loading member comprises a thrust loading surface for transferring thrust between the loading housing and the socket housing; and in which the socket housing comprises a thrust bushing for transferring thrust between the loading member and the socket housing, the thrust bushing having a first end, a second end, and a bore passing through the first and second ends, the first end of the thrust bushing including a thrust bearing surface for contacting the thrust loading surface and transferring thrust between the thrust loading surface and the bushing, the thrust bushing being movably disposed in the bore of the socket housing in such a manner that the thrust bearing surface is free to move laterally in the bore of the socket housing with the thrust loading surface and loading member.

69. Flexible joint of claim 68 in which the socket housing comprises:

a compression bearing for transferring thrust between the thrust bushing and the socket housing, the compression bearing having a compression bearing surface disposed in the bore of the socket housing between the second end of the thrust bushing and the socket housing with the compression bearing surface adjacent the second end of the thrust bushing, the second end of the thrust bushing and the compression bearing surface being constructed and arranged such that the second end of the thrust bushing slidably engages the compression bearing surface in order to enhance the ability of the thrust bearing surface and thrust bushing to move laterally with the thrust loading surface and loading member.

70. Flexible joint of claim 65:

in which the loading member includes a tension loading shoulder extending laterally outwardly from the loading member; and in which the socket housing includes a tension bearing shoulder extending laterally inwardly in the bore of the socket housing for capturing the tension loading shoulder of the loading member in the socket housing and for contacting the tension loading shoulder and transferring tension between the loading housing and the socket housing; and wherein the tension loading shoulder and the tension bearing shoulder are constructed and arranged so that each of at least two loading housing teeth makes torque and rotation transmitting contact with a socket housing tooth before the loading member makes torque transmitting contact with the socket housing when torque is applied across the flexible joint.

* * * * *

UNITED STATES PATENT AND TRADEMARK OFFICE

CERTIFICATE OF CORRECTION

PATENT NO. : 5,213,168

DATED : May 25, 1993

INVENTOR(S) : Tommy M. Warren, et al

It is certified that error appears in the above-indentified patent and that said Letters Patent is hereby corrected as shown below:

| Col. | Line | |
|---|---|---|
| 8 | 21 | "the inventors, research" should read --the inventors' research--. |
| 8 | 22 | **"37/8 $^{7}/_{8}$ inch" should read --3-$^{7}/_{8}$ inch--.** |
| 13 | 20 | **"FIGS. 3 and 4" should read --FIGS. 1, 3 and 4--.** |
| 17 | 65 | **"$F_n$" should read --$F_{ri}$--.** |
| 18 | 1 | **"and $F_n$" should read --and $F_{ri}$--.** |
| 21 | 16 | **"inside radius R" should read --inside radius $R_i$--.** |
| 40 | 65-66 | **"a rotary drill for drilling" should read --a rotary drill string for drilling--.** |
| 41 | 37 | **"drilling string" should read --drill string--.** |

Signed and Sealed this

Third Day of May, 1994

Bruce Lehman

*Attest:*

BRUCE LEHMAN

*Attesting Officer*

*Commissioner of Patents and Trademarks*